US008508566B2

(12) United States Patent
Ohno

(10) Patent No.: US 8,508,566 B2
(45) Date of Patent: Aug. 13, 2013

(54) LIGHT EMITTING APPARATUS, PRINT HEAD AND IMAGE FORMING APPARATUS

(75) Inventor: Seiji Ohno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 58 days.

(21) Appl. No.: 13/195,350

(22) Filed: Aug. 1, 2011

(65) Prior Publication Data

US 2012/0249715 A1 Oct. 4, 2012

(30) Foreign Application Priority Data

Mar. 29, 2011 (JP) ..... 2011-072830

(51) Int. Cl.
*B41J 2/435* (2006.01)
*B41J 2/47* (2006.01)

(52) U.S. Cl.
USPC ..... 347/237; 347/247

(58) Field of Classification Search
USPC ..... 347/224, 237, 238, 247
See application file for complete search history.

(56) References Cited

U.S. PATENT DOCUMENTS

2010/0118100 A1* 5/2010 Ohno ..... 347/130
2010/0118108 A1 5/2010 Ohno
2010/0177155 A1* 7/2010 Kii ..... 347/224

FOREIGN PATENT DOCUMENTS

JP A-2010-111085 5/2010

* cited by examiner

*Primary Examiner* — Hai C Pham
(74) *Attorney, Agent, or Firm* — Oliff & Berridge, PLC

(57) ABSTRACT

A light emitting apparatus includes a plurality of light emitting chips, a first wire, a second wire, a third wire, and a fourth wire. The plurality of light emitting chips each have a plurality of light emitting devices and are divided into a plurality of chip groups, the light emitting devices in each of the light emitting chips being divided into a plurality of device groups. The first wire transmits in common a transmission signal to the light emitting chips. The second wire transmits in common a first selection signal to a given chip group of the light emitting chips. The third wire transmits in common a second selection signal to a set of the device groups. The fourth wire transmits a turn-on control signal to each of the chip groups.

5 Claims, 18 Drawing Sheets

65
62
C
φR
φWe
φ1
80
102
φE
φWo
φ2
Vga
X
Y
φWo1
φWo2
φWo3
φWo4
φWo5
φWo20
205o1
205o2
205o3
205o4
205o5
150o
63
Ca1 (C)
Ca2
Ca3
Ca4
Ca5
Cb1
Cb2
Cb3
Cb4
Cb5
#a
#b
150e
205e1
205e2
205e3
205e4
φWe1
φWe2
φWe3
φWe4
φWe20
204a
202a
201a
203a
200b
200a
203b
201b
202b
204b
110
φRa
φ2a
φ1a
φEa
Vga
Vsub
φEb
φ1b
φ2b
φRb
140a
120a
130a
170
160
130b
120b
140b C
T1
D1
Rx1
Ry1
L1
T2
D2
Gt2
Gt1
S1
S2
S3
S4
L2
L3
L4
Ds
R1
TE1
TE2
RW1
RE
RI1
RI2
VIB
φ1
φ2
Vga
φWo
φE
Vsub 65
62
C
φR
φWr
φ1
80
102
φE
φWl
φ2
Vga
X
Y
φWl1
φWl2
φWl3
φWl4
φWl5
φWl20
205l1
205l2
205l3
205l4
205l5
150l
63
Ca1 (C)
Ca2
Ca3
Ca4
Ca5
Cb1
Cb2
Cb3
Cb4
Cb5
#a
#b
150r
φWr1
φWr2
φWr3
φWr4
φWr20
205r1
205r2
205r3
205r4
204a
202a
201a
203a
200b
200a
203b
201b
202b
204b
110
φRa
φ2a
φ1a
φEa
Vga
Vsub
φEb
φ1b
φ2b
φRb
140a
120a
130a
170
160
130b
120b
140b 65
62
C
φ1
φWr
φ1
80
102
φE
φWl
φ2
Vga
X
Y
φWl1
φWl2
φWl3
φWl4
φWl5
φWl20
205l1
205l2
205l3
205l4
205l5
150l
63
#a
#b
Ca1 (C)
Ca2
Ca3
Ca4
Ca5
Cb1
Cb2
Cb3
Cb4
Cb5
205r1
205r2
205r3
205r4
150r
φWr1
φWr2
φWr3
φWr4
φWr20
204a
202a
201a
203a
200b
200a
203b
201b
202b
204b
110
φ1a
φ2a
φ1a
φEa
Vga
Vsub
φEb
φ1b
φ2b
φ1b
180a
120a
130a
170
160
130b
120b
180b 65
62
C
φ1
φEr
φ1
80
102
φW
φEl
Vga φ2
Vga
X
Y
φEl1
φEl2
φEl3
φEl4
φEl5
φEl20
2031l
2032l
2033l
2034l
2035l
130l
63
#a
#b
Ca1 (C)
Ca2
Ca3
Ca4
Ca5
Cb1
Cb2
Cb3
Cb4
Cb5
2031r
2032r
2033r
2034r
130r
φEr1
φEr2
φEr3
φEr4
φEr20
204a
202a
201a
205a
200b
200a
205b
201b
202b
204b
110
φ1a
φ2a
φ1a
φWa
Vga
Vsub
φWb
φ1b
φ2b
φ1b
180a
120a
150a
170
160
150b
120b
180b

LIGHT EMITTING APPARATUS, PRINT HEAD AND IMAGE FORMING APPARATUS

CROSS-REFERENCE TO RELATED APPLICATIONS

This application is based upon and claims priority under 35 USC 119 from Japanese Patent Application No. 2011-072830, filed Mar. 29, 2011.

BACKGROUND

1. Technical Field

The present invention relates to a light emitting apparatus, a print head, and an image forming apparatus.

2. Related Art

In an electrographic image forming apparatus such as a printer, a copy machine, a facsimile, or the like, image forming is performed by obtaining an electrostatic latent image through irradiation of image information onto a photoconductor that is uniformly charged using optical recording unit, visualizing the electrostatic latent image through addition of toner to the electrostatic latent image, transferring and fusing the electrostatic latent image onto a recording paper. As such optical recording unit, in addition to an optical scanning system that performs exposure by scanning laser light in a main scanning direction using a laser, a recording apparatus using an LED print head (LPH) that is provided by arranging a plurality of light emitting diodes (LEDs) in a main scanning direction as light emitting devices has recently been adopted in response to demand for miniaturization of the apparatus.

SUMMARY OF THE INVENTION

According to an aspect of the invention, a light emitting apparatus includes a plurality of light emitting chips, a first wire, a second wire, a third wire, and a fourth wire. The plurality of light emitting chips each have a plurality of light emitting devices and are divided into a plurality of chip groups, the light emitting devices in each of the light emitting chips being divided into a plurality of device groups. The first wire transmits in common a transmission signal to the light emitting chips in order to successively set the light emitting devices in each of the light emitting chips as subjects of turn-on or non-turn-on control. The second wire transmits in common a first selection signal to a given chip group of the light emitting chips in order to select the given chip group as a subject of the turn-on control in a period in which the light emitting devices in each of the light emitting chips are set as the subjects of the turn-on or non-turn-on control based on the transmission signal. The third wire transmits in common a second selection signal to a set of the device groups in order to select the set of the device groups as a subject of the turn-on control in the period in which the light emitting devices in each of the light emitting chips are set as the subjects of the turn-on or non-turn-on control based on the transmission signal. The set of the device groups includes a first device group of the light emitting devices in the light emitting chips belonging to one of the chip groups and a second device group of the light emitting devices in the light emitting chips belonging to the others of the chip groups. The fourth wire transmits a turn-on control signal to each of the chip groups in order to control power supply for turning on the light emitting devices in the period in which the light emitting devices in each of the light emitting chips are set as the subjects of the turn-on or non-turn-on control based on the transmission signal.

BRIEF DESCRIPTION OF THE DRAWINGS

Exemplary embodiments of the invention will be described in detail based on the following figures, wherein.

DETAILED DESCRIPTION

Hereinafter, exemplary embodiments of the present invention will be described in detail with reference to the drawings.

First Exemplary Embodiment

Image Forming Apparatus 1

Figure 1:
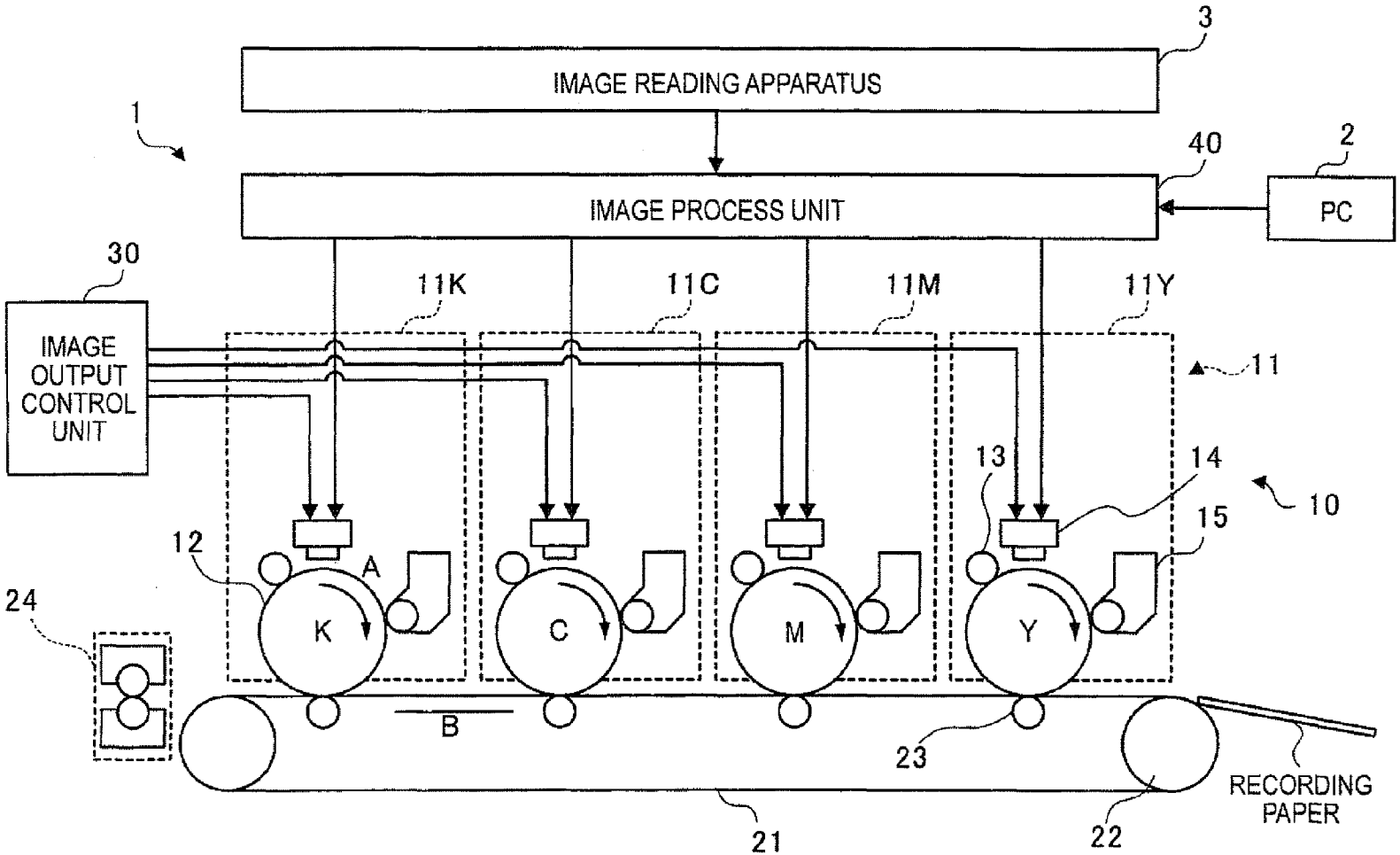
FIG. 1 is a diagram illustrating an example of the whole construction of an image forming apparatus to which a first exemplary embodiment is applied.

FIG. 1 is a diagram illustrating an example of the whole configuration of an image forming apparatus 1 to which a first exemplary embodiment is applied. The image forming apparatus 1 illustrated in FIG. 1 is an image forming apparatus that is generally called a tandem type. This image forming apparatus 1 includes an image forming process unit 10 performing image forming to correspond to image data of respective colors, an image output control unit 30 controlling the image forming process unit 10, and an image process unit 40 connected, for example, to a personal computer (PC) 2 and an image reading apparatus 3 to execute a predetermined image process with respect to image data received from them.

The image forming process unit 10 is provided with an image forming unit 11 that includes a plurality of engines arranged in parallel at predetermined intervals. The image forming unit 11 includes four image forming units 11Y, 11M, 11C, and 11K. Each of the image forming units 11Y, 11M, 11C, and 11K includes a photoconductor drum 12 as an example of an image carrier retaining a toner image by forming an electrostatic latent image, a charger 13 as an example of charging unit which charges the surface of the photoconductor drum 12 with a predetermined electric potential, a print head 14 exposing the photoconductor drum 12 charged by the charger 13, and a developer 15 as an example of developing unit which develops the electrostatic latent image obtained by the print head 14. Here, the respective image forming units 11Y, 11M, 11C, and 11K are configured in the same manner except for toner accommodated in the developer 15. Further, the image forming units 11Y, 11M, 11C, and 11K form toner images of yellow (Y), magenta (M), cyan (C), and black (K).

Further, in order to multi-transfer the toner images of the respective colors formed by the photoconductor drums 12 of the respective image forming units 11Y, 11M, 11C, and 11K onto a recording paper as an example of a transfer body, the image forming process unit 10 includes a paper transport belt 21 transporting the recording paper, a drive roll 22 that is a roll driving the paper transport belt 21, a transfer roll 23 as an example of transfer unit which transfers the toner images of the photoconductor drum 12 onto the recording paper, and a fuser 24 fusing the toner images on the recording paper.

In this image forming apparatus 1, the image forming process unit 10 performs an image forming operation based on various kinds of control signals supplied from the image output control unit 30. Further, under the control of the image output control unit 30, image data that is received from the personal computer (PC) 2 or the image reading apparatus 3 is processed by the image process unit 40 and then is supplied to the image forming unit 11. For example, in a black (K) image forming unit 11K, the photoconductor drum 12 is charged with a predetermined electric potential by the charger 13 while the photoconductor drum 12 is rotated in a direction indicated by arrow A, and is exposed by the print head 14 that emits light based on the image data supplied from the image process unit 40. Accordingly, an electrostatic latent image according to a black (K) image is formed on the photoconductor drum 12. The electrostatic latent image formed on the photoconductor drum 12 is developed by the developer 15, and thus a black (K) toner image is formed on the photoconductor drum 12. Even in the image forming units 11Y, 11M, and 11C, toner images of yellow (Y), magenta (M), and cyan (C) are formed, respectively.

The respective color toner images on the photoconductor drum 12, which are formed by the respective image forming units 11, are sequentially electrostatically transferred onto a recording paper that is supplied in the movement direction of the paper transport belt 21 that is moved in a direction indicated by arrow B by a transfer electric field that is applied to the transfer roll 23, and thus a composite toner image in which respective color toners are superimposed is formed on the recording paper.

Thereafter, the recording paper on which the composite toner image is electrostatically transferred is transported to the fuser 24. The composite toner image on the recording paper that is transported to the fuser 24 is fused on the recording paper through a fusing process with heat and pressure by the fuser 24, and the recording paper is discharged from the image forming apparatus 1.

(Print Head 14)

Figure 2:
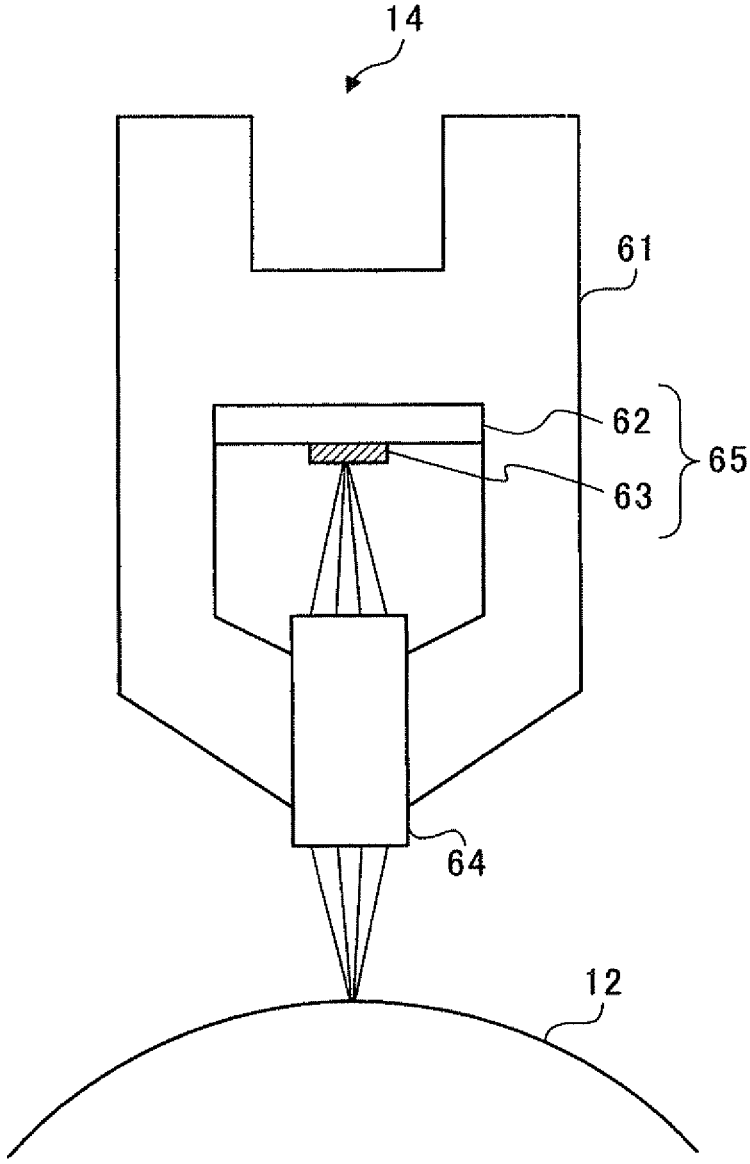
FIG. 2 is a cross-sectional view illustrating the construction of a print head.

FIG. 2 is a cross-sectional view illustrating the construction of a print head 14. This print head 14 includes a housing 61, a light emitting apparatus 65 as an example of exposure unit having a light source unit 63 including a plurality of light emitting devices (in this exemplary embodiment, light emitting thyristors) that expose the photoconductor drum 12, and a rod lens array 64 as an example of optical unit which provides light output from the light source unit 63 onto the surface of the photoconductor drum 12.

The light emitting apparatus 65 includes a circuit board 62 on which the light source unit 63 and a signal generation circuit 110 (see FIG. 3 to be described later) that drives the light source unit 63 are mounted. In this case, the light emitting apparatus 65 may not be provided with the signal generation circuit 110, but an external image output control unit 30 of the light emitting apparatus 65 may be provided with the signal generation circuit 110. In this case, signals that the signal generation circuit 110 supplies to the light source unit 63 are supplied from the image output control unit 30 to the light emitting apparatus 65 through a harness or the like. Hereinafter, explanation will be made on the assumption that the light emitting apparatus 65 has the signal generation circuit 110.

The housing 61, for example, is formed of a metal, supports the circuit board 62 and the rod lens array 64, and is set so that the light emitting point of the light emitting device of the light source unit 63 coincides with the focal plane of the rod lens array 64. Further, the rod lens array 64 is arranged in an axial direction (main scanning direction and X-axis direction in FIGS. 3 and 4B to be described later) of the photoconductor drum 12.

(Light Emitting Apparatus 65)

Figure 3:
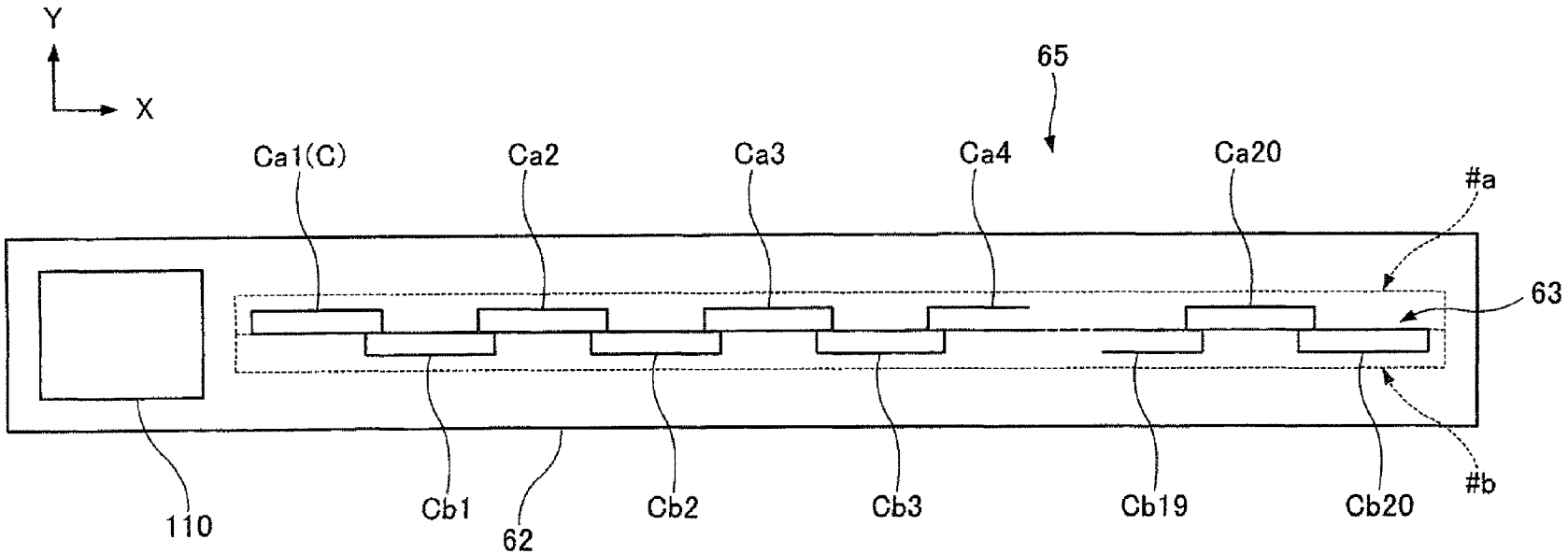
FIG. 3 is a plan view of a light emitting apparatus according to a first exemplary embodiment.

FIG. 3 is a plan view of the light emitting apparatus 65 according to the first exemplary embodiment.

As illustrated in FIG. 3, in the light emitting apparatus 65 according to this exemplary embodiment, the light source unit 63 is configured by arranging 20 light emitting chips Ca1 to Ca20 (light emitting chip group #a) and 20 light emitting chips Cb1 to Cb20 (light emitting chip group #b) in a zigzag manner in two rows in the main scanning direction on the circuit board 62. That is in this exemplary embodiment, two light emitting groups (the light emitting chip group #a and the light emitting chip group #b) are provided. Here, a light emitting chip group may be abbreviated to a group. In this case, details of opposition of the light emitting chip group #a and the light emitting chip group #b will be described later.

In the description, "~" indicates a plurality of constituent elements which are distinguished by numbers, and includes numbers stated before and after "~" and the numbers provided between the stated numbers. For example, "Ca1~Ca20" includes the light emitting chip Ca1 to the light emitting chip Ca20 in numerical order.

The configurations of the light emitting chips Ca1 to Ca20 and the light emitting chips Cb1 to Cb20 may be the same. Accordingly, in the case where the light emitting chips Ca1 to Ca20 and the light emitting chips Cb1 to Cb20 are not distinguished from one another, they are represented by light emitting chips C.

In this exemplary embodiment, the number of the light emitting chips C is 40 in total, but is not limited thereto.

The light emitting apparatus 65 has the signal generation circuit 110 mounted thereon to drive the light source unit 63. As described above, the light emitting apparatus 65 may not have the signal generation circuit 110 mounted thereon.

Figures 4A, 4B:
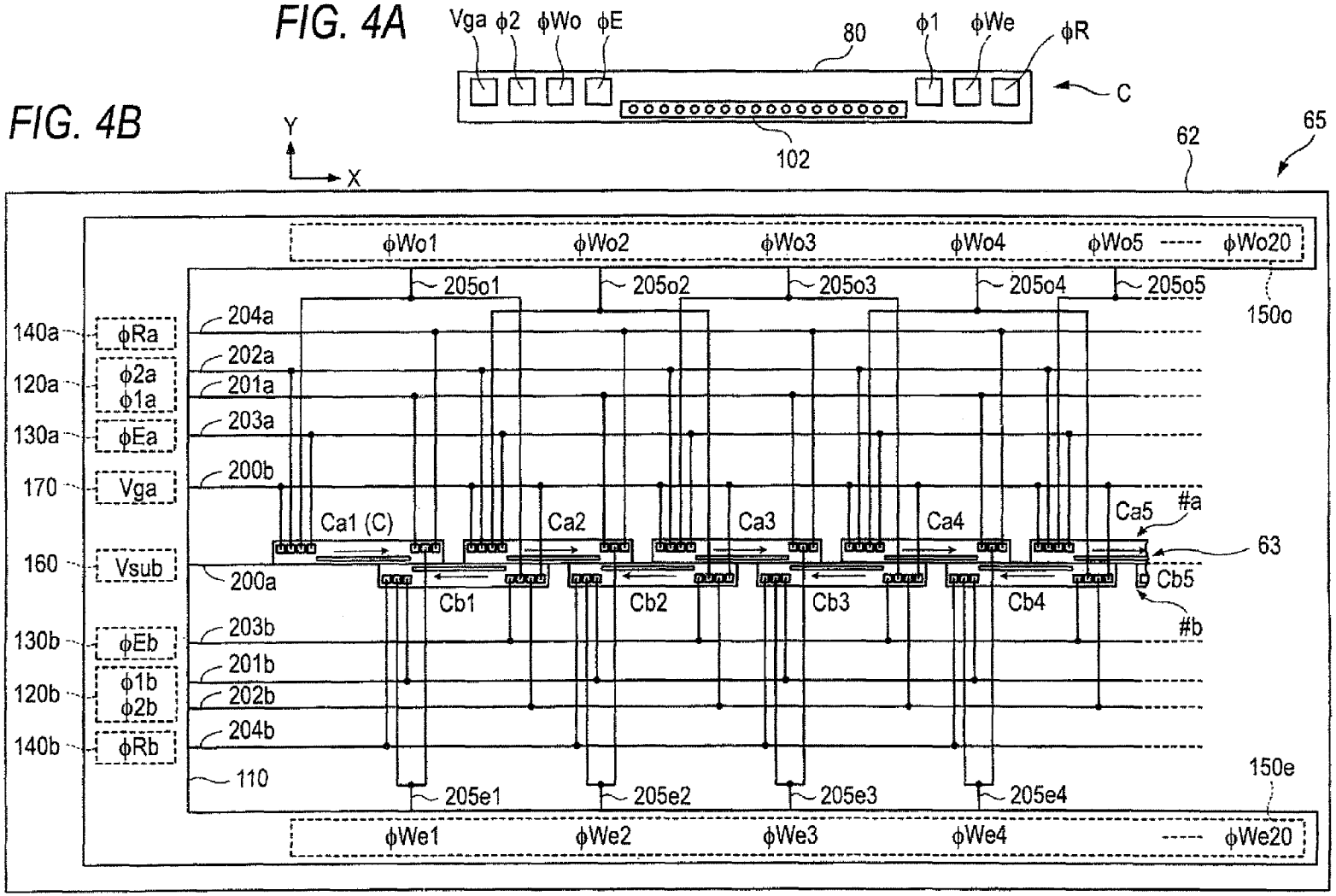
FIGS. 4A and 4B are diagrams illustrating the configuration of a light emitting chip, the configuration of a signal generation circuit, and the wire configuration on a circuit board according to a first exemplary embodiment.

FIGS. 4A and 4B are diagrams illustrating the configuration of the light emitting chip C, the configuration of the signal generation circuit 110, and the wire configuration on the circuit board 62 according to a first exemplary embodiment. Specifically, FIG. 4A shows the configuration of the light emitting chip C, and FIG. 4B shows the configuration of the signal generation circuit 110 of the light emitting apparatus 65 and the wire configuration on the circuit board 62. In this exemplary embodiment, the light emitting chips C are divided into two light emitting chip groups (#a and #b).

First, the configuration of the light emitting chip C illustrated in FIG. 4A will be described.

The light emitting chip C has a light emitting unit 102 that includes a plurality of light emitting devices (in this exemplary embodiment, light emitting thyristors L1, L2, L3, . . . ) which are installed on a side that is close to the long side of a substrate 80 having a rectangular surface shape in rows along the long side. Further, the light emitting chip C has input terminals (terminal Vga, terminal ϕ1, terminal ϕ2, terminal ϕE, terminal ϕWo, terminal ϕWe, and terminal ϕR), which are a plurality of bonding pads for inputting various kinds of control signals, provided on both end portions of the substrate 80 in the long side direction. The input terminals are installed in the order of the terminal Vga, the terminal ϕ2, the terminal ϕWo, and the terminal ϕE from one end portion of the substrate 80, and in the order of the terminal ϕR, the terminal ϕWe, the terminal ϕ1 from the other end portion of the substrate 80. Further, the light emitting unit 102 is installed between the terminal ϕE and the terminal ϕ1. On the back of the substrate 80, a back electrode 85 (see FIG. 6 to be described later) is installed as a terminal Vsub.

In this case, the wording "in rows", as illustrated in FIG. 4A, is not limited to a case where a plurality of light emitting devices are arranged in alignment, but may be a state where the respective light emitting devices of the plurality of light emitting devices are arranged with different deviation amounts with respect to a direction that is orthogonal to the row direction. For example, if it is assumed that the light emitting plane 312 (see FIG. 6 to be described later) corresponds to a pixel, the respective light emitting devices may be arranged with a deviation amount as large as several pixels or several tens of pixels in the direction that is orthogonal to the row direction. Further, the light emitting devices may be alternately arranged with the neighboring light emitting devices, or may be arranged in a zigzag manner.

Next, referring to FIG. 4B, the configuration of the signal generation circuit 110 of the light emitting apparatus 65 and the wire configuration on the circuit board 62 will be described.

As described above, on the circuit board 62 of the light emitting apparatus 65, the signal generation circuit 110 and the light emitting chips C (the light emitting chips Ca1 to Ca20 and the light emitting chips Cb1 to Cb20) are mounted, and wires (lines) for connecting the signal generation circuit 110 and the light emitting chips C (the light emitting chips Ca1 to Ca20 and the light emitting chips Cb1 to Cb20) are installed.

First the configuration of the signal generation circuit 110 will be described.

To the signal generation circuit 110, although not illustrated, processed image data and various kinds of control signals are input from the image output control unit 30 and the image process unit 40 (see FIG. 1). The signal generation circuit 110 performs the replacement of the image data or correction of the light emission amount based on the image data and the various kinds of control signals.

Further, the signal generation circuit 110 includes a transmission signal generation unit 120*a* transmitting a first transmission signal ϕ1*a* and a second transmission signal ϕ2*a* to the light emitting chip group #a (light emitting chips Ca1 to Ca20) based on the various kinds of control signals, and a transmission signal generation unit 120*b* transmitting a first transmission signal ϕ1*b* and a second transmission signal ϕ2*b* to the light emitting chip group #b (light emitting chips Cb1 to Cb20).

Further, the signal generation circuit 110 includes an enabling signal generation unit 130*a* transmitting an enabling signal ϕEa to the light emitting chip group #a (light emitting chips Ca1 to Ca20) based on the various kinds of control signals, and an enabling signal generation unit 130*b* transmitting an enabling signal ϕEb to the light emitting chip group #b (light emitting chips Cb1 to Cb20).

Further, the signal generation circuit 110 includes a turn-off signal generation unit 140*a* transmitting a turn-off signal ϕRa to the light emitting chip group #a (light emitting chips Ca1 to Ca20) based on the various kinds of control signals, and a turn-off signal generation unit 140*b* transmitting a turn-off signal ϕRb to the light emitting chip group #b (light emitting chips Cb1 to Cb20).

Further, the signal generation circuit 110 includes a setting signal generation unit 150*o* transmitting setting signals ϕWo1 to ϕWo20 for each light emitting chip set which is composed of one light emitting chip C that belongs to the light emitting chip group #a and one light emitting chip C that belongs to the light emitting chip group #b based on the various kinds of control signals. In the same manner, the signal generation circuit 110 includes a setting signal generation unit 150*e* transmitting setting signals ϕWe1 to ϕWe20 for each light emitting chip set which is composed of one light emitting chip C that belongs to the light emitting chip group #a and one light emitting chip C that belongs to the light emitting chip group #b. Here, a light emitting chip set may be abbreviated to a set.

For example, the setting signal generation unit 150*o* transmits the setting signal ϕWo1 to the light emitting chip set #1 which is composed of the light emitting chip Ca1 that belongs to the light emitting chip group #a and the light emitting chip Cb1 that belongs to the light emitting chip group #b. Further, the setting signal generation unit 150*o* transmits the setting signal ϕWo2 to the light emitting chip set #2 which is composed of the light emitting chip Ca2 that belongs to the light emitting chip group #a and the light emitting chip Cb2 that belongs to the light emitting chip group #b. In the same manner, the setting signal generation unit 150*o* transmits the setting signal ϕWo20 to the light emitting chip set #20 which is composed of the light emitting chip Ca20 that belongs to the light emitting chip group #a and the light emitting chip Cb20 that belongs to the light emitting chip group #b.

On the other hand, the setting signal generation unit 150*e* transmits the setting signal ϕWe1 to the light emitting chip set #1 which is composed of the light emitting chip Ca1 that belongs to the light emitting chip group #a and the light emitting chip Cb1 that belongs to the light emitting chip group #b. Further, the setting signal generation unit 150*e* transmits the setting signal ϕWe2 to the light emitting chip set #2 which is composed of the light emitting chip Ca2 that belongs to the light emitting chip group #a and the light emitting chip Cb1 that belongs to the light emitting chip group #b. In the same manner, the setting signal generation unit 150*e* transmits the setting signal ϕWe20 to the light emitting chip set #20 which is composed of the light emitting chip Ca20 that belongs to the light emitting chip group #a and the light emitting chip Cb20 that belongs to the light emitting chip group #b.

Further, the signal generation circuit 110 includes a reference potential supply unit 160 supplying a reference potential Vsub that becomes a reference of the electric potential in the light emitting chips C (light emitting chips Ca1 to Ca20 and light emitting chips Cb1 to Cb20), and a power potential supply unit 170 supplying a power potential Vga for driving the light emitting chips C (light emitting chips Ca1 to Ca20 and light emitting chips Cb1 to Cb20).

As described above, in FIG. 4, the transmission signal generation unit 120*a* and the transmission signal generation unit 120*b* are separately illustrated. However, they may be collectively indicated as the transmission signal generation unit 120.

In the same manner, although the enabling signal generation unit 130*a* and the enabling signal generation unit 130*b* are separately illustrated, they may be collectively indicated as the enabling signal generation unit 130.

In the same manner, although the turn-off signal generation unit 140*a* and the turn-off signal generation unit 140*b* are separately illustrated, they may be collectively indicated as the turn-off signal generation unit 140.

Further, although the setting signal generation unit 150*o* and the setting signal generation unit 150*e* are separately illustrated, they may be collectively indicated as the setting signal generation unit 150.

Further, in the case where the first transmission signal ϕ1*a* and the first transmission signal ϕ1*b* are not distinguished from each other, they are represented by a first transmission signal ϕ1, and in the case where the second transmission signal ϕ2*a* and the second transmission signal ϕ2*b* are not distinguished from each other, they are represented by a second transmission signal ϕ2. Further, in the case where the first transmission signal ϕ1 and the second transmission signal ϕ2 are not distinguished from each other, they are represented by a transmission signal. In the same manner, in the case where the enabling signal ϕEa and the enabling signal ϕEb are not distinguished from each other, they are represented by an enabling signal ϕE. In the case where the turn-off signal ϕRa and the turn-off signal ϕRb are not distinguished from each other, they are represented by a turn-off signal ϕR. The setting signals ϕWo1 to ϕWo20 are represented by a setting signal ϕWo, and the setting signals ϕWe1 to ϕWe20 are represented by a setting signal ϕWe. Further, in the case where the setting signal ϕWo and the setting signal ϕWe are not distinguished from each other, they are represented by a setting signal ϕW.

The enabling signal ϕE is an example of the first selection signal, and the setting signal ϕW is an example of the second selection signal.

Next, the arrangement of the light emitting chips Ca1 to Ca20 and the light emitting chips Cb1 to Cb20 will be described.

The light emitting chips Ca1 to Ca20 that belong to the light emitting chip group #a are arranged in a row at predetermined intervals in the long side direction. In the same manner, the light emitting chips Ca1 to Ca20 that belong to the light emitting chip group #b are arranged in a row at predetermined intervals in the long side direction. Further, the light emitting chips Ca1 to Ca20 that belong to the light emitting chip group #a and the light emitting chips Cb1 to Cb20 that belong to the light emitting chip group #b are arranged in a zigzag manner in a state where they are rotated by 180° so that the long sides, which are close to the light emitting units 102 installed in the respective light emitting chip groups, face each other. Further, the positions of the light emitting chips C are set so that the light emitting devices are arranged at predetermined intervals in the main scanning direction between the light emitting chips C. In this case, the direction of the arrangement of the light emitting devices (in this exemplary embodiment, in numerical order of the light emitting thyristors L1, L2, L3, . . . ) of the light emitting unit 102 illustrated in FIG. 4A is indicated by an arrow in the light emitting chips Ca1, Ca2, Ca3, . . . and the light emitting chips Cb1, Cb1, Cb3, . . . in FIG. 4B.

The wires (lines) for connecting the signal generation circuit 110 and the light emitting chips C (light emitting chips Ca1 to Ca20 and light emitting chips Cb1 to Cb20) will be described.

On the circuit board 62, a power line 200*a* is installed, which is connected to the terminal Vsub (see FIG. 6 to be described later) installed on the back surface of the substrate 80 of the light emitting chip C to receive the reference potential Vsub from the reference potential supply unit 160 of the signal generation circuit 110.

Further, a power line 200*b* is installed, which is connected to the terminal Vga installed on the light emitting chip C to receive the power potential Vga for power supply from the power potential supply unit 170 of the signal generation circuit 110.

Further, on the circuit board 62, a first transmission signal line 201*a* for transmitting a first transmission signal ϕ1*a* from the transmission signal generation unit 120*a* of the signal generation circuit 110 to the terminals ϕ1 of the light emitting chips Ca1 to Ca20 of the light emitting chip group #a and a second transmission signal line 202*a* for transmitting a second transmission signal ϕ2*a* to the terminals ϕ2 of the light emitting chips Ca1 to Ca20 of the light emitting chip group #a are installed. The first transmission signal ϕ1*a* and the second transmission signal 2*a* are transmitted in common (in parallel) to the light emitting chips Ca1 to Ca20 of the light emitting chip group #a.

In the same manner, a first transmission signal line 201*b* for transmitting a first transmission signal ϕ1*b* from the transmission signal generation unit 120*b* of the signal generation circuit 110 to the terminals ϕ1 of the light emitting chips Cb1 to Cb20 of the light emitting chip group #b and a second transmission signal line 202*b* for transmitting a second transmission signal ϕ2*b* to the terminals ϕ2 of the light emitting chips Cb1 to Cb20 of the light emitting chip group #b are installed. The first transmission signal ϕ1*b* and the second transmission signal ϕ2*b* are transmitted in common (in parallel) to the light emitting chips Cb1 to Cb20 of the light emitting chip group #b.

The transmission signal lines 201*a*, 201*b*, 202*a*, and 202*b* are examples of the first wire.

Further, on the circuit board 62, an enabling signal line 203*a* for transmitting an enabling signal ϕEa from the enabling signal generation unit 130*a* of the signal generation circuit 110 to the terminals ϕE of the light emitting chips Ca1 to Ca20 of the light emitting chip group #a is installed. The enabling signal ϕEa is transmitted in common (in parallel) to the light emitting chips Ca1 to Ca20 of the light emitting chip group #a.

In the same manner, an enabling signal line 203*b* for transmitting an enabling signal ϕEb from the enabling signal generation unit 130*b* of the signal generation circuit 110 to the terminals ϕE of the light emitting chips Cb1 to Cb20 of the light emitting chip group #b is installed. The enabling signal ϕEb is transmitted in common (in parallel) to the light emitting chips Cb1 to Cb20 of the light emitting chip group #b.

The enabling signal lines 203*a* and 203*b* are examples of the second wire.

Further, on the circuit board 62, a turn-off signal line 204*a* for transmitting a turn-off signal ϕRa from the turn-off signal generation unit 140*a* of the signal generation circuit 110 to the terminals ϕR of the light emitting chips Ca1 to Ca20 of the light emitting chip group #a is installed. The turn-off signal ϕRa is transmitted in common (in parallel) to the light emitting chips Ca1 to Ca20 of the light emitting chip group #a.

In the same manner, a turn-off signal line 204*b* for transmitting a turn-off signal ϕRb from the turn-off signal generation unit 140*b* of the signal generation circuit 110 to the terminals ϕR of the light emitting chips Cb1 to Cb20 of the light emitting chip group #b is installed. The turn-off signal ϕRb is transmitted in common (in parallel) to the light emitting chips Cb1 to Cb20 of the light emitting chip group #b.

The turn-off signal lines 204*a* and 204*b* are examples of the fourth wire.

Further, on the circuit board 62, setting signal lines 205*o*1 to 205*o*20 for transmitting setting signals ϕWo1 to ϕWo20 from the setting signal generation unit 150*o* of the signal generation circuit 110 to the terminals ϕWo of the light emitting chip C for each light emitting chip set which is composed of one light emitting chip C that belongs to the light emitting chip group #a and one light emitting chip C that belongs to the light emitting chip group #b are installed.

Further, on the circuit board 62, setting signal lines 205*e*1 to 205*e*20 for transmitting setting signals ϕWe1 to ϕWe20 from the setting signal generation unit 150*e* of the signal generation circuit 110 to the terminals ϕWe of the light emitting chip C for each light emitting chip set which is composed of one light emitting chip C that belongs to the light emitting chip group #a and one light emitting chip C that belongs to the light emitting chip group #b are installed.

In FIG. 4, the setting signal lines 20501 to 205*o*5 and the setting signal lines 205*e*1 to 205*e*4 are described.

The setting signal lines 205*o*1 to 205*o*5 and 205*e*1 to 205*e*5 are examples of the third wire.

For example, the setting signal line 205*o*1 is connected to the terminal ϕWo of the light emitting chip Ca1 of the light emitting chip group #a and the terminal ϕWo of the light emitting chip Cb1 of the light emitting chip group #b, and transmits the setting signal ϕWo1 to the light emitting chip set #1 that is composed of the light emitting chip Ca1 and the light emitting chip Cb1. The setting signal line 205*o*2 is connected to the terminal ϕWo of the light emitting chip Ca2 of the light emitting chip group #a and the terminal ϕWo of the light emitting chip Cb2 of the light emitting chip group #b, and transmits the setting signal ϕWo2 to the light emitting chip set #2 that is composed of the light emitting chip Ca2 and the light emitting chip Cb2. In the same manner, the setting signal line 205*o*20 is connected to the terminal ϕWo of the light emitting chip Ca20 of the light emitting chip group #a and the terminal ϕWo of the light emitting chip Cb20 that belongs to the light emitting chip group #b, and transmits the setting signal ϕWo20 to the light emitting chip set #20 that is composed of the light emitting chip Ca20 and the light emitting chip Cb20.

In the same manner, the setting signal line 205*e*1 is connected to the terminal We of the light emitting chip Ca1 of the light emitting chip group #a and the terminal ϕWe of the light emitting chip Cb1 of the light emitting chip group #b, and transmits the setting signal ϕWe1 to the light emitting chip set #1 that is composed of the light emitting chip Ca1 and the light emitting chip Cb1. The setting signal line 205*e*2 is connected to the terminal (We of the light emitting chip Ca2 of the light emitting chip group #a and the terminal ϕWe of the light emitting chip Cb2 of the light emitting chip group #b, and transmits the setting signal ϕWe2 to the light emitting chip set #2 that is composed of the light emitting chip Ca2 and the light emitting chip Cb2. In the same manner, the setting signal line 205*e*20 is connected to the terminal ϕWe of the light emitting chip Ca20 of the light emitting chip group #a and the terminal ϕWe of the light emitting chip Cb20 that belongs to the light emitting chip group #b, and transmits the setting signal ϕWe20 to the light emitting chip set #20 that is composed of the light emitting chip Ca20 and the light emitting chip Cb20.

As described above, the reference potential Vsub and the power potential Vga are transmitted in common to all the light emitting chips C on the circuit board 62.

Further, the first transmission signal ϕ1*a*, the second transmission signal ϕ2*a*, the enabling signal ϕEa, and the turn-off signal ϕRa are transmitted in common to the light emitting chip group #a. Further, the first transmission signal ϕ1*b*, the second transmission signal ϕ2*b*, the enabling signal ϕEb, and the turn-off signal ϕRb are transmitted in common to the light emitting chip group #b.

On the other hand, the setting signals ϕWo1 to ϕWo20 and the setting signals ϕWe1 to ϕWe20 are transmitted in common to the respective light emitting chi sets #1 to #20 each of which is composed of one light emitting chip C that belongs to the light emitting chip group #a and one light emitting chip C that belongs to the light emitting chip group #b.

Here, the number of wires (lines) will be described.

In the case where the present exemplary embodiment is not applied, and the light emitting chips C of the light emitting apparatus 65 are not divided into the light emitting chip groups and the light emitting chip sets, two turn-on signals ϕ1 (in this exemplary embodiment, corresponding to turn-off signals ϕR) are transmitted for each light emitting chip C, and if the number of light emitting chips C is set to 40, 80 turn-on signal lines (corresponding to the turn-off signal lines 204*a* and 204*b* in FIG. 4) for turning on the light emitting thyristors L are required in order to simultaneously turn on two light emitting thyristors L for each light emitting chip C to be described later. In addition, first transmission, signal lines (corresponding to the first transmission signal lines 201*a* and 201*b* in FIG. 4), second transmission signal lines (corresponding to the second transmission signal lines 202*a* and 202*b* in FIG. 4), and power lines 200*a* and 200*b* are required. Accordingly, in the light emitting apparatus 65, the number of wires (lines) becomes 84.

Further, since the turn-on signal lines are for transmitting current for turning on the light emitting thyristors L, they are required to have low resistance. Accordingly, as the turn-on signal lines, wires having a wide width are required. Due to this, in the case where this exemplary embodiment is not applied, a plurality of wires having a wide width should be installed on the circuit board 62 of the light emitting apparatus 65 to increase the area of the circuit board 62.

In this exemplary embodiment, as illustrated in FIGS. 4A and 4B, if the number of light emitting chip groups is set to 2, 10 signal lines including first transmission signal lines 201*a* and 201*b*, second transmission signal lines 202*a* and 202*b*, enabling signal lines 203*a* and 203*b*, turn-on signal lines 204*a* and 204*b*, and power lines 200*a* and 200*b* are required. Further, 40 setting signal lines 205*o*1 to 205*o*20 and 205*e*1 to 205*e*20 are required. Accordingly, the number of wires (lines) in the light emitting apparatus 65 according to this exemplary embodiment becomes 50.

Accordingly, the number of wires according to this exemplary embodiment becomes 60% of that in the case where this exemplary embodiment is not applied.

Further, in this exemplary embodiment, since the current supply to the thyristors L is performed through the power lines 200*a* and 200*b* and the turn-off signal lines 204*a* and 204*b* are set by turning on the clear thyristors TR1 and TR2, wires having low resistance and wide width are not required. In this exemplary embodiment, it is not required to install a plurality of wires having a wide width on the circuit board 62, and thus the area of the circuit board 62 may be reduced.

Figure 5:
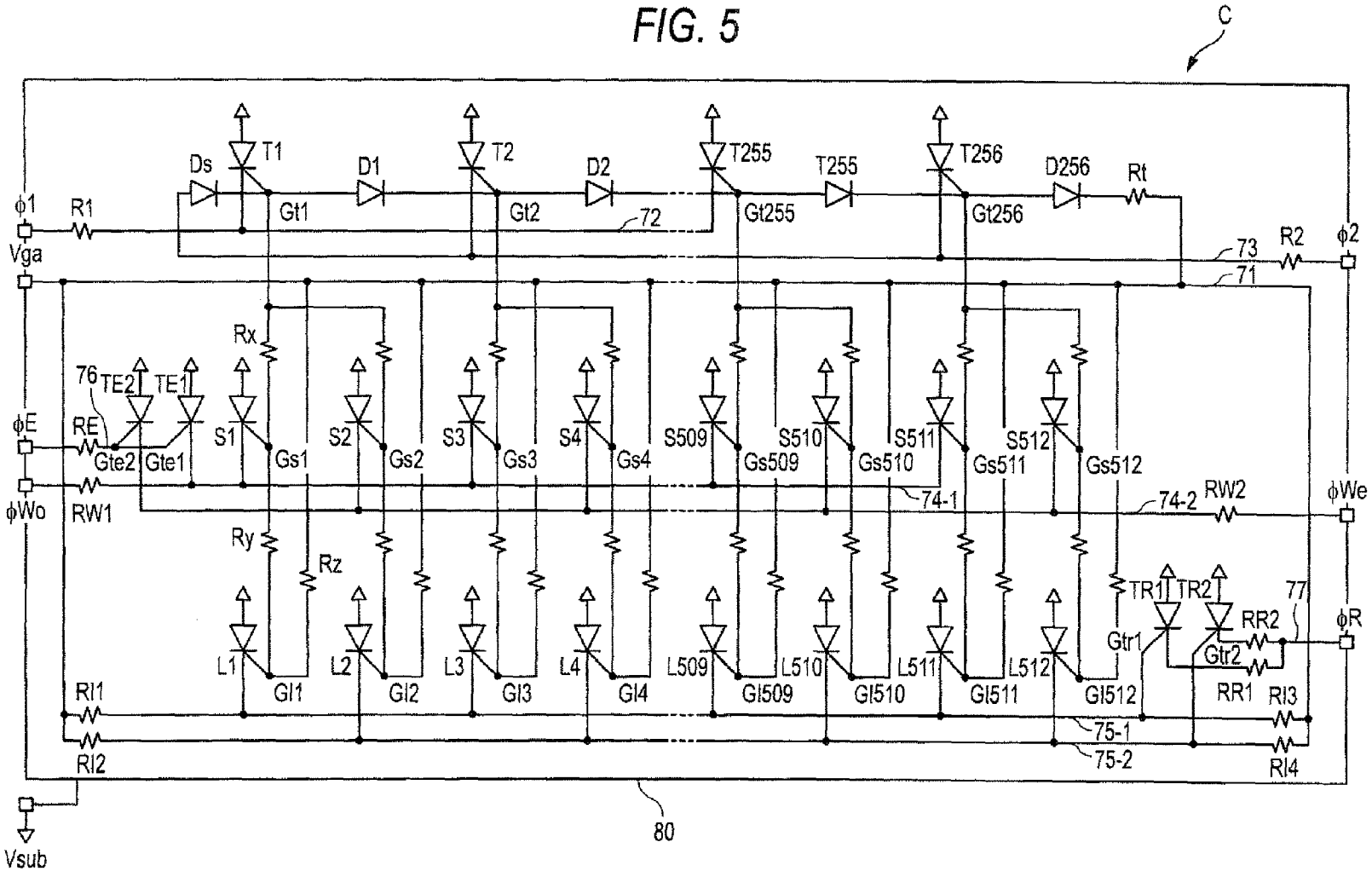
FIG. 5 is an equivalent circuit diagram illustrating the circuit configuration of a light emitting chip that is a self-scanning light emitting device (SLED) chip according to a first exemplary embodiment.

FIG. 5 is an equivalent circuit diagram illustrating the circuit configuration of a light emitting chip C that is a self-scanning light emitting device (SLED) chip according to a first exemplary embodiment. In FIG. 5, except for the input terminals (terminal Vga, terminal ϕ1, terminal ϕ2, terminal ϕE, terminal ϕWo, terminal ϕWe, and terminal ϕR), respective devices to be described hereinafter are arranged based on the layout on the light emitting chip C as illustrated in FIG. 6 to be described later.

In this case, unlike FIG. 4A, for convenience in explanation, the input terminals (terminal Vga, terminal ϕ1, terminal ϕE, and terminal ϕWo) are shown at the left side of the drawing, and the input terminals (terminal ϕ2, terminal ϕWe, and terminal ϕR) are shown at the right side of the drawing.

As described above, the light emitting chip C includes a light emitting thyristor column (light emitting unit 102 (see FIG. 4A)) composed of light emitting thyristors L1, L2, L3, . . . as an example of the light emitting devices that are arranged in rows on the substrate 80.

Further, the light emitting chip C includes a transmission thyristor column composed of transmission thyristors T1, T2, T3, . . . as an example of the transmission devices that are arranged in rows in the same manner as the light emitting thyristor column, and a setting thyristor column composed of setting thyristors S1, S2, S3, . . . , as an example of the setting devices that are arranged in rows in the same manner.

Here, in the case where the light emitting thyristors L1, L2, L3, . . . are not distinguished from one another, they are represented by light emitting thyristors L. In the case where the transmission thyristors T1, T2, T3, . . . are not distinguished from one another, they are represented by transmission thyristors T. In the case where the setting thyristors S1, S2, S3, . . . are not distinguished from one another, they are represented by setting thyristors S.

Further, the light emitting chip C includes setting enabling thyristors TE1 and TE2 as an example of the enabling devices, and is also provided with turn-off thyristors TR1 and TR2.

In this case, the above-described thyristors (light emitting thyristor L, transmission thyristor T, setting thyristors S, setting enabling thyristors TE1 and TE2, and turn-off thyristors TR1 and TR2) are semiconductor devices having three terminals of an anode, a cathode, and a gate.

Further, the light emitting chip C includes coupling diodes D1, D2, D3, . . . each of which is provided between each pair of transmission thyristors T1, T2, T3, . . . . Further, connection resistors Rx are provided between the transmission thyristors T1, T2, T3, . . . and the setting thyristors S1, S2, S3, . . . , respectively. Further, connection resistors Ry are provided between the setting thyristors S1, S2, S3, . . . and the light emitting thyristors L1, L2, L3, . . . .

Further, the light emitting chip C includes connection resistors Rz between the light emitting thyristors L1, L2, L3, . . . and a power line 71 to be described later.

Here, in the same manner as the light emitting thyristors L, in the case where the coupling diodes D1, D2, D3, . . . are not distinguished from one another, they are represented by coupling diodes D.

Here, the number of light emitting thyristors L in the light emitting thyristor column may be predetermined. In the first exemplary embodiment, the number of light emitting thyristors L is, for example, 512, and the number of setting thryristors S is also 512. However, the number of transmission thyristors T is a half of the number of light emitting thyristors L or setting thyristors S, that is, 256. That is, in the case where one light emitting thyristor L and one setting thyristor S form a pair, one transmission thyristor T is provided with two pairs of light emitting thyristors L and setting thyristors S.

In this case, the number of coupling diodes D is 256, which is the same as the number of transmission thyristors T. The number of connection resistors Rx, Ry, or Rz is also 512.

Further, the light emitting chip C includes one start diode Ds. Further, the light emitting chip C includes current limiting resistors R1 and R2 for preventing excessive current from flowing to a first transmission signal line 72 for transmitting the first transmission signal ϕ1 and a second transmission signal line 73 for transmitting the second transmission signal ϕ2. Further, the light emitting chip C includes current limiting resistors RE, Rw1, Rw2, RR1, RR2, and Rt.

In addition, the light emitting chip C includes current limiting resistors R11, R12, R13, and R14 for inhibiting excessive current flow to turn-on signal lines 75-1 and 75-2 that supply current for turn-on to the light emitting thyristors L.

In this case, the light emitting thyristors L1, L2, L3, . . . of the light emitting thyristor column, the transmission thyristor T1, T2, T3, . . . of the transmission thyristor column, and the setting thyristors S1, S2, S3, . . . of the setting thyristor column are arranged in numerical order from the left side of FIG. 5. Further, the setting enabling thyristors TE1 and TE2 are installed in parallel to the setting thyristor S1 on the outer side of the setting thyristor column. Further, the coupling diodes D1, D2, D3, . . . are arranged in the order of their numbers from the left side of the drawing.

Further, the light emitting thyristor column, the transmission thyristor column, and the setting thyristor column are arranged in the order of the transmission thyristor column, the setting thyristor column, and the light emitting thyristor column from the upper side of FIG. 5.

Next, electrical connection of respective devices in the light emitting chip C will be described. Anode terminals of the light emitting thyristor L, the transmission thyristor T, the setting thyristor 5, the setting enabling thyristors TE1 and TE2, and the turn-off thyristors TR1 and TR2 are connected to the substrate 80 (anode common).

Further, these anode terminals are connected to the power line 200*a* (see FIG. 4) through the terminal Vsub that is the back electrode 85 (see FIG. 6 to be described later) that is installed on the back of the substrate 80. A reference potential Vsub is supplied from the reference potential supply unit 160 to the power line 200*a*.

Cathode terminals of the odd-numbered transmission thyristors T1, T3, . . . are connected to the first transmission signal line 72 along the transmission thyristor column. Further, in the light emitting chip Ca1, the first transmission signal line 72 is connected to the terminal ϕ1 that is the input terminal of the first transmission signal ϕ1*a* through the current limiting resistor R1. This terminal ϕ1 is connected to the first transmission signal line 201*a* (see FIG. 4), and the first transmission signal ϕ1*a* is transmitted to the terminal 41.

On the other hand, cathode terminals of the even-numbered transmission thyristors T2, T4, . . . are connected to the second transmission signal line 73 along the transmission thyristor column. Further, in the light emitting chip Ca1, the second transmission signal line 73 is connected to the terminal ϕ2 that is the input terminal of the second transmission signal ϕ2*a* through the current limiting resistor R2. This terminal ϕ2 is connected to the second transmission signal line 202*a* (see FIG. 4), and the second transmission signal ϕ2*a* is transmitted to the terminal ϕ2.

Cathode terminals of the odd-numbered setting thyristors S1, S3, . . . and the setting enabling thyristor TE1 are connected to the setting signal line 74-1 along the setting thyristor column. Further, the setting signal line 74-1 is connected to the terminal ϕWo through the current limiting resistor RW1. In the light emitting chip Ca1, the terminal ϕWo is connected to the setting signal line 205*e*1 (see FIG. 4), and the setting signal ϕWo1 is transmitted to the terminal ϕWo.

Cathode terminals of the even-numbered setting thyristors S2, S4, . . . , and the setting enabling thyristor TE2 are connected to the setting signal line 74-2 along the setting thyristor column. Further, the setting signal line 74-2 is connected to the terminal ϕWe through the current limiting resistor RW2. In the light emitting chip Ca1, the terminal ϕWe is connected to the setting signal line 205*e*1 (see FIG. 4), and the setting signal ϕWe1 is transmitted to the terminal ϕWe.

Further, the gate terminal Gte1 of the setting enabling thyristor TE1 and the gate germinal Gte2 of the setting enabling thyristor TE2 are connected to the enabling signal line 76. The enabling signal line 76 is connected to the terminal ϕE through the current limiting resistor RE. In the light emitting chip Ca1, the terminal ϕE is connected to the enabling signal line 203*a* (see FIG. 4), and the enabling signal ϕEa is transmitted to the terminal ϕE.

Gate terminals Gtr1 of the odd-numbered light emitting thyristors L1, L3, . . . , and the turn-off thyristor TR1 are connected to the turn-on signal line 75-1 along the light emitting thyristor column. Further, one end of the turn-on signal line 75-1 is connected to the power line 71 through the current limiting resistor R11, and the other end of the turn-on signal line 75-1 is connected to the power line 71 through the current limiting resistor R13.

Gate terminals Gtr2 of the even-numbered light emitting thyristors L2, L4, . . . , and the turn-off thyristor TR2 are connected to the turn-on signal line 75-2 along the light emitting thyristor column. Further, one end of the turn-on signal line 75-2 is connected to the power line 71 through the current limiting resistor R12, and the other end of the turn-on signal line 75-2 is connected to the power line 71 through the current limiting resistor R14.

Further, the cathode terminal of the turn-off thyristor TR1 is connected to the turn-off signal line 77 through the current limiting resistor RR1, and the cathode terminal of the turn-off thyristor TR2 is connected to the turn-off signal line 77 through the current limiting resistor RR2. Further, the turn-off signal line 77 is connected to the terminal ϕR. In the light emitting chip Ca1, the terminal ϕR is connected to the turn-off signal line 204*a* (see FIG. 4), and the turn-off signal ϕRa is transmitted to the terminal ϕR.

The gate terminals Gt1, Gt2, Gt3, . . . , of the transmission thyristors T are connected to the gate terminal $Gt_n$ of the transmission thyristor $T_n$ having the number n (n is an integer that is equal to or larger than 1), the gate terminal $Gs_{2n-1}$ of the setting thyristor $S_{2n-1}$ having the number (2n−1), and the gate terminal $Gs_{2n}$ of the setting thyristor $S_{2n}$ having the number 2n, respectively, through the connection resistors Rx.

On the other hand, the respective gate terminals Gs1, Gs2, Gs3, . . . , of the setting thyristors S1, S2, S3, . . . , are connected to the gate terminals G11, g12, G13, . . . , of the light emitting thyristors L1, L2, L3, . . . , having the same numbers through the connection resistors Ry, respectively.

The gate terminals G1 of the light emitting thyristors L are connected to the power line 71 through the connection resistors Rz that are installed to correspond to the respective light emitting thyristors L.

Here, in the case where the gate terminals Gt1, Gt2, Gt3, . . . , the gate terminals Gs1, Gs2, Gs3, . . . and the gate terminals G11, G12, G13, . . . are not distinguished from one another, they are represented by the gate terminals Gt, the gate terminals Gs, and the gate terminals G1, respectively.

The coupling diodes D1, D2, D3, . . . are connected between two pairs of the respective gate terminals Gt1, Gt2, Gt3, . . . of the transmission thyristors T1, T2, T3, . . . in numerical order. That is, the coupling diodes D1, D2, D3, . . . are connected in series so that they are sandwiched between the gate terminals Gt1, Gt2, Gt3, . . . in order. Further, the coupling diode D1 is connected in the direction in which current flows from the gate terminal Gt1 toward the gate terminal Gt2. Other coupling diodes D2, D3, D4, . . . are connected in the same manner.

In this case, the anode terminal of the coupling diode D256 is connected to the gate terminal Gt256, and the cathode terminal of the coupling diode D256 is connected to the power line 71 through the current limiting resistor Rt.

Further, the cathode terminal of a start diode Ds is connected to the gate terminal Gt1 of the transmission thyristor T1 on one side of the transmission thyristor column, and the anode terminal of the start diode Ds is connected to the second transmission signal line 73.

The power line 71 is connected to the terminal Vga. The terminal Vga is connected to the power line 200*b*, and the power potential Vga is supplied from the power potential supply unit 170 to the terminal Vga.

Figures 6A, 6B:
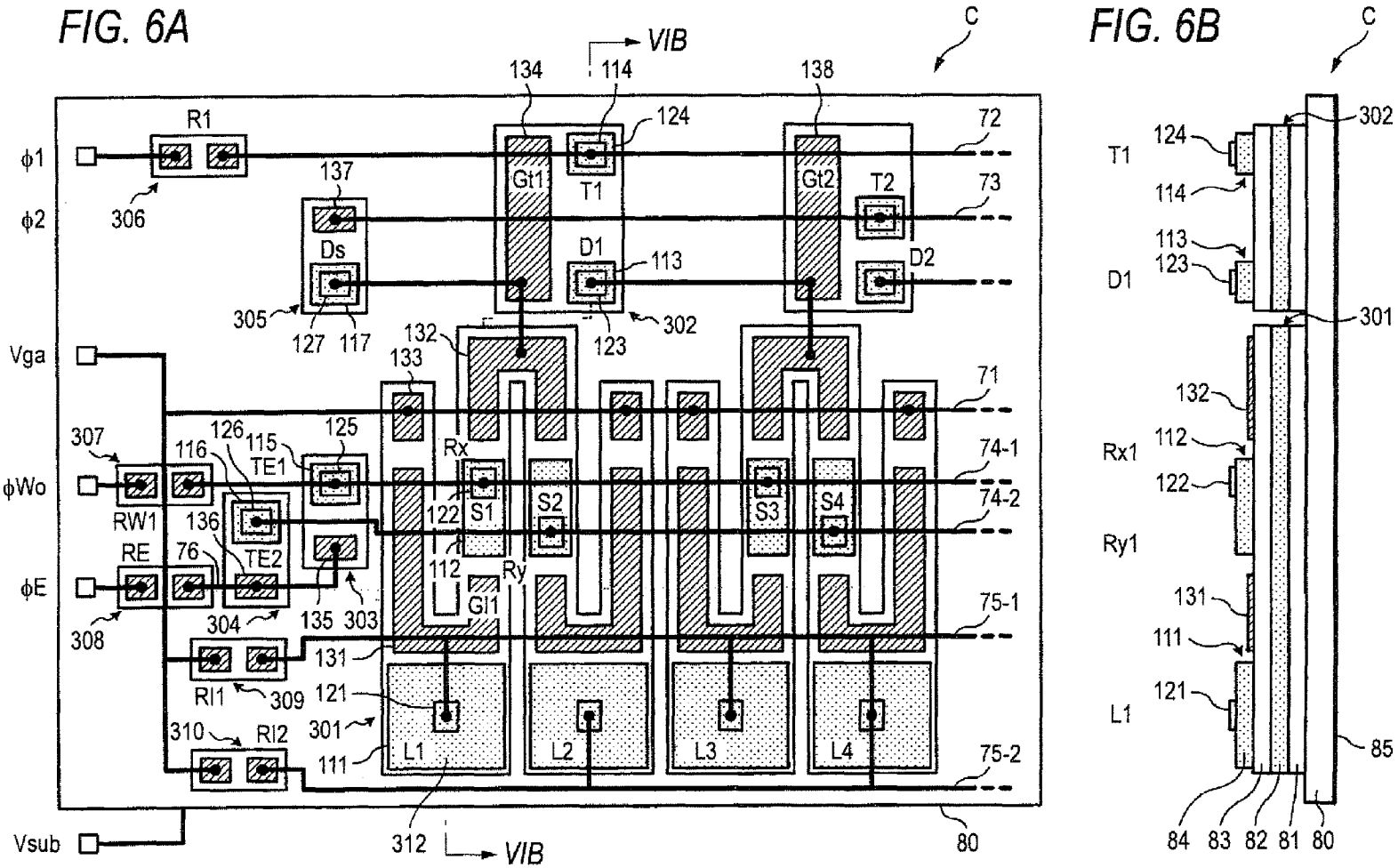
FIGS. 6A and 6B are a planar layout diagram and a cross-sectional view of a light emitting chip according to a first exemplary embodiment.

FIGS. 6A and 6B are a planar layout diagram and a cross-sectional view of a light emitting chip C according to a first exemplary embodiment. FIGS. 6A and 6B illustrate a portion on the left side of the light emitting chip C as illustrated in FIG. 5, that is, a portion around the light emitting thyristors L1 to L4, the setting thyristors S1 to S4, and the transmission thyristors T1 and T2. Accordingly, FIGS. 6A and 6B do not illustrate a portion on the right side of the light emitting chip C of FIG. 5, that is, a portion around the terminal ϕ2, the terminal (We, and the terminal ϕR.

FIG. 6A is a planar layout diagram of a light emitting chip C, and FIG. 6B is a cross sectional view taken along line VIB-VIB illustrated in FIG. 6A. Accordingly, in FIG. 6B, as seen from the lower portion of the drawing, cross-sections of the light emitting thyristor L1, the connection resistor RY, the setting thyristor S1, the connection resistor Rx, the coupling diode D1, and the transmission thyristor T1 are indicated. In FIGS. 6A and 6B, the names of important devices or terminals are given.

In this case, in FIG. 6A, wires connecting the respective devices are indicated by solid line. And open through-holes on the interlayer insulating films installed on the respective devices are indicated by a black circle (●). Further, in FIG. 6B, the names of the interlayer insulating film and the wires are omitted.

The light emitting chip C, as illustrated in FIG. 6B, is constructed by successively laminating a p-type first semiconductor layer 81, an n-type second semiconductor layer 82, a p-type third semiconductor layer 83, and an n-type fourth semiconductor layer 84 on a p-type substrate 80 in a compound semiconductor, for example, such as GaAs or GaAlAs. Further, by successively etching the p-type first semiconductor layer 81, the n-type second semiconductor layer 82, the p-type third semiconductor layer 83, and the n-type fourth semiconductor layer 84, the above-described devices are installed on a plurality of islands separated from one another (first island 301 to tenth island 310 and islands not marked with a sign).

As illustrated in FIG. 6A, the first island 301 is W-shaped in plane. The light emitting thyristor L1 is installed in the center portion of the left V shape that constitute the W character, and the light emitting thyristor L2 is installed in the center portion of the right V shape of the W character.

The left V-shaped portion and the right V-shaped portion are bilaterally symmetrical except that the positions of the setting thyristor S1 and the setting thyristor S2 are different from each other. Accordingly, only the left V-shaped portion will be described.

The connection resistor Rz is installed in one portion that is branched from the left V-shaped portion, and the setting thyristor S1 and the connection resistors Rx and Ry are installed in the other portion that is branched from the left V-shaped portion.

The second island 302 is in a rectangular shape in plane, and is provided with the transmission thyristor T1 and the coupling diode D1.

The third island 303 is in a rectangular shape in plane, and is provided with the setting enabling thyristor TE1. The fourth island 304 is also in a rectangular shape in plane, and is provided with the setting enabling thyristor TE2. The fifth island 305 is in a rectangular shape in plane, and is provided with the start diode Ds.

The current limiting resistor R1 is installed on the sixth island 306, the current limiting resistor RW1 is installed on the seventh island 307, and the current limiting resistor RE is installed on the eighth island 308. The current limiting resistor R11 is installed on the ninth island 309, and the current limiting resistor R12 is installed on the tenth island 310. These islands are in a rectangular shape.

Further, in the light emitting chip C, islands (no sign) that are equal to the first island 301 and the second island 302 are installed in parallel to them. On these islands, the light emitting thyristors L2, L3, L4, . . . , the setting thyristors S2, S3, S4, . . . , and the transmission thyristors T2, T3, T4, . . . , are installed in the same manner as the first island 301 and the second island 302. The explanation thereof will be omitted.

Further, the same islands as the third island 303 and the fourth island 304 are installed, and the turn-off thyristors TR1 and TR2 are installed. Further, the same islands as the sixth island 306, the seventh island 307, the ninth island 309, and the tenth island 310 are installed, and the current limiting resistors R2, RW2, RR1, RR2, R13, R14 are installed.

Further, as illustrated in FIG. 6B, the back electrode 85 that is the terminal Vsub is installed on the back of the substrate 80.

Further, referring to FIGS. 6A and 6B, the first island 301 to the tenth island 310 will be described in detail.

The light emitting thyristor L1 installed in the center portion of the V shape on the left side (in FIGS. 6A and 6B) of the W-shaped first island 301 has an anode terminal that is the p-type first semiconductor layer 81 on the p-type substrate 80, a cathode electrode that is an n-type ohmic electrode 121 formed on the area 111 of the n-type fourth semiconductor layer 84, and a gate terminal G11 that is a p-type ohmic electrode 131 formed on the p-type third semiconductor layer 83 that is exposed by removing the n-type fourth semiconductor layer 84. Further, light is emitted from the surface (light emitting surface 312) of the area 111 of the n-type fourth semiconductor layer 84 except for a portion that is covered by the n-type ohmic electrode 121 and the turn-on signal lines 75-1 and 75-2. In this case, the p-type ohmic electrode 131 is installed adjacent to the area 111, and extends to the V-shaped portion of the first island 301.

The setting thyristor S1 installed in the right portion of the V shape of the first island 301 has an anode terminal that is the p-type first semiconductor layer 81 on the p-type substrate 80, a cathode electrode that is an n-type ohmic electrode 122 formed on the area 112 of the n-type fourth semiconductor layer 84, and a gate terminal Gs1 that is the p-type third semiconductor layer 83. In this case, the gate terminal Gs1 is not constructed as an individual electrode, and is continuous to the p-type third semiconductor layer 83 (the layer that acts as a resistor) of the connection resistor Rx and the connection resistor Ry to be described later.

In the same manner, the connection resistor Rx installed on the first island 301 has resistance that corresponds to the p-type third semiconductor layer 83 between the p-type ohmic electrode 132 installed on the p-type third semiconductor layer 83 and the setting thyristor 51. The p-type ohmic electrode 132 is installed in the center portion of the W shape of the first island 301. The connection resistor Ry has resistance that corresponds to the p-type third semiconductor layer 83 between the setting thyristor 51 and the p-type ohmic electrode 131 (gate terminal G11).

Further, the connection resistor Rz installed on the first island 301 has resistance that corresponds to the p-type third semiconductor layer 83 between the p-type ohmic electrode 131 (gate terminal G11) and the p-type ohmic electrode 133 installed on the p-type third semiconductor layer 83. The p-type ohmic electrode 133 is installed at the front end of the left portion that is branched from the left V shape of the first island 301.

The coupling diode D1 installed on the second island 302 has a cathode terminal that is the n-type ohmic electrode 123 installed on the area 113 of the n-type fourth semiconductor layer 84 and an anode terminal that is the p-type ohmic electrode 134 (gate terminal Gt1) installed on the p-type third semiconductor layer 83 that is exposed by removing the n-type fourth semiconductor layer 84.

In the same manner, the transmission thyristor T1 installed on the second island 302 has an anode terminal that is the p-type fourth semiconductor layer 84 on the p-type substrate 80, a cathode terminal that is the n-type ohmic electrode 124 formed on the area 114 of the n-type fourth semiconductor layer 84, and a gate terminal Gt1 that is the p-type ohmic electrode 134.

In this case, other islands that are installed in parallel to the first island 301 and the second island 302 are the same.

The setting enabling thyristor TE1 installed on the third island 303 has an anode terminal that is the p-type fourth semiconductor layer 84 on the p-type substrate 80, a cathode terminal that is the n-type ohmic electrode 125 formed on the area 115 of the n-type fourth semiconductor layer 84, and a gate terminal Gte1 that is the p-type ohmic electrode 135 formed on the p-type third semiconductor layer 83 that is exposed by removing the n-type fourth semiconductor layer 84.

The setting enabling thyristor TE2 installed on the fourth island 304 has an anode terminal that is the p-type fourth semiconductor layer 84 on the p-type substrate 80, cathode terminal that is the n-type ohmic electrode 126 formed on the area 116 of the n-type fourth semiconductor layer 84, and a gate terminal Gte2 that is the p-type ohmic electrode 136 formed on the p-type third semiconductor layer 83 that is exposed by removing the n-type fourth semiconductor layer 84.

The start diode Ds installed on the fifth island 305 has a cathode terminal that is the n-type ohmic electrode 127 installed on the area 117 of the n-type fourth semiconductor layer 84 and an anode terminal that is the p-type ohmic electrode 137 formed on the p-type third semiconductor layer 83 that is exposed by removing the n-type fourth semiconductor layer 84.

The current limiting resistor R1 installed on the sixth island 306, the current limiting resistor RW1 installed on the seventh island 307, the current limiting resistor RE installed on the eighth island 308, the current limiting resistor R11 installed on the ninth island 309, and the current limiting resistor R12 installed on the tenth island 310 have resistance that corresponds to the p-type third semiconductor layer 83 between one set of the p-type ohmic electrodes (no sign) formed on the p-type third semiconductor layer 83.

Referring to FIG. 6A, the connection relationship between the respective devices will be described.

The n-type ohmic electrode 121 that is the cathode terminal of the light emitting thyristor L1 of the first island 301 is connected to the turn-on signal line 75-1. The turn-on signal line 75-1 is connected to the power line 71 through the current limiting resistor R11 installed on the ninth island 309. Other odd-numbered light emitting thyristors L3, . . . are the same.

On the other hand, the n-type ohmic electrode (no sign) that is the cathode terminal of the even-numbered light emitting thyristor L2 installed on the island that is adjacent to the first island 301 is connected to the turn-on signal line 75-2. The turn-on signal line 75-2 is connected to the power line 71 through the current limiting resistor R12 installed on the tenth island 310. Other even-numbered light emitting thyristors L4 are the same.

The n-type ohmic electrode 122 that is the cathode terminal of the setting thyristor S1 of the first island 301 is connected to the setting signal line 74-1. Other odd-numbered setting thyristors S3, S5, . . . are the same. Further, the n-type ohmic electrode 125 that is the cathode terminal of the setting enabling thyristor TE1 of the third island 303 is also connected to the setting signal line 74-1. The setting signal line 74-1 is connected to the terminal ϕWo through the current limiting resistor RW1 installed on the seventh island 307.

The n-type ohmic electrode (no sign) that is the cathode terminal of the setting thyristor S2 that is installed on the first island 301 in the same manner as the setting thyristor S1 is connected to the setting signal line 74-2. Other even-numbered setting thyristors S2, S6, . . . are the same. Further, the n-type ohmic electrode 126 that is the cathode terminal of the setting enabling thyristor TE2 of the fourth island 304 is also connected to the setting signal line 74-2. The setting signal line 74-2 is connected to the terminal ϕWe (not illustrated) through the current limiting resistor RW2 installed on the island (not illustrated).

The p-type ohmic electrode 135 that is the gate terminal Gte1 of the setting enabling thyristor TE1 installed on the third island 303 and the p-type ohmic electrode 136 that is the gate terminal Gte2 of the setting enabling thyristor TE2 installed on the fourth island 304 are connected to the enabling signal line 76. The enabling signal line 76 is connected to the terminal ϕE through the current limiting resistor RE installed on the eighth island 308.

The p-type ohmic electrode 132 of the first island 301 is connected to the p-type ohmic electrode 134 (gate terminal Gt1) of the second island 302. The p-type ohmic electrode 133 of the first island 301 is connected to the power line 71.

The islands which are equal to the first island 301 and the second island 302 and are installed in parallel to the first island 301 and the second island 302 are the same. The power line 71 is connected to the terminal Vga.

The p-type ohmic electrode 134 (gate terminal Gt1) of the second island 302 is connected to the n-type ohmic electrode 127 that is the cathode terminal of the start diode Ds installed on the fifth island 305.

The n-type ohmic electrode 124 that is the cathode terminal of the transmission thyristor T1 installed on the second island 302 is connected to the first transmission signal line 72. The first transmission signal line 72 is connected to the terminal ϕ1 through the current limiting resistor R1 installed on the sixth island 306.

The odd-numbered transmission thyristors T3, which are installed in parallel to the second island 302 and is installed on the same island as the second island 302, are the same.

The cathode terminal of the even-numbered transmission thyristors T2, . . . , which are installed in parallel to the second island 302 and is installed on the same island as the second island 302, is connected to the second transmission signal line 73. The p-type ohmic electrode 137 that is the anode terminal of the start diode Ds installed on the fifth island 305 is also connected to the second transmission signal line 73. Further, the second transmission signal line 73 is connected to the terminal ϕ1 (not illustrated) through the current limiting resistor R1 installed on the island (not illustrated).

The cathode terminal of the coupling diode D1 installed on the second island 302 is connected to the p-type ohmic electrode 138 that is the gate terminal Gt2 of the transmission thyristor T2 installed on the same island as the adjacent second island 302. Even the coupling diodes D2, installed on the same island as the second island 302 that is parallel to the second island 302 are the same.

Further, although explanation will be omitted, the turn-on thyristors TR1 and TR2 installed on the same islands as the third island 303 and the fourth island 304, and even the current limiting resistors R2, RW2, RR1, RR2, R13, and R14 installed on the same islands as the sixth island 306, the seventh island 307, the ninth island 309, and the tenth island 310 are constructed in the same manner.

By doing so, the light emitting chip C as illustrated in FIG. 5 is constructed.

Next, the basic operation of the thyristors (the light emitting thyristor L, the transmission thyristor T, the setting thyristor S, the setting enabling thyristors TE1 and TE2, and the turn-off thyristors TR1 and TR2) will be described.

<Basic Operation of Thyristor>

The thyristor is a semiconductor device having three terminals of an anode, a cathode, and a gate.

Hereinafter, as an example illustrated in FIGS. 5 and 6A and 6B, it is assumed that the reference potential. Vsub that is supplied to the terminal Vsub (anode terminal of the thyristor) of the light emitting chip C is 0V as high-level potential (hereinafter described as "H"), and the power potential Vga supplied to the terminal Vga is −3.3V as low level potential (hereinafter described as "L"). Further, it is assumed that the thyristor, as illustrated in FIG. 6B, is constructed by laminating the p-type semiconductor layers (the first semiconductor layer 81 and the third semiconductor layer 83) such as GaAs, GaAlAs, and the like, and n-type semiconductor layers (the second semiconductor layer 82, and the fourth semiconductor layer 84), and the diffusion potential (forward potential) Vd of the pn junction is 1.5V.

In an off-state thyristor, current flowing between the anode terminal and the cathode terminal is lower than the current in an on-state thyristor. The off-state thyristor is shifted to an on-state (turned on) if potential that is lower than a threshold voltage (negative potential having a large absolute) is applied to the cathode terminal. If the thyristor is turned on, it is in a state where large current flows between the anode terminal and the cathode terminal in comparison to the off state of the thyristor. Here, the threshold voltage of the thyristor is a value obtained by subtracting the forward potential Vd of the pn junction from the potential of the gate terminal. Accordingly, if the potential of the gate terminal of the thyristor is −1.5V, the threshold voltage becomes −3.0V. That is, if potential that is lower than −3.0V is applied to the cathode terminal, the thyristor is turned on. In this case, if the potential of the gate terminal of the thyristor is 0V, the threshold voltage becomes −1.5V.

The gate terminal of the on-state thyristor has the potential that is close to the potential of the anode terminal of the thyristor. Here, since the anode terminal is set to "H" (0V), explanation will be made on the assumption that the potential of the gate terminal becomes "H" (0V). Further, the cathode terminal of the on-state thyristor has the potential that is obtained by subtracting the forward potential Vd of the pn junction from the potential of the anode terminal. That is, the potential of the cathode terminal becomes −1.5V.

Once the thyristor is turned on, it maintains the on state until the potential of the cathode terminal becomes higher voltage (negative potential having a small absolute value, 0 or positive potential) than the potential (maintenance potential) that is required to maintain the on state. The potential of the cathode terminal of the on-state thyristor is −1.5V, and if the potential that is lower than −1.5V is continuously applied to the cathode terminal and current that may maintain the on state is supplied, the thyristor maintains the on state. The maintenance potential is −Vd (−1.5V).

In the case, if the potential that is higher than −1.5V is applied to the cathode terminal, the thyristor is shifted to the off state (is turned off). For example, if the cathode terminal becomes "H" (0V), the cathode terminal has the same potential as the anode terminal, and thus the thyristor is turned off.

Further, in an on state, the thyristor maintains a current-flowing state, and according to the potential of the gate terminal, it is not shifted to the off state. That is, the thyristor has a function of maintaining (storing or holding) the on state.

As described above, the potential that is applied to the cathode terminal in order to maintain the on state of the thyristor may be lower than the potential that is applied to the cathode terminal in order to turn on the thyristor.

The light emitting thyristor L is lit (emits light) when it is turned on, while it is unlit (emits no light) when it is turned off. The light emitting output (light emission amount) of the on-state light emitting thyristor L is determined by current flowing between the cathode terminal and the anode terminal. In this case, the transmission thyristor T, the setting thyristor S, the setting enabling thyristors TE1 and TE2, and the turn-off thyristors TR1 and TR2 may be turned on to emit light. Since these thyristors exert an influence on the image forming if the light emission amount is large, the light emission amount is inhibited by light shielding.

(Operation of Light Emitting Apparatus 65)

As described above, the first transmission signal ϕ1*a*, the second transmission signal ϕ2*a*, the enabling signal ϕEa, and the turn-off signal ϕRa are transmitted in common to the light emitting chip group #a. Accordingly, the light emitting chips Ca1 to Ca20 of the light emitting chip group #a are operated in parallel (simultaneously). Further, the first transmission signal ϕ1*b*, the second transmission signal ϕ2*b*, the enabling signal ϕEb, and the turn-off signal ϕRb are transmitted in common to the light emitting chip group #b. Accordingly, the light emitting chips Cb1 to Cb20 of the light emitting chip group #b are operated in parallel (simultaneously).

On the other hand, the setting signals ϕWo1 to ϕWo20 and the setting signals ϕWe1 to ϕWe20 are transmitted in common to the light emitting chip sets #1 to #20 each of which is composed of one light emitting chip C that belongs to the light emitting chip group #a and one light emitting chip C that belongs to the light emitting chip group #b. Accordingly, the light emitting chip sets #1 to #20 are operated in parallel (simultaneously).

As seen from the above-described contents, it is sufficient if the operation of the light emitting chip set #1 (light emitting chips Ca1 and Cb1) is explained.

Figure 7:
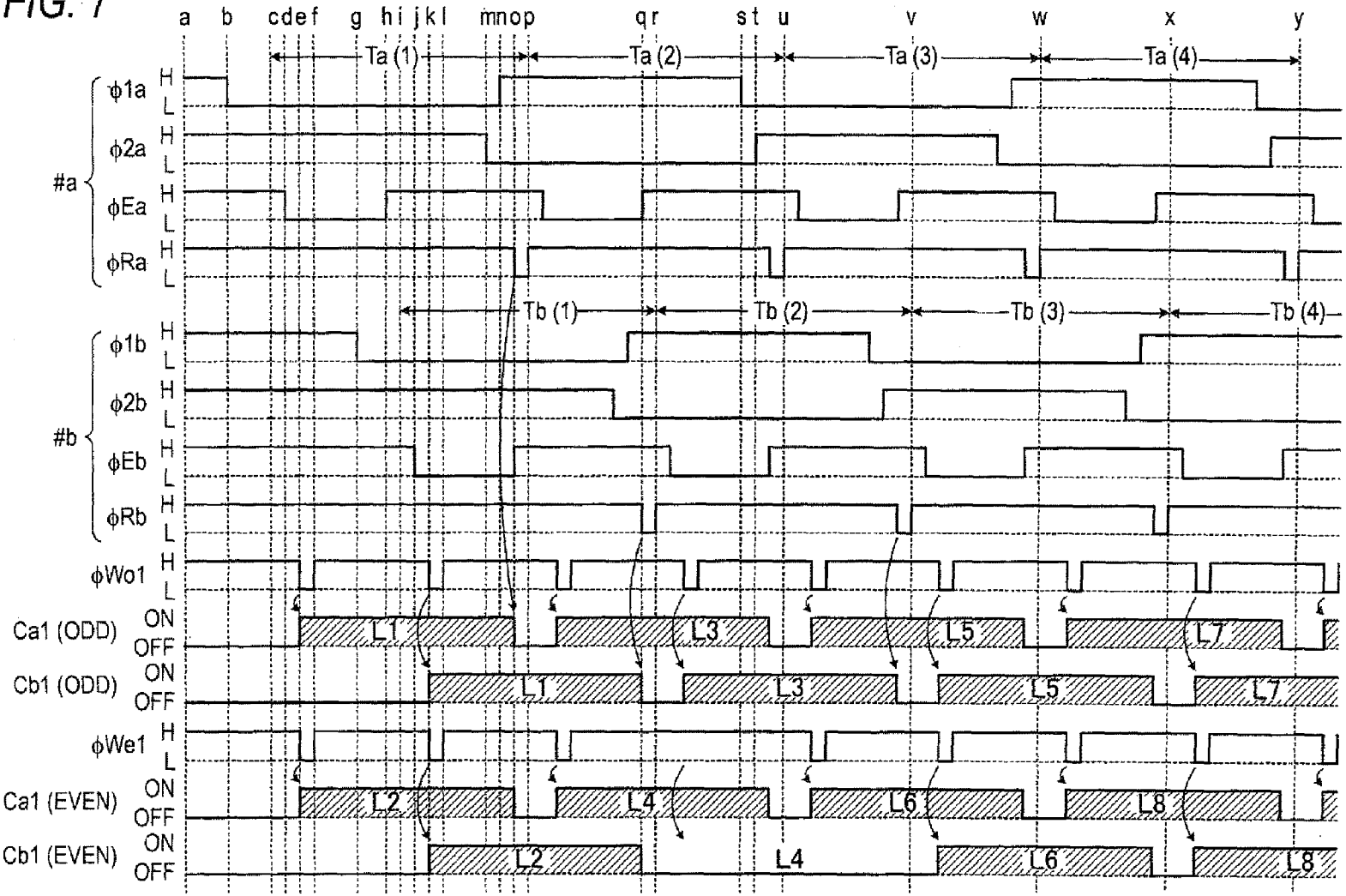
FIG. 7 is a timing chart illustrating an operation of a light emitting chip of a light emitting apparatus according to a first exemplary embodiment.

FIG. 7 is a timing chart illustrating an operation of a light emitting chip C of a light emitting apparatus 65 according to a first exemplary embodiment.

In FIG. 7, a timing chart for explaining the operation of the light emitting chip set #1 (light emitting chips Ca1 and Cb1) in the light emitting apparatus 65 is illustrated. Specifically, in FIG. 7, a timing chart of a portion that controls the turn-on or non-turn-on of 8 light emitting thyristors L of the light emitting thyristors L1 to L8 in the respective light emitting chip C is illustrated. Hereinafter, the turn-on or non-turn-on control of the light emitting thyristors L is called "turn-on control".

In the light emitting chip Ca1, it is assumed that all light emitting thyristors L1 to L8 are turned on. In the light emitting chip Cb1, it is assumed that the light emitting thyristors L1 to L3 and L5 to LB are turned on and the light emitting thyristor L4 is not turned on.

In FIG. 7, the light emitting chip Ca1 is divided into the light emitting chip Ca1 (odd) that indicates odd-numbered light emitting thyristors L1, L3, L5, . . . and the light emitting chip Ca1 (even) that indicates even-numbered light emitting thyristors L2, L4, L6, . . . . The light emitting chip Cb1 is the same.

As described later, in the first exemplary embodiment, the even-numbered light emitting thyristors L and the odd-numbered light emitting thyristors L constitute respective light emitting device groups, and light emitting thyristors L of the respective light emitting devices groups, that is, one odd-numbered light emitting thyristor L and one even-numbered light emitting thyristor L, form a pair, so that the turn-on control thereof is performed.

In FIG. 7, it is assumed that the time goes by in alphabetical order from time a to time y. The turn-on control of the light emitting thyristors L1 and L2 of the light emitting chip Ca1 of the light emitting chip group #a is performed in a period Ta(1) from time c to time P. The turn-on control of the light emitting thyristors L3 and L4 of the light emitting chip Ca1 of the light emitting chip group #a is performed in a period Ta(2) from time p to time u. The turn-on control of the light emitting thyristors L5 and L6 of the light emitting chip Ca1 of the light emitting chip group #a is performed in a period Ta(3) from time u to time w. The turn-on control of the light emitting thyristors L7 and LB of the light emitting chip Ca1 of the light emitting chip group #a is performed in a period Ta(4) from time w to time y. Hereinafter, in the same manner as described above, the turn-on control of the light emitting thyristors L the number of which is equal to or more than 5 is performed.

On the other hand, the turn-on control of the light emitting thyristors L1 and L2 of the light emitting chip Cb1 of the light emitting chip group #b is performed in a period Tb(1) from time i to time r. The turn-on control of the light emitting thyristors L3 and L4 of the light emitting chip Cb1 of the light emitting chip group #b is performed in a period Tb(2) from time r to time v. The turn-on control of the light emitting thyristors L5 and L6 of the light emitting chip Cb1 of the light emitting chip group #b is performed in a period Tb(3) from time v to time x. The turn-on control of the light emitting thyristors L7 and L8 of the light emitting chip Cb1 of the light emitting chip group #b is performed in a period Tb(4) after time x.

Hereinafter, in the same manner as described above, the turn-on control of the light emitting thyristors L the number of which is equal to or more than 9 is performed.

In this exemplary embodiment, the periods Ta(1), Ta(2), Ta(3), . . . , and the periods Tb(1), Tb(2), Tb(3), . . . , have same length, and may be referred as period T, when not distinguished.

In this exemplary embodiment, the periods Ta(1), Ta(2), Ta(3), . . . , in which the light emitting chips Ca1 to Ca20 of the light emitting chip group #a are controlled, and the periods Tb(1), Tb(2), Tb(3), . . . , in which the light emitting chips Cb1 to Cb20 of the light emitting chip group #b, are shifted from each other by a half of the period T (in phase, 180°). That is, the period Tb(1) starts after the lapse of a half of the period T after the period Ta(1) starts.

Accordingly, the periods Ta(1), Ta(2), Ta(3), . . . , in which the light emitting chip Ca1 of the light emitting chip group #a is controlled, will be hereinafter described.

If the mutual relationship between the signals is maintained as described hereinafter, the period T may be varied.

The signal waveforms in the periods Ta(1), Ta(2), Ta(3), . . . are repeated except for the setting signals ϕWo (ϕWo1 to ϕWo20) and the setting signals ϕWe (ϕWe1 to ϕWe20), which are changed according to image data.

Accordingly, hereinafter, only the period Ta(1) from time a to time c will be described. In this case, the period from time a to time c is a period in which the light emitting chip Ca1 and the light emitting chip Cb1 start their operation. The signals in this period will be described in the description of their operations.

Signal waveforms of the first transmission signal ϕ1*a*, the second transmission signal ϕ2*a*, the enabling signal ϕEa, and the turn-off signal ϕRa in the period Ta(1) will be described.

The first transmission signal ϕ1*a* is "L" at time c, is shifted from "L" to "H" at time n, and maintains "H" at time p.

The second transmission signal ϕ2*a* is "H" at time c, is shifted from "H" to "L" at time m, and maintains "L" at time p.

Here, comparing the first transmission signal ϕ1*a* with the second transmission signal ϕ2*a*, the waveform of the first transmission signal ϕ1*a* in the period Ta(1) becomes the waveform of the second transmission signal ϕ2*a* in the period Ta(2). Further, the waveform of the second transmission signal ϕ2*a* in the period Ta(1) becomes the waveform of the first transmission signal ϕ1*a* in the period Ta(2).

That is, the first transmission signal ϕ1*a* and the second transmission signal ϕ2*a* are signal waveforms which are repeated in the unit of a period (2T) that is double the period T. Further, they alternately repeat "H" and "L" across the period in which both the signals become "L", such as the period from time m to time n. Further, except for the period from time a to time b, the first transmission signal ϕ1 and the second transmission signal ϕ2 do not have a period in which they become "H" at the same time.

By the transmission signals of one set of the first transmission signal ϕ1*a* and the second transmission signal ϕ2*a*, the transmission thyristors T as illustrated in FIG. 5 become in an on state in order as described later, and the light emitting thyristors L which are subjects of turn-on or non-turn-on (of which the turn-on is to be controlled) are set.

The enabling signal ϕEa is "H" at time c, is shifted from "L" to "H" at time d, and is shifted from "L" to "H" at time h. The enabling signal ϕEa maintains "H" at time p.

The enabling signal ϕEa, as described later, sets the light emitting thyristors L which are subjects of turn-on or non-turn-on (of which the turn-on is to be controlled) in a turn-on state.

The turn-off signal ϕRa is "H" at time c, is shifted from "H" to "L" at time o, and is shifted from "L" to "H" at time p.

The turn-off signal ϕRa, as described later, is a signal that turns off the light emitting thyristor L that is in a turn-on (light emitting) state.

The setting signal ϕWo1 is "H" at time c, is shifted from "H" to "L" at time e, and is shifted from "L" to "H" at time f. Further, the setting signal ϕWo1 is shifted from "H" to "L" at time k, and is shifted from "L" to "H" at time 1. That is, the setting signal ϕWo1 has two "L" periods in the period Ta(1).

Here, the waveform of the setting signal ϕWe1 in the period Ta(1) is equal to the waveform of the setting signal ϕWo1.

Further, in consideration of the relationship between the setting signals ϕWo1 and We1 and the enabling signal ϕEa, the setting signals ϕWo1 and We1 are "L" in a period from time e to time f, that is included in a period from time d to time h, in which the enabling signal ϕEa is "L".

On the other hand, in consideration of the relationship between the enabling signal ϕEb having a phase that is shifted by 180° with respect to the enabling signal ϕEa and the setting signals ϕWo1 and ϕWe1, the setting signals ϕWo1 and ϕWe1 are "L" in a period from time k to time l, that is included in a period from time j to time o, in which the enabling signal ϕEb is "L".

That is, in the period Ta(1), the period (from time e to time f), in which the setting signals ϕWo1 and ϕWe1 are initially "L", corresponds to a signal for turning on (lighting) the light emitting thyristors L1 and L2 of the light emitting chip Ca1, and the period (from time k to time l), in which the setting signal ϕWo1 become "L" later, corresponds to a signal for turning on (lighting) the light emitting thyristors L1 and L2 of the light emitting chip Cb1.

Because of this, the period (from time d to time h) in which the enabling signal ϕEa is "L" is set not to overlap the period (from time k to time l) in which the setting signals ϕWo1 and ϕWe1 become "L" in order to turn on (light) the light emitting thyristor L1 of the light emitting chip Cb1. In the same manner, the period (from time j to time o) in which the enabling signal ϕEb is "L" is set not to overlap the period (from time e to time f) in which the setting signals ϕWo1 and ϕWe1 become "L" in order to turn on (light) the light emitting thyristor L1 of the light emitting chip Ca1.

As described later, the light emitting thyristors L are turned on (emit light) when the enabling signals ϕE (enabling signals ϕEa and ϕEb) are "L" and the setting signals ϕW (ϕWo and ϕWe) are "L".

Now, with reference to FIGS. 4A, 4B, and 5, the operation of the light emitting chip C in the light emitting apparatus 65 will be described according to the timing chart illustrated in FIG. 7.

(1) Time a

A state (initial state) at time a when supply of the reference potential Vsub and the power potential Vga to the light emitting apparatus 65 starts will be described.

<Light Emitting Apparatus 65>

At time a in the timing chart shown in FIG. 7, the power line 200*a* is set to the reference potential Vsub of "H" (0V), and the power line 200*b* is set to the power potential Vga of "L" (−3.3V) (see FIG. 4). Accordingly, the respective terminals Vsub of all the light emitting chips C (light emitting chips Ca1 to Ca20 and the light emitting chips Cb1 to Cb20) are set to "H", and the respective terminals Vga are set to "L" (−3.3V). In this case, the power line 71 that is connected to the terminal Vga becomes "L". Further, the turn-on signal line 75-1 that is connected to the power line 71 through the current limiting resistors R11 and R13 becomes "L", and the turn-on signal line 75-2 that is connected to the power line 71 through the current limiting resistors R12 and R14 becomes "L" (See FIG. 5).

Further, the transmission signal generation unit 120*a* of the signal generation circuit 110 sets the first transmission signal ϕ1*a* and the second transmission signal ϕ2*a* to "H", and the transmission signal generation unit 120*b* sets the first transmission signal ϕ1*b* and the second transmission signal ϕ2*b* to "H", respectively. Then, the first transmission signal lines 201*a* and 201*b* and the second transmission signal lines 202*a* and 202*b* become "H" (See FIG. 4). Accordingly, the terminals ϕ1 and the terminals ϕ2 of the light emitting chips C (light emitting chips Ca1 to Ca20 and the light emitting chips Cb1 and Cb20) become "H". The potential of the first transmission signal line 72 that is connected to the terminal ϕ1 through the current limiting resistor R1 also becomes "H", and the second transmission signal line 73 that is connected to the terminal ϕ1 through the current limiting resistor R2 also becomes "H" (See FIG. 5).

Further, the enabling signal generation unit 130*a* of the signal generation circuit 110 sets the enabling signal ϕEa to "H", and the enabling signal generation unit 130*b* sets the enabling signal ϕEb to "H". Then, the enabling signal lines 203*a* and 203*b* become "H" (See FIG. 4). Accordingly, the terminal ϕE of the light emitting chip C becomes "H" (See FIG. 5).

Further, the turn-off signal generation unit 140*a* of the signal generation circuit 110 sets the turn-off signal ϕRa to "H", and the turn-off signal generation unit 140*b* sets the turn-off signal ϕ1*b* to "H". Then, the turn-off signal lines 204*a* and 204*b* become "H" (See FIG. 4). Accordingly, the terminal ϕR of the light emitting chip C becomes "H". In this case, the turn-off signal line 77 that is connected to the terminal ϕR also becomes "H" (See FIG. 5).

The setting signal generation unit 150*a* of the signal generation circuit 110 sets the setting signals ϕWO1 to ϕWo20 to "H", respectively, and the setting signal lines 205*o*1 to 205*o*20 are set to "H", respectively. The setting signal generation unit 150*b* sets the setting signals ϕWe1 to ϕWe20 to "H". Then, the setting signal lines 205*e*1 to 205*e*20 become "H" (See FIG. 4). Accordingly, the terminals ϕWo and ϕWe of the light emitting chip C become "H" (See FIG. 5).

The terminal ϕWo of the light emitting chip C is connected to the setting signal line 74-1 through the current limiting resistor RW1. The terminal ϕWe of the light emitting chip C is connected to the setting signal line 74-2 through the current limiting resistor RW2. Accordingly, the setting signal lines 74-1 and 74-2 also become "H" (See FIG. 5).

Next, with reference to FIG. 5, the operation of the light emitting chips C will be described using the light emitting chips Ca1 and Cb1 that belong to the light emitting chip set #1 according to the timing chart as illustrated in FIG. 7.

In FIG. 7 and in the following description, it is assumed that the potentials of the respective terminals are changed in a step manner. However, the potentials of the respective terminals are gradually changed. Accordingly, if the following conditions are satisfied while the potentials are changed, the thyristors change their turn-on and turn-off states.

<Light Emitting Chip Ca1>

Since the anode terminals of the transmission thyristor T, the setting thyristor S, the setting enabling thyristors TE1 and TE2, and the turn-off thyristors TR1 and TR2 are connected to the terminal Vsub, they are set to "H", respectively.

On the other hand, the respective cathode terminals of the odd-numbered transmission thyristors T1, T3, T5, . . . are connected to the first transmission signal line 72, and are set to "H", respectively. The respective cathode terminals of the even-numbered transmission thyristors T2, T4, T6, are connected to the second transmission signal line 73, and are set to "H", respectively. Accordingly, all the anode terminal and the cathode terminal of the transmission thyristor T become "H", and thus the transmission thyristor T is in an off state.

In the same manner, the respective cathode terminals of the odd-numbered setting thyristors S1, S3, S5, . . . and the setting enabling thyristor TE1 are connected to the setting signal line 74-1, and are set to "H", respectively. The respective cathode terminals of the even-numbered setting thyristors S2, S4, S6, . . . and the setting enabling thyristor TE2 are connected to the setting signal line 74-2, and are set to "H", respectively. Since the setting signal lines 74-1 and 74-2 are "H", the anode terminals and the cathode terminals of the setting thyristor S and the setting enabling thyristors TE1 and TE2 are all "H", and thus they are in an off state.

Further, the gate terminals Gtr2 of the odd-numbered light emitting thyristors L1, L3, L5, . . . and the turn-off thyristor TR2 are connected to the turn-on signal line 75-1, and are set to "L" (−3.3V), respectively. The gate terminals Gtr1 of the even-numbered light emitting thyristors L2, L4, L6, . . . and the turn-off thyristor TR1 are connected to the turn-on signal line 75-2, and are set to "L" (−3.3V), respectively.

Accordingly, all the anode terminal and the cathode terminal of the light emitting thyristor L become "L" (−3.3V). All the turn-off thyristors TR1 and TR2 have a threshold voltage of −4.8V.

The gate terminal Gte1 of the setting enabling thyristor TE1 and the gate terminal Gte2 of the setting enabling thyristor TE2 are connected to the enabling signal line 76, and are set to "H" (0V). Accordingly, all the setting enabling thyristor TE1 and the setting enabling thyristor TE2 have a threshold voltage of −1.5V.

The cathode terminal of the turn-off thyristor TR1 is connected to the turn-off signal line 77 through the current limiting resistor RR1, and the cathode terminal of the turn-off thyristor TR2 is connected to the turn-off signal line 77 through the current limiting resistor RR2. The turn-off signal line 77 is set to "H". Accordingly, the anode terminals and the cathode terminals of the turn-off thyristor TR1 and the turn-off thyristor TR2 are all "H" to be in an off state.

The gate terminal Gt of the transmission thyristor T is connected to the gate terminal Gs of the setting thyristor S through the connection resistor Rx. The gate terminal Gs of the setting thyristor S is connected to the gate terminal G1 of the light emitting thyristor L through the connection resistor Ry. Further, the gate terminal G1 of the light emitting thyristor L is connected to the power line 71 of "L" (−3.3V) through the connection resistor Rz.

That is, the potential of the gate terminal Gt and the potential of "L" (−3.3V) on the power line 71 are divided by the connection resistors Rx, Ry, and Rz, and the gate terminal Gs and the gate terminal G1 are set to the divided potentials.

In this case, with respect to one transmission thyristor T, two pairs of the setting thyristors S and light emitting thyristors L are connected.

Here, it is assumed that the resistance value Rx of the connection resistor Rx is 2 kΩ, the resistance value Ry of the connection resistor Ry is 16 kΩ, and the resistance value Rz of the connection resistor Rz is 6 kΩ. In this case, as described later, the resistance value Ry of the connection resistor Ry is lowered to about 0.8 kΩ by modulation if the setting thyristor S is in an on state. It is sufficient if an operation to be described later may be realized with these resistance values, and the resistance values may differ from the above-described resistance values.

The anode terminal of the start diode Ds is connected to the second transmission signal line 73 of "H" (0V). The cathode terminal (gate terminal Gt1) of the start diode Ds is connected to the power line 71 of "L" (−3.3V) through the connection resistors Rx, Ry, and Rz. Accordingly, the start diode Ds is biased in forward direction (forward-biased). Accordingly, the potential of the cathode terminal (gate terminal Gt1) of the start diode Ds becomes −1.5V that is obtained by subtracting the forward potential Vd (1.5V) of the pn junction from "H" (0V) of the anode terminal, and the threshold voltage of the transmission thyristor T1 becomes −3V.

Accordingly, the potential of the gate terminals Gs1 and Gs2 becomes −1.65V. Accordingly, the threshold voltage of the setting thyristors S1 and S2 becomes −3.15V.

At this time, the potential of the gate terminals G11 and G12 becomes −2.85V. Accordingly, the threshold voltage of the light emitting thyristors L1 and L2 becomes −4.35V. At this time, as described above, the turn-on signal lines 75-1 and 75-2 are "L" (−3.3V), which is lower than the threshold voltage of the light emitting thyristors L1 and L2, and thus the light emitting thyristors L1 and L2 are not turned on.

In the same manner, the coupling diode D1 is forward-biased, and the potential of the cathode terminal (gate terminal Gt2) of the coupling diode D1 becomes −3V.

Accordingly, the potential of the gate terminals Gs3 and Gs4 becomes −3.02V, and the threshold voltage of the setting thyristors S3 and S4 becomes −4.52V.

On the other hand, the potential of the gate terminals G13 and G14 becomes −3.23V. Accordingly, the threshold voltage of the light emitting thyristors L3 and L4 becomes −4.73V.

Since the cathode terminal of the start diode Ds is not affected by "H" (0V), the potential of the gate terminal Gt of the transmission thyristor T, the number of which is equal to or larger than 3, becomes "L" (−3.3V). Therefore, the threshold voltage of transmission thyristor T, the number of which is equal to or larger than 3 becomes −4.8V.

Accordingly, the threshold voltage of the transmission thyristor T, the number of which is equal to or larger than 5 and the potential of the gate terminal G1 of the light emitting thyristor L become −3.3V. Accordingly, the threshold voltage of the setting thyristor T, the number of which is equal to or larger than 5, and the light emitting thyristor L becomes −4.8V.

<Light Emitting Chip Cb1>

Even in the light emitting chip Cb1, the initial state is the same as that of the light emitting chip Ca1, the explanation thereof will be omitted.

(2) Time b

At time b as illustrated in FIG. 7, the first transmission signal $\phi 1a$ that is transmitted to the light emitting chip group #a is shifted from "H" (0V) to "L" (−3.3V). Accordingly, the light emitting apparatus 65 enters into an operation state.

<Light Emitting Chip Ca1>

The transmission thyristor T1 having a threshold voltage of −3V is turned on. However, since the odd-numbered transmission thyristor T having a large number after the transmission thyristor T3 has a threshold voltage of −4.8V, it may not be turned on.

If the transmission thyristor T1 is turned on, the potential of the gate terminal Gt1 becomes "H" (0V) of the anode terminal. Then, the potential of the gate terminal Gt2 becomes −1.5V by the forward-biased coupling diode D1. Accordingly, the threshold voltage of the transmission thyristor T2 becomes −3V. The potential of the gate terminal Gt3 that is connected to the gate terminal Gt2 of the transmission thyristor T2 through the coupling diode D2 becomes −3V. Accordingly, the threshold voltage of the transmission thyristor T3 becomes −4.5V. The transmission thyristor T, the number of which is equal to or larger than 4, maintains the threshold voltage of −4.8V.

Further, the potential of the cathode terminal (the first transmission signal line 72 in FIG. 5) of the transmission thyristor T1 becomes −1.5V that is obtained by subtracting the forward potential Vd (1.5V) of the pn junction from "H" (0V) of the anode terminal of the transmission thyristor T1.

On the other hand, if the transmission thyristor T1 is turned on and the potential of the gate terminal Gt1 becomes "H" (0V), the potential of the gate terminals Gs1 and Gs2 becomes −0.27V, and the threshold voltage of the setting thyristors S1 and S2 become −1.77V. Further, the potential of the gate terminals G11 and G12 becomes −2.48V, and the threshold voltage of the light emitting thyristors L1 and L2 becomes −3.98V. In this case, although the turn-on signal lines 75-1 and 75-2 becomes "L" (−3.3V), this potential is lower than the threshold voltage, and thus the light emitting thyristors L1 and L2 are not turned on.

Further, if the potential of the gate terminal Gt2 becomes −1.5V, the potential of the gate terminals Gs3 and Gs3 becomes −1.65V, and the threshold voltage of the setting thyristors 53 and 54 becomes −3.15V. Further, the potential of the gate terminals G13 and G14 becomes −2.85V, and the threshold voltage of the light emitting thyristors L3 and L4 becomes −4.35V.

Further, if the potential of the gate terminal Gt3 becomes −3V, the potential of the gate terminals Gs5 and Gs6 becomes −3.02V, and the threshold voltage of the setting thyristors 55 and 56 becomes −4.52V. Further, the potential of the gate terminals G15 and G16 becomes −3.23V, and the threshold voltage of the light emitting thyristors L3 and L4 becomes −4.73V.

As described above, if the potential of the gate terminal Gt is changed, the potential of the gate terminals Gs and G1 is changed, and the threshold voltage of the setting thyristor S and the light emitting thyristor L is changed.

Hereinafter, only the thyristor that is related to the turn-on or turn-off control will be described.

That is, at time b, only the transmission thyristor T1 is turned on. Just after time b (here, when the thyristor returns to a normal state after the thyristor is changed due to the change of the potential of the signal at time b), the thyristor T1 is in an on state. Other transmission thyristor T, setting thyristor S, light emitting thyristor L, setting enabling thyristors TE1 and TE2, and turn-off thyristors TR1 and TR2 are in an off state.

Hereinafter, only the thyristors (transmission thyristor T, setting thyristor S, light emitting thyristor L, setting enabling thyristors TE1 and TE2, and turn-off thyristors TR1 and TR2) which are in an on state are described.

<Light Emitting Chip Cb1>

Since the signal that is transmitted to the light emitting chip group #b belonging to the light emitting chip Cb1 is not changed, the light emitting chip Cb1 maintains its initial state.

(3) Time c

Time c is a start time of the period Ta(1). So signal change occurs.

(4) Time d

At time d, the enabling signal ϕEa that is transmitted to the light emitting chip group #a is shifted from "H" (0V) to "L" (−3.3V).

<Light Emitting Chip Ca1>

The enabling signal line 76 becomes "L" (−3.3V) through the current limiting resistor RE. Then, the potential of the gate terminal Gte1 and Gte2 connected to the enabling signal line 76 becomes "L" (−3.3V). Then, the threshold voltage of the setting enabling thyristors TE1 and TE2 is shifted from −1.5V to −4.8V.

Just after time d, the transmission thyristor T1 is in an on state.

<Light Emitting Chip Cb1>

Since the signal that is transmitted to the light emitting chip group #b belonging to the light emitting chip Cb1 is not changed, the light emitting chip Cb1 maintains its initial state.

(5) Time e

At time e, the setting signals ϕWo1 and ϕWe1 that are transmitted to the light emitting chip Ca1 of the light emitting chip group #a and the light emitting chip set #1 to which the light emitting chip Cb1 of the light emitting chip group #b belongs are shifted from "H" (0V) to "L" (−3.3V).

<Light Emitting Chip Ca1>

The potential of the setting signal line 74-1 becomes "L" (−3.3V) through the current limiting resistor RW1. At this time, since the threshold voltage of the setting thyristors 51 and 52 of which the cathode terminals are connected to the setting signal line 74-1 is set to −1.77V, the setting thyristors S1 and 52 are turned on.

Then, the potential of the gate terminals Gs1 and Gs2 becomes 0V. Accordingly, the potential of the gate terminals G11 and G12 becomes the value that is obtained by dividing the difference potential between the potential (0V) of the gate terminals Gs1 and Gs2 and the potential (Vga ("L" (−3.3V))) of the power line 71 through the connection resistor Ry and the connection resistor Rz. At this time, since the setting thyristor S is in an on state, the resistance of the connection resistor Ry becomes about 0.8 kΩ. Accordingly, the potential of the gate terminals G11 and G12 becomes −0.39V. Accordingly, the threshold voltage of the light emitting thyristors L1 and L2 becomes −1.89V.

Since the turn-on signal line 75-1 to which the cathode terminal of the light emitting thyristor L1 is connected and the turn-on signal line 75-2 to which the cathode terminal of the light emitting thyristor L2 is connected have the power potential Vga ("L" (−3.3V)), respectively, the light emitting thyristors L1 and L2 are turned on (in FIG. 7, Ca1(odd) and Ca1 (even)). Accordingly, the potential of the turn-on signal lines 75-1 and 75-2 becomes −1.5V that is obtained by subtracting the forward potential Vd of the pn junction from the potential of the anode terminals of the light emitting thyristors L1 and L2.

Accordingly, the potential of the gate terminals Gtr1 and Gtr2 of the turn-off thyristors TR1 and TR2 becomes −1.5V, and the threshold voltage of the turn-off thyristors TR1 and TR2 becomes −3V.

At this time, the setting signal ϕWo1 and the setting signal ϕWe1 are simultaneously shifted from "H" (0V) to "L" (−3.3V) at time e. The shifting of the setting signal ϕWo1 and the setting signal ϕWe1 from "H" to "L" may not be performed simultaneously. Even if the setting signal ϕWo1 is first shifted from "H" to "L" prior to the setting signal ϕWe1 and the potential of the turn-on signal line 75-1 becomes −1.5V, the turn-on signal line 75-1 is connected to the power line 71 through the current limiting resistors R11 and R12, and thus the potential of the turn-on signal line 75-1 is connected to the power line 71 through the current limiting resistors R11 and R12, and thus the potential of the turn-on signal line 75-2 maintains the power potential Vga ("L" (−3.3V)). Accordingly, even though the setting signal ϕWe1 is shifted from "H" to "L" after the setting signal ϕWo1, the light emitting thyristor L2 is turned on. Accordingly, the potential of the turn-on signal line 75-2 becomes −1.5V.

Accordingly, just after time e, the light emitting thyristors L1 and L2 are turned on in a state where the transmission thyristor T1 and the setting thyristors S1 and S2 are turned on. That is, in the light emitting chip Ca1, two light emitting thyristors L1 and L2 are simultaneously turned on (emit light).

<Light Emitting Chip Cb1>

Since the threshold voltage of the setting enabling thyristors TE1 and TE2 is −1.5V, the setting signal ϕWo1 is shifted from "H" to "L", and if the potential of the setting signal lines 74-1 and 74-2 is shifted from "H" (0V) to "L" (−3.3V), the setting enabling thyristors TE1 and TE2 are turned on. Further, the potential of the setting signal lines 74-1 and 74-2 becomes −1.5V.

(6) Time f

At time f, the setting signals ϕWo1 and ϕWe1 that are transmitted to the light emitting chip Ca1 of the light emitting chip group #a and the light emitting chip set #1 to which the light emitting chip Cb1 of the light emitting chip group #b belongs are shifted from "L" (−3.3V) to "H" (0V).

<Light Emitting Chip Ca1>

The potential of the setting signal lines 74-1 and 74-2 becomes "H", and all the cathode terminal and the anode terminal of the setting thyristors S1 and S2 become "H" to turn off the setting thyristors S1 and S2.

However, the on-state light emitting thyristors L1 and L2 maintain the On state, and the potential of the gate terminal G11 and G12 becomes 0V. Further, since the transmission thyristor T1 is in an on state, the potential of the gate terminal Gt1 becomes 0V. Accordingly, the potential of the gate terminals Gs1 and Gs2, which are connected to the gate terminal Gt1 and the gate terminals G11 and G12 through the connection resistor Rx and the connection resistor Ry, respectively, also becomes 0V, and the threshold voltage of the setting thyristors S1 and S2 becomes −1.5V.

Just after time f, the transmission thyristor T1 is in an on state, and the light emitting thyristors L1 and L2 are turned on (emit light).

<Light Emitting Chip Cb1>

The potential of the setting signal lines 74-1 and 74-2 becomes "H", and all the cathode terminal and the anode terminal of the setting enabling thyristors TE1 and TE2 become "H" to turn off the setting enabling thyristors TE1 and TE2.

(7) Time g

At time g, the first transmission signal ϕ1*b* that is transmitted to the light emitting chip group #b is shifted from "H" (0V) to "L" (−3.3V).

<Light Emitting Chip Ca1>

Since the signal that is transmitted to the light emitting chip group #a, to which the light emitting chip Ca1 belongs, is not changed, the state just after time if is maintained.

<Light Emitting Chip Cb1>

The operation of the light emitting chip Cb1 is the same as the operation of the light emitting chip Ca1 at time b. That is, the transmission thyristor T1 is turned on. Accordingly, the threshold voltage of the setting thyristors S1 and S2 becomes −1.77V. Further, the potential of the first transmission signal line 72 becomes −1.5V.

That is, the light emitting chip Cb1 operates in the same manner as the light emitting chip Ca1 in a shifted timing (in a state where the phase is shifted by 180°).

(8) Time h

At time h, the enabling signal ϕa that is transmitted to the light emitting chip group #a is shifted from "L" (−3.3V) to "H" (0V).

<Light Emitting Chip Ca1>

The potential of the enabling signal line 76 becomes 0V, and the potential of the gate terminals Gte1 and Gte2 of the setting enabling thyristors TE1 and TE2 becomes 0V. Accordingly, the threshold voltage of the setting enabling thyristors TE1 and TE2 becomes −1.5V.

Just after time h, the transmission thyristor T1 is in an on state, and thus the light emitting thyristors L1 and L2 are turned on (emit light).

<Light Emitting Chip Cb1>

Since the signal that is transmitted to the light emitting chip group #b, to which the light emitting chip Cb1 belongs, is not changed, the state just after time g is maintained.

(9) Time i

At time i, the period Tb(1) starts. No signal change Occurs.

(10) Time j

At time j, the enabling signal ϕEb that is transmitted to the light emitting chip group #b is shifted from "H" (0V) to "L" (−3.3V).

<Light Emitting Chip Ca1>

Since the signal that is transmitted to the light emitting chip group #a, to which the light emitting chip Ca1 belongs, is not changed, the state just after time h is maintained.

<Light Emitting Chip Cb1>

Since the operation of the light emitting chip Cb1 is the same as the operation of the light emitting chip Ca1 at time d, the detailed description thereof will be omitted.

Just after time j, the transmission thyristor T1 is in an on state.

(11) Time k

At time k, the setting signals ϕWo1 and ϕWe1 that are transmitted to the light emitting chip Ca1 of the light emitting chip group #a and the light emitting chip set #1 to which the light emitting chip Cb1 of the light emitting chip group #b belongs are shifted from "H" (0V) to "L" (−3.3V).

<Light Emitting Chip Ca1>

The potential of the setting signal lines 74-1 and 74-2 is shifted from "H" (0V) to "L" (−3.3V) through the current limiting resistors RW1 and RW2. Then, since the threshold voltage becomes −1.5V at time h, the setting enabling thyristors TE1 and TE2, the cathode terminals of which are connected to the setting signal lines 74-1 and 74-2 are turned on.

In this case, as described above, since the light emitting thyristors L1 and L2 are in an on state, the threshold voltage of the setting thyristors S1 and S2 becomes −1.5V. Accordingly, instead of the setting enabling thyristor TE1, the setting thyristor S1 may be turned on. In the same manner, instead of the setting enabling thyristor TE2, the setting thyristor S2 may be turned on. Since the light emitting thyristor L1 is in an on state, it does not matter the setting thyristor S1 is turned on. In the same manner, since the light emitting thyristor L2 is in an on state, it does not matter the setting thyristor 52 is turned on.

Just after time k, the transmission thyristor T1, the setting enabling thyristor TE1 (and/or the setting thyristor S1), and the setting enabling thyristor TE2 (and/or the setting thyristor 52) are in an on state, and thus the light emitting thyristors L1 and L2 are turned on (emit light).

<Light Emitting Chip Cb1>

In the same manner as the light emitting chip Ca1 at time e, the setting thyristors S1 and S2 are turned on, and then the light emitting thyristors L1 and L2 are turned on (emit light) (Cb1(odd), Cb1(even) in FIG. 7).

Just after time k, the transmission thyristor T1, the setting thyristors S1 and S2 are in an on state, and thus the light emitting thyristors L1 and L2 are turned on (emit light). That is, in the light emitting chip Cb1, two light emitting thyristors L1 and L2 are simultaneously turned on (emit light).

(12) Time l

At time l, the setting signal ϕWe1 that is transmitted to the light emitting chip Ca1 of the light emitting chip group #a and the light emitting chip set #1 to which the light emitting chip Cb1 of the light emitting chip group #b belongs is shifted from "L" (−3.3V) to "H" (0V).

<Light Emitting Chip Ca1>

Since the potential of the setting signal lines 74-1 and 74-2 becomes "H", and all the on-state setting enabling thyristor TE1 (and/or the setting thyristor S1), and the setting enabling thyristor TE2 (and/or the setting thyristor S2) become "H", they are turned off.

However, the on-state light emitting thyristors L1 and L2 maintain the on state. Further, the threshold voltage of the setting thyristors S1 and S2 becomes −1.5V.

Just after time l, the transmission thyristor T1 is in an on state, and thus the light emitting thyristors L1 and L2 are turned on (emit light).

<Light Emitting Chip Cb1>

In the same manner as the operation of the light emitting chip Ca1 at time f, the potential of the setting signal lines 74-1 and 74-2 is shifted from "L" to "H", and thus the setting thyristors S1 and S2 are turned off.

Just after time 1, the transmission thyristor T1 is in an on state, and thus the light emitting thyristors L1 and L2 are turned on (emit light).

(13) Time m

At time m, the second transmission signal ϕ2*a* that is transmitted to the light emitting chip group #a is shifted from "H" (0V) to "L" (−3.3V).

<Light Emitting Chip Ca1>

The transmission thyristor T2 having the threshold voltage of −3V is turned on. However, the even-numbered transmission thyristor T, the number of which is equal to or larger than 4, is unable to be turned on since the threshold voltage is −4.8V.

If the transmission thyristor T2 is turned on, the gate terminal Gt2 becomes "H" (0V). Then, the potential of the gate terminal Gt3 that is connected to the gate terminal Gt2 of the transmission thyristor T2 through the coupling diode D2 becomes −1.5V. Accordingly, the threshold voltage of the transmission thyristor T3 becomes −3V.

Then, the second transmission signal line 73 becomes −1.5V.

On the other hand, if the transmission thyristor T2 is turned on and the gate terminal Gt2 becomes "H" (0V), the potential of the gate terminals Gs3 and Gs4 becomes −0.27V, and the threshold voltage of the setting thyristors 53 and S4 becomes −1.77V. Then, the potential of the gate terminals G13 and G14 becomes −2.48V, and the threshold voltage of the light emitting thyristors L3 and L4 becomes −3.98V.

Just after time m, the transmission thyristor T1 and the transmission thyristor T2 are in an on state, and thus the light emitting thyristors L1 and L2 are turned on (emit light).

<Light Emitting Chip Cb1>

Since the signal that is transmitted to the light emitting chip group #b, to which the light emitting chip Cb1 belongs, is not changed, the state just after time l is maintained.

(14) Time n

At time n, the first transmission signal $\phi 1a$ that is transmitted to the light emitting chip group #a is shifted from "L" (−3.3V) to "H" (0V).

<Light Emitting Chip Ca1>

Since all the cathode terminal and the anode terminal become "H", the on-state transmission thyristor T1 is turned off. At this time, the light emitting thyristors L1 and L2 are in an on state, and the potential of the gate terminal G11 maintains 0V. Accordingly, the threshold voltage of the transmission thyristor T1 maintains −1.5V.

Just after time n, the transmission thyristor T2 is in an on state, and thus the light emitting thyristors L1 and L2 are turned on (emit light).

<Light Emitting Chip Cb1>

Since the signal that is transmitted to the light emitting chip group #b, to which the light emitting chip Cb1 belongs, is not changed, the state just after time 1 is maintained.

(15) Time o

At time o, the turn-off signal ϕRa that is transmitted to the light emitting chip group #a is shifted from "H" (0V) to "L" (−3.3V). Further, the enabling signal ϕEb that is transmitted to the light emitting chip group #b is shifted from "L" (−3.3V) to "H" (0V).

<Light Emitting Chip Ca1>

If the turn-off signal Ra is shifted from "H" to "L" (−3.3V), the turn-off signal line 77 becomes "L" (−3.3V). Then, the turn-off thyristors TR1 and TR2, of which the threshold voltage becomes −3V at time e, are all turned on. At this time, even if any one of the turn-off thyristors TR1 and TR2 is first turned on and the cathode terminal becomes −1.5V, the potential of the terminal ϕR maintains "L" (−3.3V) by the current limiting resistors RR1 and RR2. Accordingly, the turn-off thyristors TR1 and TR2 are all turned on.

Then, the potentials of the gate terminals Gtr1 and GTr2 of the turn-off thyristors TR1 and TR2 become 0V, and the potential of the turn-on signal lines 75-1 and 75-2 becomes "H" (0V).

Accordingly, all the potentials of the anode terminals and the cathode terminals of the light emitting thyristors L1 and L2 become "H" (0V), and thus the light emitting thyristors L1 and L2 are turned off.

Accordingly, the gate terminal Gt1 of the light emitting thyristor L1 and the gate terminal Gt2 of the light emitting thyristor L2 are unable to maintain "H" (0V). Since the transmission thyristor T1, the setting thyristor S1, and the setting thyristor S2 are in an off state, the gate terminals G11, G12, Gs1, Gs2, and Gt1 become the power potential Vga("L" (−3.3V)). Accordingly, the respective threshold voltages of the light emitting thyristors L1 and L2, the setting thyristors S1 and S2, and the transmission thyristor T1 become −4.8V.

That is, the light emitting thyristor L1 of the light emitting chip Ca1 is turned on (emits light) in the timing when the setting signal ϕWo1 at time e is shifted from "H" to "L", and is turned off (emits no light) in the timing when the turn-off signal ϕRa at time o is shifted from "L" to "H". The period from time e to time o corresponds to the turn-on (lighting) period of the light emitting thyristor L1 of the light emitting chip Ca1.

Further, the light emitting thyristor L2 of the light emitting chip Ca1 is turned on (emits light) in the timing when the setting signal ϕWe1 at time e is shifted from "H" to "L", and is turned off (emits no light) in the timing when the turn-off signal ϕRa at time o is shifted from "L" to "H". The period from time e to time o corresponds to the turn-on (lighting) period of the light emitting thyristor L1 of the light emitting chip Ca1.

Just after time o, the transmission thyristor T2 and the turn-off thyristors TR1 and TR2 are in an on state.

<Light Emitting Chip Cb1>

If the enabling signal ϕEb that is transmitted to the light emitting chip group #b is shifted from "L" (−3.3V) to "H" (0V), in the same manner as at time h in the light emitting chip Ca1, the potential of the enabling signal line 76 becomes 0V, and the potential of the gate terminals Gte1 and Gte2 of the setting enabling thyristors TE1 and TE2 becomes 0V. Further, the threshold voltage of the setting enabling thyristors TE1 and TE2 becomes −1.5V.

Just after time o, the transmission thyristor T1 is in an on state, and thus the light emitting thyristors L1 and L2 are turned on (emit light).

In this case, in this exemplary embodiment, at time o, the turn-off signal ϕRa that is transmitted to the light emitting chip group #a is shifted from "L" to "H", and the enabling signal ϕb that is transmitted to the light emitting chip group #b is shifted from "L" to "H". However, it is not required to simultaneously perform the shifting, and any one of them may be first performed.

(16) Time p

At time p, the turn-off signal ϕRa that is transmitted to the light emitting chip group #a is shifted from "L" (−3.3V) to "H" (0V).

<Light Emitting Chip Ca1>

Since all the potentials of the anode terminals and the cathode terminals of the turn-off thyristors TR1 and TR2 become "H" (0V), the turn-off thyristors TR1 and TR2 are turned off. Then, the potential of the gate terminals Gtr1 and Gtr2 does not become 0V, and the potential of the turn-on signal lines 75-1 and 75-2 becomes the power potential Vga ("L" (−3.3V)).

From time p, the turn-on control period Ta(2) of the light emitting thyristor L2 comes in.

Since the first transmission signal $\phi 1a$ and the second transmission signal $\phi 2a$ are changed in a period that includes the periods Ta(1) and Ta(2), their signal waveforms differ from each other, but the operation of the light emitting chip Ca1 becomes the repetition of the period Ta(1) from time c to time p. Accordingly, in the period Ta(2), the explanation of the operation of the light emitting chip Ca1 will be omitted except for the explanation of the first transmission signal $\phi 1a$, the second transmission signal $\phi 2a$, and the transmission thyristor T related to the signals.

At time p, the transmission thyristor T2 is in an on state.

<Light Emitting Chip Cb1>

Since the signal that is transmitted to the light emitting chip group #b, to which the light emitting chip Cb1 belongs, is not changed, the state just after time o is maintained.

(17) Time q

At time q, the enabling signal ϕEa that is transmitted to the light emitting chip group #a is shifted from "L" (−3.3V) to "H" (0V). Further, the turn-off signal ϕRb that is transmitted to the light emitting chip group #b is shifted from "H" (0V) to "L" (−3.3V).

<Light Emitting Chip Ca1>

Since the operation is the same as that at time h, the description thereof will be omitted.

Just after time q, the transmission thyristor T2 is in an on state, and thus the light emitting thyristors L3 and L4 are turned on (emit light).

<Light Emitting Chip Cb1>

In the same manner as the operation of the light emitting chip Ca1 at time o, if the turn-off signal ϕRb is shifted from "H" (0V) to "L" (−3.3V), all the cathode terminals and the anode terminals of the on-state light emitting thyristors L1 and L2 become "H", and the light emitting thyristors L1 and L2 are turned off.

That is, the light emitting thyristor L1 of the light emitting chip Cb1 is turned on (emits light) in the timing when the setting signal ϕWo1 at time k is shifted from "H" to "L", and is turned off (emits no light) in the timing when the turn-off signal ϕRb at time q is shifted from "L" to "H". The period from time k to time q corresponds to the turn-on (lighting) period of the light emitting thyristor L1 of the light emitting chip Cb1.

The light emitting thyristor L2 of the light emitting chip Cb1 is turned on (emits light) in the timing when the setting signal ϕWe1 at time k is shifted from "H" to "L", and is turned off (emits no light) in the timing when the turn-off signal ϕRb at time q is shifted from "L" to "H". The period from time k to time q corresponds to the turn-on (lighting) period of the light emitting thyristor L2 of the light emitting chip Cb1.

Just after time q, the transmission thyristor T2 and the turn-off thyristors TR1 and TR2 are in an on state.

(18) Time r

At time r, the turn-off signal ϕRb that is transmitted to the light emitting chip group #b is shifted from "L" (−3.3V) to "H" (0V).

<Light Emitting Chip Ca1>

Since the signal that is transmitted to the light emitting chip group #a, to which the light emitting chip Ca1 belongs, is not changed, the state just after time q is maintained.

<Light Emitting Chip Cb1>

In the same manner as the operation at time p in the light emitting chip Ca1, the on-state turn-of thyristors TR1 and TR2 are turned off. Further, the potential of the turn-on signal lines 75-1 and 75-2 becomes the power potential Vga ("L" (−3.3V)). Since the threshold voltage of any light emitting thyristor L is lower than −3.3V, the light emitting thyristor L is not turned on.

Just after time r, the transmission thyristor T2 is in an on state.

At time r, the period Tb(1) for controlling the light emitting thyristor L1 of the light emitting chip group #b is terminated.

(19) Time s

At time s, the first transmission signal ϕ1*a* that is transmitted to the light emitting chip group #a to which the light emitting chip Ca1 belongs is shifted from "H" (0V) to "L" (−3.3V).

<Light Emitting Chip Ca1>

The transmission thyristor T3, the threshold voltage of which is −3V, is turned on. Accordingly, the gate terminal Gt3 becomes "H" (0V). Further, the potential of the gate terminal Gt4 becomes −1.5V, and the threshold voltage of the transmission thyristor T4 becomes −3V.

Just after time s, the transmission thyristors T2 and T3 are in an on state, and thus the light emitting thyristors L3 and L4 are turned on (emit light).

<Light Emitting Chip Cb1>

Since the signal that is transmitted to the light emitting chip group #b, to which the light emitting chip Cb1 belongs, is not changed, no state change occurs.

Just after time s, the transmission thyristor T2 is in an on state, and thus the light emitting thyristor L3 is turned on (emits light). In this case, the light emitting thyristor L4 maintains a turn-off state. This will be described later.

(20) Time t

At time t, the second transmission signal ϕ2*a* that is transmitted to the light emitting chip group #a, to which the light emitting chip Ca1 belongs, is shifted from "L" (−3.3V) to "H" (0V).

<Light Emitting Chip Ca1>

Since all the cathode terminal and the anode terminal become "H", the on-state transmission thyristor T2 is turned off.

Just after time t, the transmission thyristor T3 is in an on state, and thus the light emitting thyristors L3 and L4 are turned on (emit light).

<Light Emitting Chip Cb1>

Since the signal that is transmitted to the light emitting chip group #b, to which the light emitting chip Cb1 belongs, is not changed, no state change occurs.

Just after time t, the transmission thyristor T2 is in an on state, and thus the light emitting thyristor L3 is turned on (emits light).

(21) Others

At time u, the period Ta(2) for controlling the light emitting thyristors L3 and L4 of the light emitting chip Ca1 is terminated. At time v, the period Tb(2) for controlling the light emitting thyristors L3 and L4 of the light emitting chip Cb1 is terminated. At time w, the period Ta(3) for controlling the light emitting thyristors L5 and L6 of the light emitting chip Ca1 is terminated. At time x, the period Tb(3) for controlling the light emitting thyristors L5 and L6 of the light emitting chip Cb1 is terminated. Further, at time y, the period Ta(4) for controlling the light emitting thyristors L7 and L8 of the light emitting chip Ca1 is terminated. Hereinafter, in the same manner, the turn-on control of all the light emitting thyristors L of the light emitting chip C is performed.

The operations of the light emitting chips C as described above will be collectively described.

First, the operation of the transmission thyristor T will be described.

In the first exemplary embodiment, in the light emitting chip C, the on state of the transmission thyristor T is shifted in order by two-phase transmission signals (the first transmission signal ϕ1 and the second transmission signal ϕ2).

That is, if the one of the two-phase transmission signals becomes "L" (−3.3V), the transmission thyristor $T_n$ having the number n, to which the one transmission signal is transmitted through the cathode terminal, is in an on state, and its gate terminal $Gt_n$ becomes "H" (0V). The potential of the gate terminal $Gt_{n+1}$ of the adjacent transmission thyristor $T_{n+1}$, which is connected to the gate terminal $Gt_n$ that becomes "H" (0V) through a forward-biased coupling diode $D_n$ becomes −1.5V. Accordingly, the transmission thyristor $T_{n+1}$ is turned on in the timing when the threshold voltage is increased (in this exemplary embodiment, from −4.5V to −3V), and the other transmission signal becomes "L" (−3.3V).

That is, by transmitting the two-phase transmission signals (the first transmission signal ϕ1 and the second transmission signal ϕ2) with their phases shifted so that their periods of "L" (−3.3V) overlap each other (the period from time m to time n in FIG. 7), the transmission thyristors T are set in a sequentially on state.

Further, if the transmission thyristor $T_n$ is in an on state and the gate terminal $Gt_n$ becomes "H" (0V), the potentials of the gate terminal $Gs_{2n-1}$ of the setting thyristor $S_{2n-1}$, which is connected to the gate terminal $Gt_n$ through the connection resistor Rx, and the gate terminal $Gs_{2n}$ of the setting thyristor $S_{2n}$ become −0.27V, and the threshold voltages of the setting thyristor $S_{2n-1}$ and the setting thyristor $S_{2n}$ become −1.77V.

Further, if the setting signals φWo (setting signals φWo1 to φWo20) and φWe (setting signals φWe1 to φWe20) are "L" in the period in which the enabling signal φE is "L" (−3.3V), the potential of the setting signal lines 74-1 and 74-2 becomes "L" (−3.3V), and thus the setting thyristors $S_{2n-1}$ and $S_{2n}$ are turned on.

If the setting thyristors $S_{2n-1}$ and $S_{2n}$ are turned on and the potential of the gate terminals $Gl_{2n-1}$ and $Gl_{2n}$ becomes 0V, the potential of the gate terminals $Gs_{2n-1}$ and $Gs_{2n}$ connected through the connection resistor Ry becomes −0.39V, and the threshold voltage of the light emitting thyristors $L_{2n-1}$ and $L_{2n}$ becomes −1.89V.

In this case, since the turn-on signal lines 75-1 and 75-2 become the power potential Vga ("L" (−3.3V)), the light emitting thyristors $L_{2n-1}$ and $L_{2n}$, the threshold voltage of which is −1.89V, are turned on (emit light).

That is, in the first exemplary embodiment, two light emitting thyristors L may be simultaneously turned on for each light emitting chip C. This is performed in the light emitting chip C by connecting two pairs of the setting thyristor S and the light emitting thyristor L to one transmission thyristor T and transmitting the setting signal φWo that turns on the odd-numbered light emitting thyristor $L_{2n-1}$ and the setting signal φWe that turns on the even-numbered light emitting thyristor $L_{2n}$.

If the turn-off signals φRa and φRb are shifted from "H" to "L" when the light emitting thyristors $L_{2n-1}$ and $L_{2n}$ are in an on state, the turn-off thyristors TR1 and TR2 are turned on.

Then, the potentials of the gate terminals Gtr1 and Gtr2 of the turn-off thyristors TR1 and TR2 become "H" (0V), and the potentials of the turn-on signal lines 75-1 and 75-2 become "H" (0V). Accordingly, the on-state light emitting thyristors $L_{2n-1}$ and $L_{2n}$ are turned off.

That is, the turn-on period in which the light emitting thyristor L is turned on (emits light) is a period from the timing (time) when the setting signals φWo (setting signals φWo1 to φWo20) and φWe (setting signals φWe1 to φWe20) become "L" to the time when the turn-off signals φRa and φRb are shifted from "H" to "L" (for example, from time e to time o in FIG. 7).

Next, a case where the light emitting thyristor L is not turned on will be described.

In the case where the light emitting thyristor $L_{2n-1}$ or $L_{2n}$ is not turned on, the setting signals φWo (setting signals φWo1 to φWo20) or φWe (setting signals φWe1 to φWe20) are maintained "H" (0V) at the time (timing) (for example, at time e) when the shifting is performed from "H" to "L". Accordingly, the setting thyristor $S_{2n-1}$ or $S_{2n}$ is not turned on, and the gate terminal $Gl_{2n-1}$ or $Gl_{2n}$ maintains the voltage of −2.48V. Accordingly, the light emitting thyristor $L_{2n-1}$ or $L_{2n}$ is not turned on since the threshold voltage is −3.98V.

At this time, by maintaining the setting signals φWo (setting signals φWo1 to φWo20) and φWe (setting signals φWe1 to φWe20) as "H" (0V) at the above-described time, both the light emitting thyristors $L_{2n-1}$ and $L_{2n}$ may be turned off.

As described above, the turn-on control of the light emitting thyristors L of the light emitting chip C may be individually performed.

In the case where the light emitting thyristor $L_{2n-1}$ or $L_{2n}$ is not turned on, the turn-on signal line 75-1 or the turn-on signal line 75-2 is not shifted to −1.5V, but is maintained as the power potential Vga ("L" (−3.3V)). Because of this, the threshold voltage of the turn-off thyristor TR1 or the turn-off thyristor TR2 becomes −4.8V.

Accordingly, even if the turn-off signal φR is shifted from "H" (0V) to "L" (−3.3V), the turn-off thyristor TR1 or the turn-off thyristor TR2 is not turned on (for example, time in FIG. 7). However, since the light emitting thyristor $L_{2n-1}$ or $L_{2n}$ is not turned on, it is not required to turn on the turn-off thyristor TR1 or the turn-off thyristor TR2.

The above-described operation is performed in the same manner even when both the light emitting thyristors $L_{2n-1}$ and $L_{2n}$ are not turned on.

Further, the operation of the setting enabling thyristors TE1 and TE2 will be described.

The enabling signal φE is supplied to the gate terminals Gte1 and Gte2 of the setting enabling thyristors TE1 and TE2 through the enabling signal line 76, and if the enabling signal φE is "L" (−3.3V), all the threshold voltages of the setting enabling thyristors TE1 and TE2 become −4.8V. Because of this, even if the setting signals φWe (setting signals φWo1 to φWo20) and/or the setting signals φWe (setting signals φWe1 to φWe20) become "L" (−3.3V), the setting enabling thyristors TE1 and TE2 are not turned on, but the setting thyristor $S_{2n-1}$ and/or setting thyristor $S_{2n}$ are turned on.

On the other hand, if the enabling signal φE is "H" (0V), the potentials of the gate terminals Gte1 and Gte2 of the setting enabling thyristors TE1 and TE2 become 0V, and all the threshold voltages thereof become −1.5V. Because of this, if the setting signals φWo (setting signals φWo1 to φWo20) and/or the setting signals φWe (setting signals φWe1 to φWe20) become "L" (−3.3V), the setting enabling thyristors TE1 and TE2 are turned on. Accordingly, the setting thyristor $S_{2n-1}$ and/or setting thyristor $S_{2n}$ are turned on. Accordingly, the setting thyristor $S_{2n-1}$ and/or the setting thyristor $S_{2n}$ are unable to be turned on, the threshold voltage of which is −1.77V that is lower than −1.5V.

That is, if the enabling signals φE (enabling signals φEa and φEb) are "L", the setting enabling thyristors TE1 and TE2 are turned off to enable the light emitting chip C to be turned on, while if the enabling signals φE (enabling signals φEa and φEb) are "H", the setting enabling thyristors TE1 and TE2 are turned on to obstruct the turn-on of the light emitting chip C. Accordingly, the enabling signals φE (enabling signals φEa and φEb) act as enable signals for controlling the turn-on of the light emitting chip C.

Further, the turn-on control of the light emitting chip Ca of the light emitting chip group #a and the light emitting chip, Cb of the light emitting chip group #b will be described.

In the first exemplary embodiment, in the case of turning on (lighting) all the light emitting thyristors L of the respective light emitting chips C with respect to a light emitting chip set that is composed of the light emitting chip C that belongs to the light emitting chip group #a and the light emitting chip C that belongs to the light emitting chip group #b, two periods in which the setting signals φW (the setting signals φWo (φWo1 to φWo20) and the setting signals φWe (φWe1 to φWe20)), which are transmitted in common, become "L" are set (a period from time e to time f and a period from time k to time l in FIG. 7). The front period of "L" sets the start of turn-on with respect to the light emitting chips C of the light emitting chip group #a, and the rear period of "L" sets the start of turn-on with respect to the light emitting chips C of the light emitting chip group #b.

In this exemplary embodiment, the phases of the transmission signals (first transmission signals φ1*a* and φ1*b* and second transmission signals φ2*a* and φ2*b*), the enabling signals φE (enabling signals φEa and φEb), and the turn-off signals φR (turn-off signals φRa and φRb), which are transmitted from the light emitting chip group #a and the light emitting chip group #b, are shifted by 180°. Accordingly, the width (margin) of the periods for setting two "L" periods, which are respectively installed in the setting signals φW (the setting signals φWo (φWo1 to φWo20) and the setting signals φWe (φWe1 to φWe20)), is maximized.

That is, since the phase is shifted by 180°, the two "L" periods, which are installed in the setting signals φW (the setting signals φWo (+Wo1 to φWo20) and the setting signals φWe (φWe1 to φWe20)), may be installed in the first half and the latter half of the period T.

In this case, if the setting signals φW (the setting signals φWo (φWo1 to φWo20) and the setting signals φWe (φWe1 to φWe20)) become "L" when the enabling signals φE (enabling signals φEa and φEb) are "L", the light emitting thyristors L are turned on.

Accordingly, it is sufficient if the period of "L" of the enabling signal φEa that is transmitted to the light emitting chip C of the light emitting chip group #a overlaps the period of "L" of the setting signals φWo (φWo1 to φWo20) and the setting signals φWe (φWe1 to φWe20) that are transmitted to the light emitting chip C, but does not overlap the period of "L" of the setting signals φWo (φWo1 to φWo20) and the setting signals φWe (φWe1 to φWe20) that are transmitted to the light emitting chip C of the light emitting chip group #b. The enabling signal φEb is the same.

On the other hand, the amount of light emission performed by the light emitting thyristor L may differ between the light emitting chips C and between the light emitting thyristors due to variations of the manufacturing conditions or the like. Due to this, the light emission amount of the light emitting thyristor L is corrected (light quantity correction). The light quantity correction method may be a method that adjusts current flowing to the light emitting thyristor L or a method that adjusts the turn-on period of the light emitting thyristor L.

As described above, the turn-on period of the light emitting thyristor L is a period from time when the setting signal φW is shifted to "L" to turn on the light emitting thyristor L to time when the turn-off signal φR is shifted from "L" to "H" to turn off the light emitting thyristor L. In this exemplary embodiment, a method of correcting the light quantity through adjustment of the turn-on start time is used.

In FIG. 7, it is exemplified that time (timing) when the setting signals φWo (φWo1 to φWo20) and the setting signals φWe (φWe1 to φWe20) are "L" is set to be equal (for example, time d or time k in FIG. 7). However, in the respective periods T, the light quantity may be corrected by adjusting the time (timing) in which the setting signals φWo (φWo1 to φWo20) and the setting signals φWe (φWe1 to φWe20) are shifted from "H" to "L".

In the first exemplary embodiment, the wording "simultaneous turn-on" includes not only a state where the turn-on starts at the same time but also a case where turn-on periods partially overlap each other.

In the light emitting chip C according to the first exemplary embodiment, it is sufficient if the number of transmission thyristors T is ½ of the number of light emitting thyristors L in comparison to the light emitting chip C according to a second exemplary embodiment to be described below. Accordingly, it is possible to lower the power for driving the transmission thyristors T.

Further, in the light emitting chip C according to the first exemplary embodiment, the setting enabling thyristors TE1 and TE2 and the turn-off thyristors TR1 And TR2 may be arranged on either side of left and right on the substrate 80 of the light emitting chip C.

In the light emitting chip C according to the first exemplary embodiment, the turn-on control of the adjacent light emitting thyristors L (for example, the light emitting thyristor L1 and the light emitting thyristor L2) may be simultaneously performed. Since the positions of the light emitting thyristor L1 and the light emitting thyristor L2 are close to each other on the substrate 80, the light emitting thyristors L have the approximate characteristics. Accordingly, the light emitting thyristor L1 and the light emitting thyristor L2 may use the same light quantity correction data, and thus it is possible to reduce the size of a memory for maintaining the light quantity correction data.

In the first exemplary embodiment, a maximum of two light emitting thyristors L may be simultaneously turned on for each light emitting chip C. However, by making three or more pairs of the setting thyristor S and the light emitting thyristor L for each transmission thyristor T, three or more light emitting thyristors L may be simultaneously turned on (emit light).

As described above, in this exemplary embodiment, since a plurality of light emitting thyristors L may be simultaneously turned on within the same light emitting chip C, for example, it is possible to suppress the light emitting current by increasing the light emission time that is allocated to the respective light emitting thyristors L instead of reducing the time that is required for one line in the main scanning direction (X-axis direction in FIGS. 3 and 4) or reducing the time required for one main scanning line.

Second Exemplary Embodiment

In the second exemplary embodiment, the configuration of the light emitting chip C is different from that according to the first exemplary embodiment. Accordingly, the configuration of the light emitting chip C, the configuration of the signal generation circuit 110, and the wire configuration on the circuit board 62 are different from those according to a third exemplary embodiment.

Figures 8A, 8B:
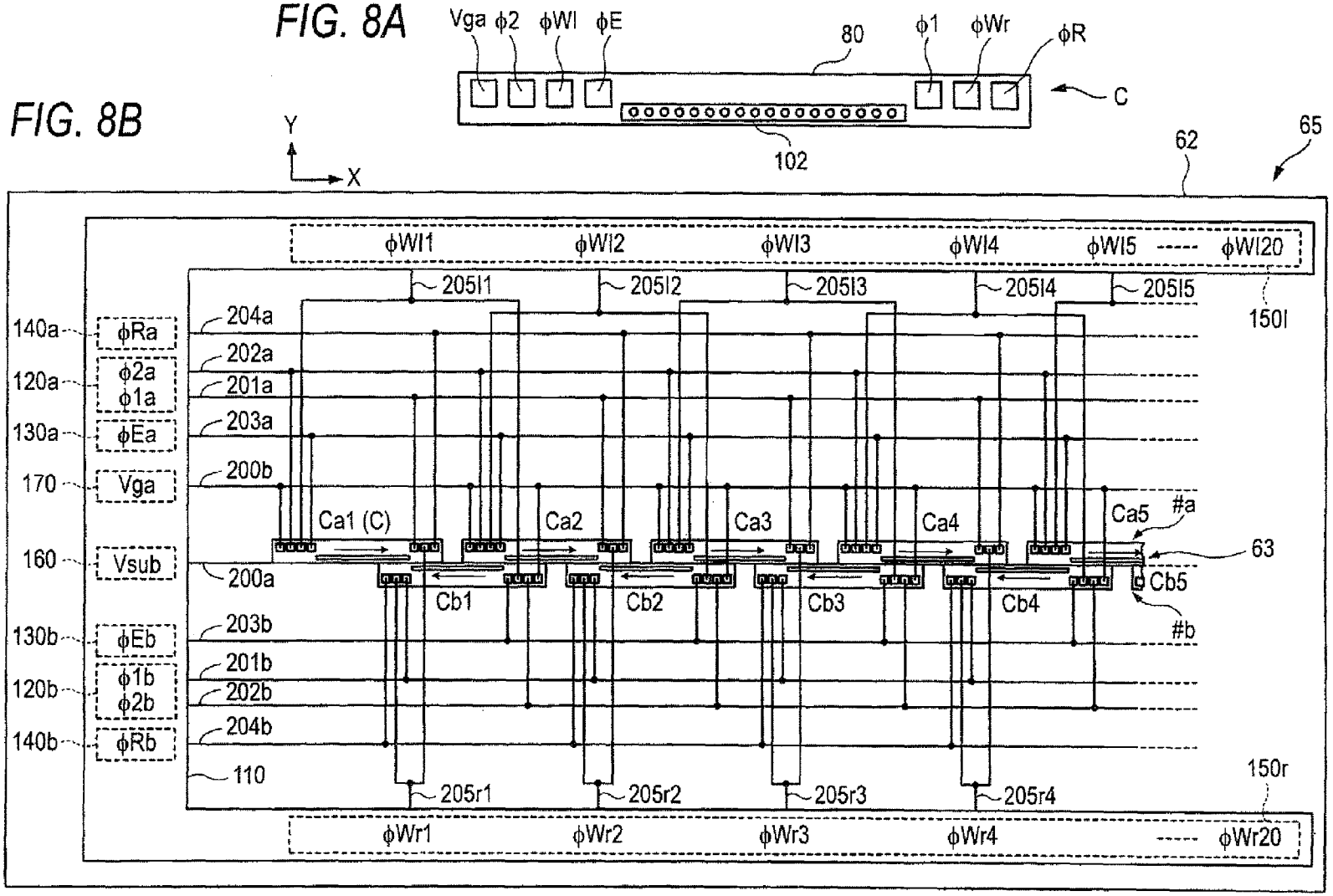
FIGS. 8A and 8B are diagrams illustrating the configuration of a light emitting chip, the configuration of a signal generation circuit, and the wire configuration on a circuit board according to a second exemplary embodiment.

FIGS. 8A and 8B are diagrams illustrating the configuration of a light emitting chip C, the configuration of a signal generation circuit 110, and the wire configuration on a circuit board 62 according to a second exemplary embodiment. FIG. 8A shows the configuration of the light emitting chip C, and FIG. 8B shows the configuration of the signal generation circuit 110 of the light emitting apparatus 65, and the wire configuration on the circuit board 62. In this exemplary embodiment, the light emitting chip C is divided into two light emitting chip groups #a and #b.

In the light emitting chip C according to the second exemplary embodiment of FIG. 8A, the terminal φWo in FIG. 4A is replaced by a terminal φWl, and the terminal φWe is replaced by a terminal φWr.

Further, in the circuit board 62 according to the second exemplary embodiment of FIG. 8B, the setting signal generation unit 150*o* in FIG. 4B is replaced by a setting signal generation unit 1501, the setting signals φWo1 to φWo20 are replaced by setting signals φW11 to φW120, and the setting signal lines 205*o*1 to 205*o*20 are replaced by setting signal lines 205/1 to 205/20.

In the same manner, in the circuit board 62 according to the second exemplary embodiment of FIG. 8B, the setting signal generation unit 150*e* in FIG. 4B is replaced by a setting signal generation unit 150*r*, the setting signals φWe1 to φWe20 are replaced by setting signals φWr1 to φWr20, and the setting signal lines 205*e*1 to 205*e*20 are replaced by setting signal lines 205*r*1 to 205*r*20.

Since other configurations are the same as those according to the first exemplary embodiment, different configurations will be described, but description of the same configurations will be omitted.

Figure 9:
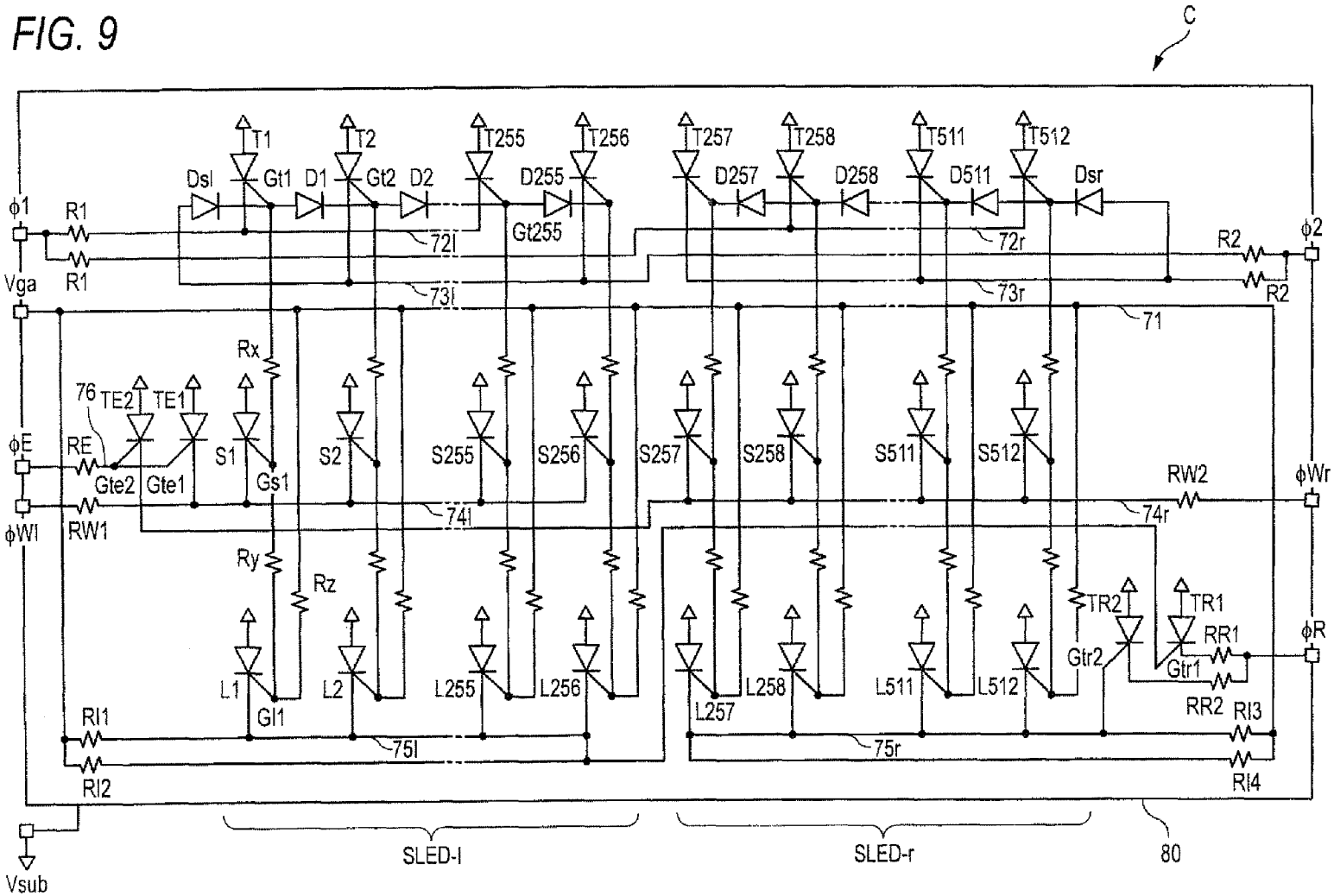
FIG. 9 is an equivalent circuit diagram illustrating the circuit configuration of a light emitting chip that is a self-scanning light emitting device (SLED) chip according to a second exemplary embodiment.

FIG. 9 is an equivalent circuit diagram illustrating the circuit configuration of a light emitting chip C that is a self-scanning light emitting device (SLED) chip according to a second exemplary embodiment.

The light emitting chip C according to the second exemplary embodiment includes transmission thyristors T1 to T256, setting thyristors S1 to S256, an SLED-1 including light emitting thyristors L1 to S256, transmission thyristors T257 to T512, setting thyristors S257 to S512, and an SLED-r including light emitting thyristors L257 to L512. That is, total 512 light emitting thyristors L are divided into left and right sides.

Further, the number of transmission thyristors T is 512, unlike 256 transmission thyristors T according to the first exemplary embodiment. Accordingly, the number of coupling diodes D is 511. Further, the start diode Ds is replaced by a start diode Ds1, and a new start diode Dsr is added. Further, the light emitting chip C includes two current limiting resistors R1 and two current limiting resistors R2.

Next, the connection relationship between the respective devices will be described.

Cathode terminals of the odd-numbered transmission thyristors T1, T3, . . . , T255 are connected to a first transmission signal line 721, and cathode terminals of the even-numbered thyristors T2, T4, . . . , T256 are connected to a second transmission signal line 731.

In the same manner, cathode terminals of the odd-numbered transmission thyristors T257, T259, . . . , T511 are connected to a first transmission signal line 72*r*, and cathode terminals of the even-numbered thyristors T258, T260, . . . , T512 are connected to a second transmission signal line 73*r*.

The first transmission signal line 721 and the first transmission signal line 72*r* are connected to a terminal ϕ1 through respective current limiting resistors R1. Further, the second transmission signal line 731 and the second transmission signal line 73*r* are connected to a terminal ϕ2 through the respective current limiting resistors R1.

Coupling diodes D1 to D255 are installed to be inserted between the respective gate terminals Gt of the transmission thyristors T1 to T256. Further, the coupling diode D1 is connected in a direction in which current flows from the gate terminal Gt1 of the transmission thyristor T1 to the gate terminal Gt2 of the transmission thyristor T2. Other coupling diodes D2 to D255 are the same.

Further, the cathode terminal of the start diode Ds1 is connected to the gate terminal Gt1, and the anode terminal thereof is connected to the second transmission signal line 731.

On the other hand, the coupling diodes D257 to D511 are installed to be inserted between the gate terminals Gt of the transmission thyristors T257 to T512. Further, the coupling diode D257 is connected in a direction in which current flows from the gate terminal Gt258 of the transmission thyristor T258 to the gate terminal Gt257 of the transmission thyristor T257. Other coupling diodes D258 to D511 are the same.

Further, the cathode terminal of the start diode Dsr is connected to the gate terminal Gt512, and the anode terminal thereof is connected to the second transmission signal line 73*r*.

Cathode terminals of the setting thyristors 81 to 8256 and cathode terminals of the setting enabling thyristors TE1 are connected to a setting signal line 741. The setting signal line 741 is connected to the terminal ϕW1 through the current limiting resistor RW1.

Cathode terminals of the setting thyristors S257 to S512 and cathode terminals of the setting enabling thyristors TE2 are connected to a setting signal line 74*r*. The setting signal line 74*r* is connected to the terminal ϕWr through the current limiting resistor RW2.

Cathode terminals of the light emitting thyristors L1 to L256 and a gate terminal Gtr1 of the turn-off thyristor TR1 are connected to the turn-on signal line 751. The turn-on signal line 751 is configured to have a "U" shape so that it connects in order from the cathode terminal of the light emitting thyristor L1 to the cathode terminal of the light emitting thyristor L256, and then returns to the light emitting thyristor L1 (return line). Accordingly, the resistance value of the turn-on signal line 751 is reduced. Further, both end portions of the "U" shape of the turn-on signal line 751 are connected to the power line 71 through the respective current limiting resistors R11 and R12.

In the same manner, cathode terminals of the light emitting thyristors L257 to L512 and a gate terminal Gtr2 of the turn-off thyristor TR2 are connected to the turn-on signal line 75*r*. The turn-on signal line 75*r* is configured to have a "U" shape so that it connects in reverse order from the cathode terminal of the light emitting thyristor L512 to the cathode terminal of the light emitting thyristor L257, and then returns to the light emitting thyristor L512 (return line). Accordingly, the resistance value of the turn-on signal line 75*r* is reduced. Further, both end portions of the "U" shape of the turn-on signal line 75*r* are connected to the power line 71 through the respective current limiting resistors R13 and R14.

Further, the gate terminal Gt of the transmission thyristor T is connected to the gate terminal Gs of the setting thyristor S through the connection resistor Rx, and the gate terminal Gs of the setting thyristor S is connected to the gate terminal G1 of the light emitting thyristor L. Further, the gate terminal G1 is connected to the power line 71 through the connection resistor Rz.

That is, in the light emitting chip C that does not use this exemplary embodiment, one setting thyristor S and one light emitting thyristor L are connected for one transmission thyristor T.

This light emitting chip C is configured in the same manner as described according to the first exemplary embodiment.

Figure 10:
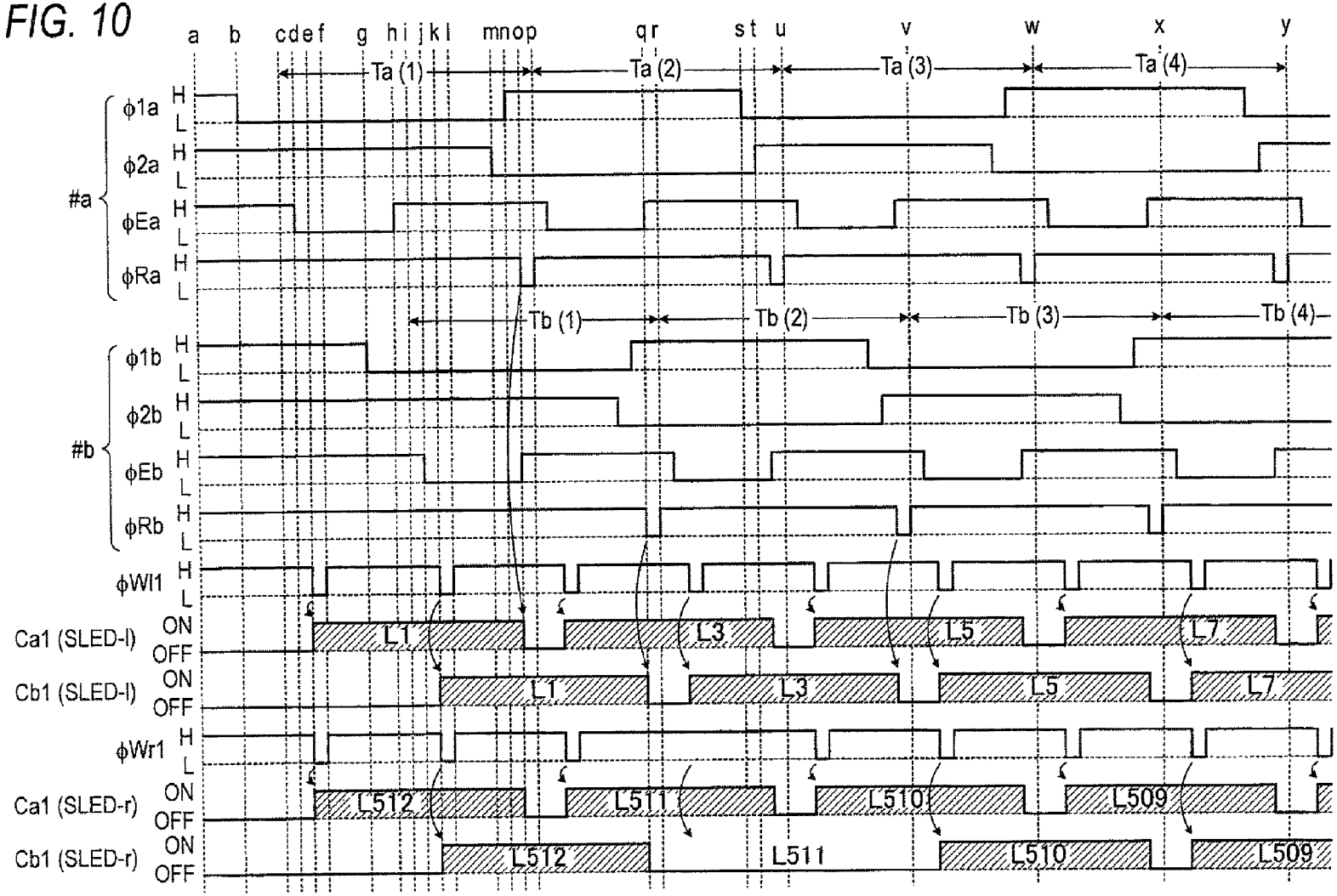
FIG. 10 is a timing chart illustrating an operation of a light emitting chip of a light emitting apparatus according to a second exemplary embodiment.

FIG. 10 is a timing chart illustrating an operation of a light emitting chip C of a light emitting apparatus 65 according to a second exemplary embodiment. Ca1(odd) in the timing chart of FIG. 7 is replaced by Ca1(SLED-1), and Ca1(even) is replaced by Ca1(SLED-r). Further, the light emitting chip Cb1 is the same.

In the second exemplary embodiment, the light emitting thyristor L of SLED-1 and the light emitting thyristor L of SLED-r constitute a light emitting device group, and one light emitting thyristor L of the light emitting device group, that is, one light emitting thyristor L of the SLED-1, and one light emitting thyristor L of the SLED-r form a pair so that the turn-on control thereof is performed.

In the light emitting chip C according to the second exemplary embodiment, as may be seen from FIG. 9, the turn-on control of two light emitting thyristors L are performed in order from both ends of the light emitting thyristors L toward the inside. That is, in the period Ta(1), the turn-on control of the light emitting thyristor L1 and the light emitting thyristor L512 of the light emitting chip Ca1 is performed, and in the period Ta(2), the turn-on control of the light emitting thyristor L2 and the light emitting thyristor L511 of the light emitting chip Ca1 is performed. The same operation is performed in other periods T and in other light emitting chips Cb1. Further, the light emitting chips Ca2 to Ca20 that belong to the light emitting chip group #a and the light emitting chips Cb2 to Cb20 that belong to the light emitting chip group #b are the same.

As described above, even in the light emitting chip C according to the second exemplary embodiment, a maximum of two light emitting thyristors L may be simultaneously turned on (emit light) for each light emitting chip C.

Since the operation of the light emitting apparatus 65 and the light emitting chips Ca and Cb is the same as that as described in the first exemplary embodiment, the explanation thereof will be omitted.

In this exemplary embodiment, the turn-on control of the light emitting thyristors L is performed from both end portions of the light emitting thyristor column. By changing the connection direction of the coupling diodes D and the arrangement of the start diodes Ds1 and Dsr to the center portion of the light emitting thyristor column, the turn-on control may be performed from the center portion.

Here, the first exemplary embodiment and the second exemplary embodiment are compared with each other.

In the light emitting chip C according to the second exemplary embodiment, as illustrated in FIG. 9, the first transmission signal line 72*r* that is connected to the transmission thyristor T of the SLED-r is wired to cross the portion of SLED-1, and the second transmission signal line 731 that is connected to the transmission thyristor T of the SLED-1 is wired to cross the portion of SLED-r.

In the same manner, the setting signal line 74*r* that is connected to the setting thyristor S of the SLED-r is wired to cross the portion of the SLED-1.

Further, the turn-on signal line 751 that is connected to the gate terminal Gtr1 of the turn-off thyristor TR1 is wired to cross the portion of the SLED-r.

That is, in the light emitting chip C according to the second exemplary embodiment, non-connected wires are installed in the portion of the SLED-1 or in the portion of the SLED-r.

By contrast, in the light emitting chip C according to the first exemplary embodiment, as illustrated in FIG. 5, non-connected wire is not provided.

Accordingly, in the light emitting chip C according to the first exemplary embodiment, the number of wires that cross the substrate 80 is reduced by two, and thus the width of the substrate 80 may be narrowed in comparison to the light emitting chip C according to the second exemplary embodiment.

Even in the second exemplary embodiment, a maximum of two light emitting thyristors L may be simultaneously turned on for each light emitting chip C. However, by making the number of SLED (SLED-1 and SLED-r) exceed two, three or more light emitting thyristors L may be simultaneously turned on (emit light).

Third Exemplary Embodiment

In the third exemplary embodiment, the circuit configuration of the light emitting chip C that is the self-scanning light emitting device (SLED) chip is different from that according to the first exemplary embodiment. Accordingly, the timing chart is different. Since other configurations are the same as those according to the first exemplary embodiment, different portions will be described, but the description of the same portions will be omitted.

Figure 11:
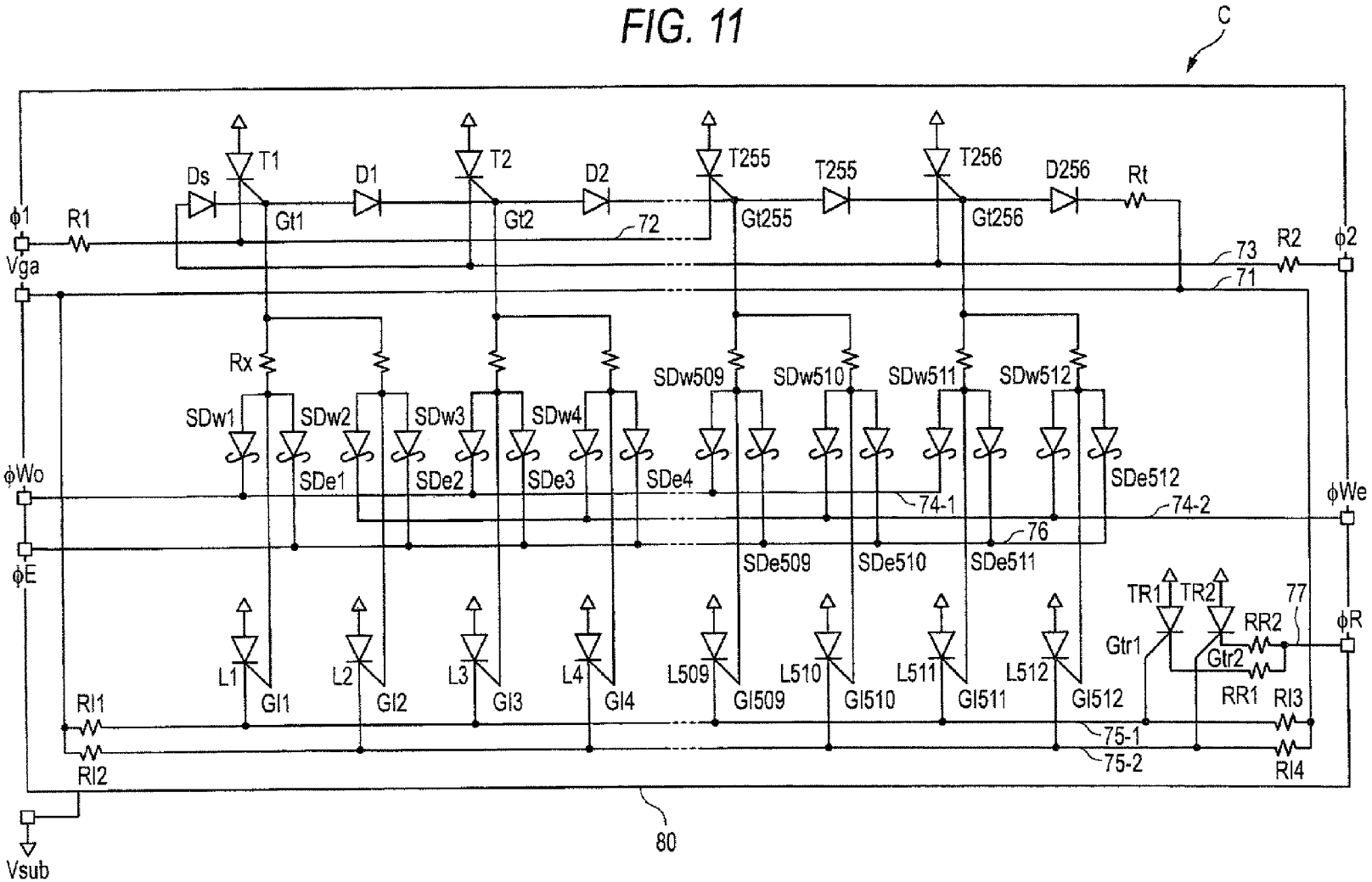
FIG. 11 is an equivalent circuit diagram illustrating the circuit configuration of a light emitting chip that is a self-scanning light emitting device (SLED) chip according to a third exemplary embodiment.

FIG. 11 is an equivalent circuit diagram illustrating the circuit configuration of a light emitting chip that is a self-scanning light emitting device (SLED) chip according to a third exemplary embodiment.

In the light emitting chip C according to the third exemplary embodiment, instead of the setting thyristors S1, S2, S3, . . . in the light emitting chip C according to the first exemplary embodiment, setting Schottky diodes SDw1, SDw2, SDw3, are installed as an example of setting devices. Further, instead of the setting enabling thyristors TE1 and TE2, enabling Schottky diodes SDe1, SDe2, SDe3, . . . are installed as an example of enabling devices. Here, in the case where the setting Schottky diodes SDw1, SDw2, SDw3, . . . are not distinguished from one another, they are represented by setting Schottky diodes SDw. Further, in the case where the enabling Schottky diodes SDe1, SDe2, SDe3, . . . are not distinguished from one another, they are represented by enabling Schottky diodes SDe.

Further, in the light emitting chip C according to the third exemplary embodiment, the connection resistors Ry and Rz in the light emitting chip C according to the first exemplary embodiment are not installed.

Further, in the light emitting chip C according to the third exemplary embodiment, the setting enabling thyristors TE1 and TE2 and the current limiting resistors RE, RW1, and RW2 in the light emitting chip C according to the first exemplary embodiment are not installed.

Next, the connection relationship between the respective devices will be described.

The gate terminal Gt1 of the transmission thyristor T1 is connected to the anode terminal of the enabling Schottky diode SDe1, the anode terminal of the setting Schottky diode SDw1, and the gate terminal G11 of the light emitting thyristor L1 through the connection resistor Rx. Further, the gate terminal Gt1 of the transmission thyristor T1 is connected to the anode terminal of the enabling Schottky diode SDe2, the anode terminal of the setting Schottky diode SDw2, and the gate terminal G12 of the light emitting thyristor L2 through another connection resistor Rx. Other transmission thyristors T are the same.

That is, if it is assumed that one enabling Schottky diode SDe, one setting Schottky diode SDw, and one light emitting thyristor L, which are connected through one connection resistor RX, form a pair, the gate terminal Gt of one transmission thyristor T is connected to an enabling Schottky diode SDe, a setting Schottky diode SDw, and a light emitting thyristor L, which form two pairs.

Cathode terminals of the odd-numbered setting Schottky diodes SDw1, SDw3, . . . are connected to the setting signal line 74-1. The setting signal line 74-1 is connected to the terminal ϕWe. Cathode terminals of the even-numbered setting Schottky diodes SDw2, SDw4, . . . are connected to the setting signal line 74-2. The setting signal line 74-2 is connected to the terminal ϕWo.

Cathode terminals of the enabling Schottky diodes SDe1, SDe2, SDe3, . . . are connected to the enabling signal line 76. The enabling signal line 76 is connected to the terminal ϕE.

The enabling Schottky diode SDe and the setting Schottky diode SDw are diodes using Schottky junction (barrier), and the value of the forward potential Vs is relatively smaller than the value of the forward potential Vd of the pn junction. Here, explanation will be made on the assumption that the forward potential Vs of the Schottky junction is 0.5V.

In this case, the enabling Schottky diode SDe and the setting Schottky diode SDw in FIGS. 6A and 6B are formed by installing two Schottky electrodes for Schottky junction with respect to a p-type third semiconductor layer 83 on a portion on which an area 111 is present instead of an n-type fourth semiconductor layer 84 and an n-type ohmic electrode 122 in an area 112. The detailed description thereof will be omitted.

The light emitting chip C is configured in the same manner as describe above according to the first exemplary embodiment.

Here, the operation of the enabling Schottky diode SDe and the setting Schottky diode SDw will be described.

As described above according to the first exemplary embodiment, if the transmission thyristor T is turned on, the potential of the gate terminal Gt becomes 0V. Hereinafter, a case where the potential of the gate terminal Gt of the transmission thyristor T is 0V will be described.

If the setting signals ϕWe and ϕWo are "H" (0V), the potential of the setting signal lines 74-1 and 74-2 that are connected to the cathode terminal of the setting Schottky diode SDw becomes "H" (0V). Then, even if the gate terminal Gt of the transmission thyristor T is 0V, the setting Schottky diode SDw is not forward-biased. Accordingly, the potential of the anode terminal of the setting Schottky diode SDw is not affected by the setting signals ϕWe and ϕWo which are "H" (0V).

In this state, if the enabling signal ϕE is "L" (−3.3V), the enabling signal line 76 that is connected to the terminal ϕE to which the enabling signal ϕE is transmitted becomes "L" (−3.3V). If the potential of the gate terminal Gt of the transmission thyristor T is 0V, the enabling Schottky diode SDe is forward-biased. Further, the potential of the anode terminal of the enabling Schottky diode SDe (the gate terminal G1 of the light emitting thyristor L) becomes −2.8V that is obtained by subtracting the forward potential Vs (0.5V) of the Schottky junction from "L" (−3.3V). Accordingly, the threshold voltage of the light emitting thyristor L becomes −4.3V. Accordingly, even if the potential of the turn-on signal lines 75-1 and 75-2 becomes the power potential Vga ("L" (−3.3V)), the light emitting thyristor L is not turned on.

On the other hand, if the enabling signal ϕE is "H" (0V), the enabling Schottky diode SDe is not forward-biased when the gate terminal Gt of the transmission thyristor T is 0V. Accordingly, the potential of the gate terminal G1 of the light emitting thyristor L is not affected by the enabling signal ϕE that is "H" (0V), and becomes the potential of the gate terminal Gt of the transmission thyristor T.

That is, if the potential of the gate terminal Gt of the transmission thyristor T is 0V, the threshold voltage of the light emitting thyristor L becomes −1.5V in a state where the potential of the gate terminal G1 is 0V. Accordingly, if the potential of the turn-on signal lines 75-1 and 75-2 becomes the power potential Vga ("L" (−3.3V)), the light emitting thyristor L is turned on.

Further, if the setting signals ϕW (setting signals ϕWe and ϕWo) are "L" (−3.3V), the potential of the setting signal lines 74-1 and 74-2 that are connected to the cathode terminal of the setting Schottky diode SDw becomes "L" (−3.3V). Then, when the gate terminal Gt of the transmission thyristor T is 0V, the setting Schottky diode SDw is forward-biased. Accordingly, the potential of the anode terminal of the setting Schottky diode SDw (the gate terminal G1 of the light emitting thyristor L) becomes −2.8V. Accordingly, the threshold voltage of the light emitting thyristor L becomes −4.3V.

This state is the same even if the enabling signal ϕE is either "H" (0V) or "L" (−3.3V).

At this time, as illustrated in FIG. 11, since the enabling Schottky diode SDe and the setting Schottky diode SDw are symmetrically installed with respect to the gate terminal Gt, their roles may be exchanged with each other. That is, the enabling signal ϕE and the setting signals ϕW (setting signals ϕWe and ϕWo) may be replaced by each other.

As described above, when the enabling signal ϕE and the setting signals ϕW (setting signals ϕWe and ϕWo) are all "H" (0V), the light emitting thyristor L is turned on (emits light). At this time, if at least one side of the enabling signal ϕE and the setting signals ϕW (setting signals ϕWe and ϕWo) is "L" (−3.3V), the light emitting thyristor L is not turned on.

As described above, the enabling Schottky diode SDe operates in the same manner as the setting enabling thyristors TE1 and TE2 in the light emitting chip C according to the first exemplary embodiment. At this time, the setting Schottky diode SDw operates in the same manner as the setting thyristor S in the light emitting chip C according to the first exemplary embodiment.

However, the enabling signal E and the setting signals ϕW (setting signals ϕWe and ϕWo) according to the third exemplary embodiment have the relationship between "H" (0V) and "L" (−3.3V), which is reverse to that according to the first exemplary embodiment.

Figure 12:
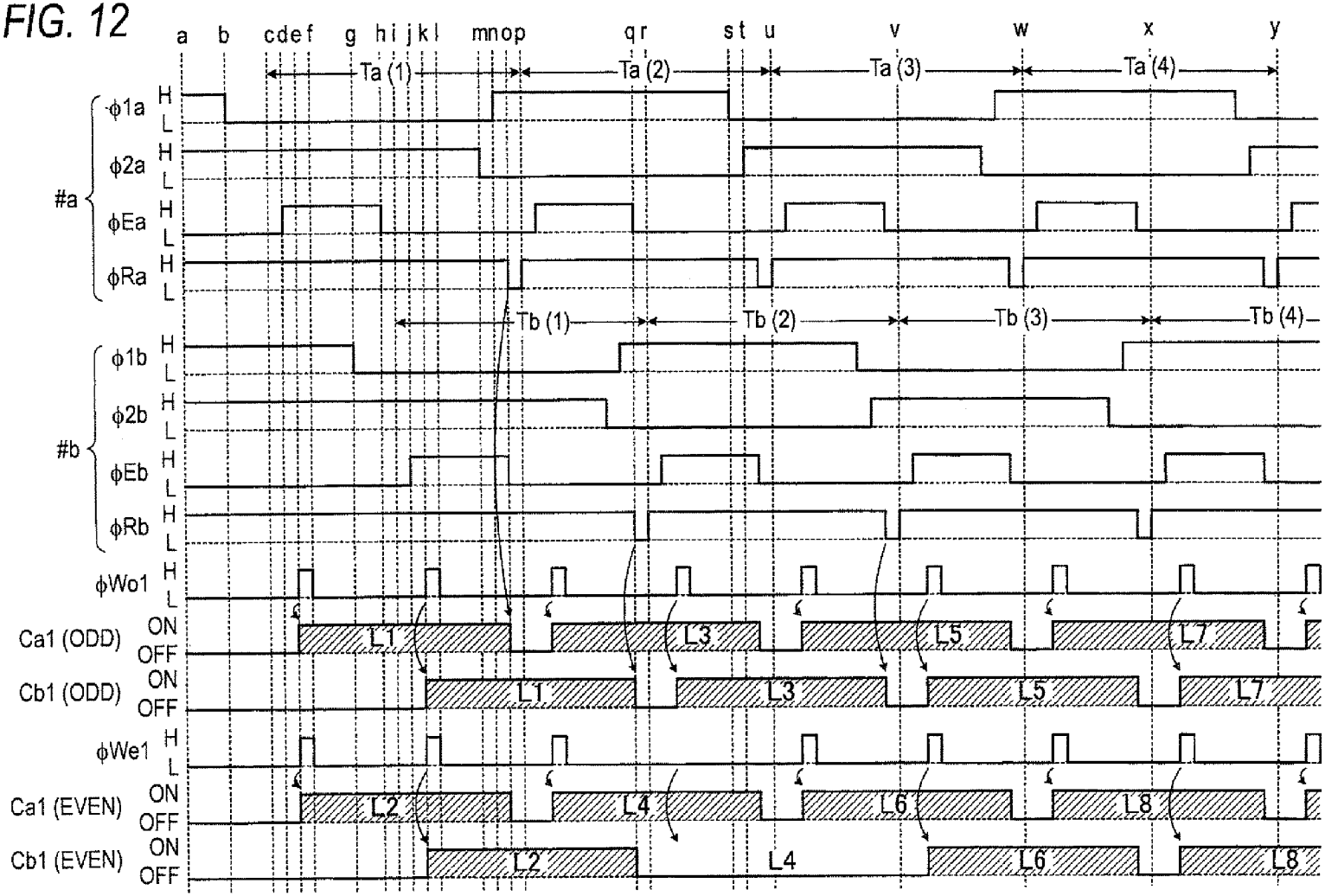
FIG. 12 is a timing chart illustrating an operation of a light emitting chip of a light emitting apparatus according to a third exemplary embodiment.

FIG. 12 is a timing chart illustrating an operation of the light emitting chip C of the light emitting apparatus 65 according to the third exemplary embodiment.

As described above, the enabling signals ϕEa and ϕEb and the setting signals ϕWe1 and ϕWo1 have the reversed relationship between "H" (0V) and "L" (−3.3V).

Accordingly, although the detailed description will be omitted, the light emitting chip C according to the second exemplary embodiment operates in the same manner as the light emitting chip C according to the first exemplary embodiment.

That is, in the third exemplary embodiment, an even-numbered light emitting thyristor L and an odd-numbered light emitting thyristor L form a light emitting device group, and each light emitting thyristor L of the light emitting device group, that is, one odd-numbered light emitting thyristor L and one even-numbered light emitting thyristor L are controlled to be turned on as a pair.

In the light emitting chip C according to the third exemplary embodiment, the setting enabling thyristors TE1 and TE2 and the connection resistors Ry and Rz, which are installed in the light emitting chip C according to the first exemplary embodiment, are not installed, and thus the size of the substrate 80 of the light emitting chip C is reduced.

Even in the third exemplary embodiment, a maximum of two light emitting thyristors L may be simultaneously turned on for each light emitting chip C. However, by providing three or more pairs of the setting Schottky diode SDw, the enabling Schottky diode She, and the light emitting thyristor L, which are connected for each transmission thyristor T, three or more light emitting thyristors L may be simultaneously turned on (emit light).

Fourth Exemplary Embodiment

In a fourth exemplary embodiment, the circuit configuration of the light emitting chip C is different from that according to the third exemplary embodiment.

Accordingly, the configuration of the light emitting chip C, the configuration of the signal generation circuit 110, and the wire configuration on the circuit board 62 are different from those according to the third exemplary embodiment.

Figures 13A, 13B:
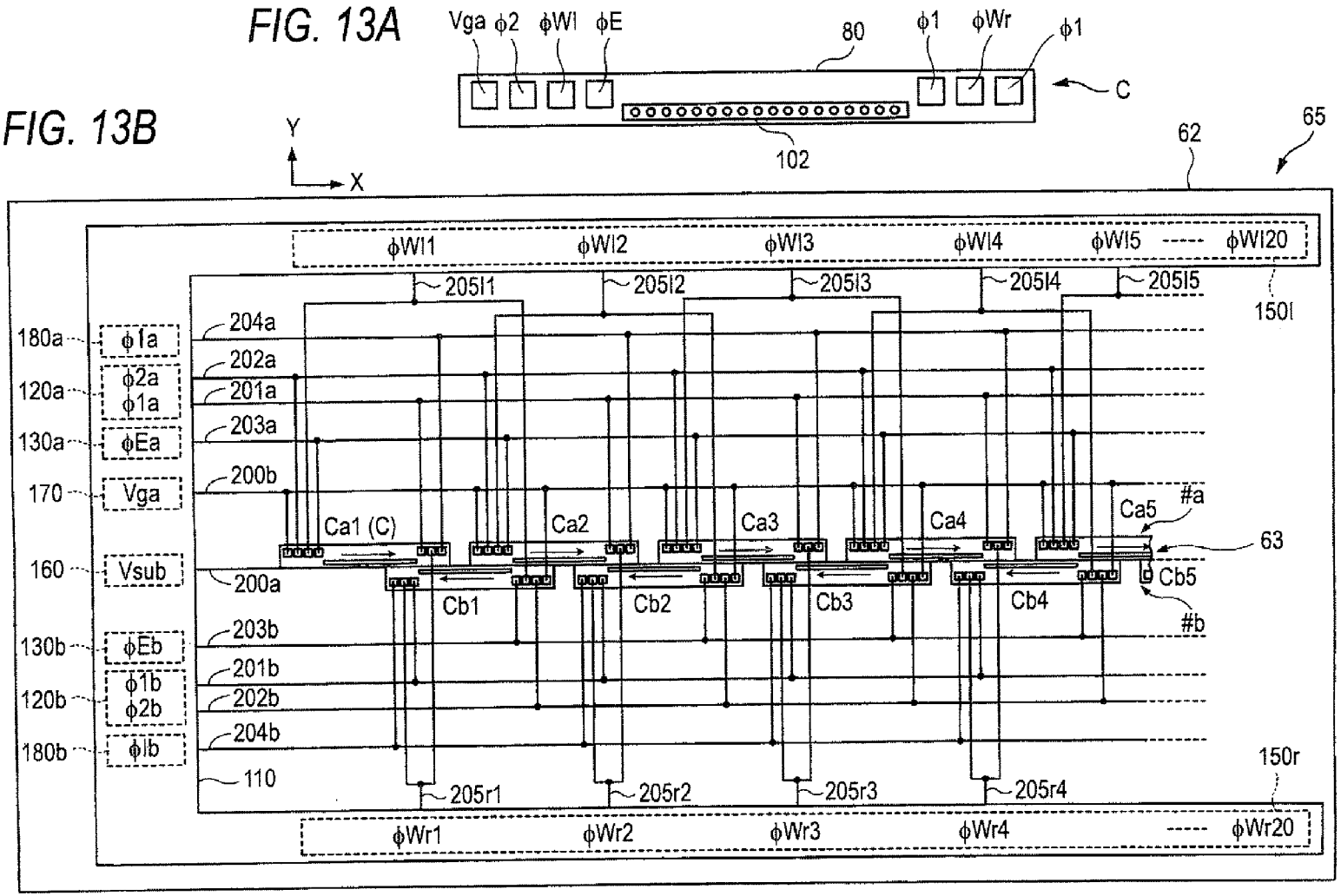
FIGS. 13A and 13B are diagrams illustrating the configuration of a light emitting chip, the configuration of a signal generation circuit, and the wire configuration on a circuit board according to a fourth exemplary embodiment.

FIGS. 13A and 13B are diagrams illustrating the configuration of a light emitting chip C, the configuration of a signal generation circuit 110, and the wire configuration on a circuit board 62 according to the fourth exemplary embodiment. FIG. 13A shows the configuration of the light emitting chip C, and FIG. 13B shows the configuration of the signal generation circuit 110 of the light emitting apparatus 65, and the wire configuration on the circuit board 62. In this exemplary embodiment, the light emitting chip C is divided into two light emitting chip groups #a and #b.

In the light emitting chip C according to the fourth exemplary embodiment of FIG. 13A, the terminal ϕWo of the light emitting chip C according to the first exemplary embodiment as illustrated in FIG. 4A is replaced by a terminal ϕW1, the terminal ϕWe is replaced by a terminal ϕWr, and the terminal ϕR is replaced by a terminal ϕ1.

Further, in the fourth exemplary embodiment of FIG. 13B, the setting signal generation unit 150*o* according to the first exemplary embodiment as illustrated in FIG. 43 is replaced by a setting signal generation unit 1501, the setting signals ϕWo1 to ϕWo20 are replaced by setting signals ϕW11 to ϕW120, and the setting signal lines 205*o*1 to 205*o*20 are replaced by setting signal lines 205/1 to 205/20. Further, the turn-off signal generation unit 140*a* is replaced by a turn-on signal generation unit 180*a*, and the turn-off signal ϕRa is replaced by a turn-on signal ϕ1*a*.

In the same manner, in the circuit board 62 according to the fourth exemplary embodiment of FIG. 133, the setting signal generation unit 150*e* according to the first exemplary embodiment as illustrated in FIG. 4B is replaced by a setting signal generation unit 150*r*, the setting signals ϕWe1 to ϕWe20 are replaced by setting signals ϕWr1 to ϕWr20, and the setting signal lines 205*e*1 to 205*e*20 are replaced by setting signal lines 205*r*1 to 205*r*20. Further, the turn-off signal generation unit 140*b* is replaced by a turn-on signal generation unit 180*b*, and the turn-off signal ϕRb is replaced by a turn-on signal ϕ1*b*.

Here, in the case where the turn-on signals ϕ1*a* and ϕ1*b* are not distinguished from each other, they are represented as turn-on signals ϕ1.

Since other configurations are the same as those according to the first exemplary embodiment, different configurations will be described, but description of the same configurations will be omitted.

The turn-on signal ϕ1 is an example of a turn-on control signal in the same manner as the turn-off signal ϕR according to the first and second exemplary embodiments.

Figure 14:
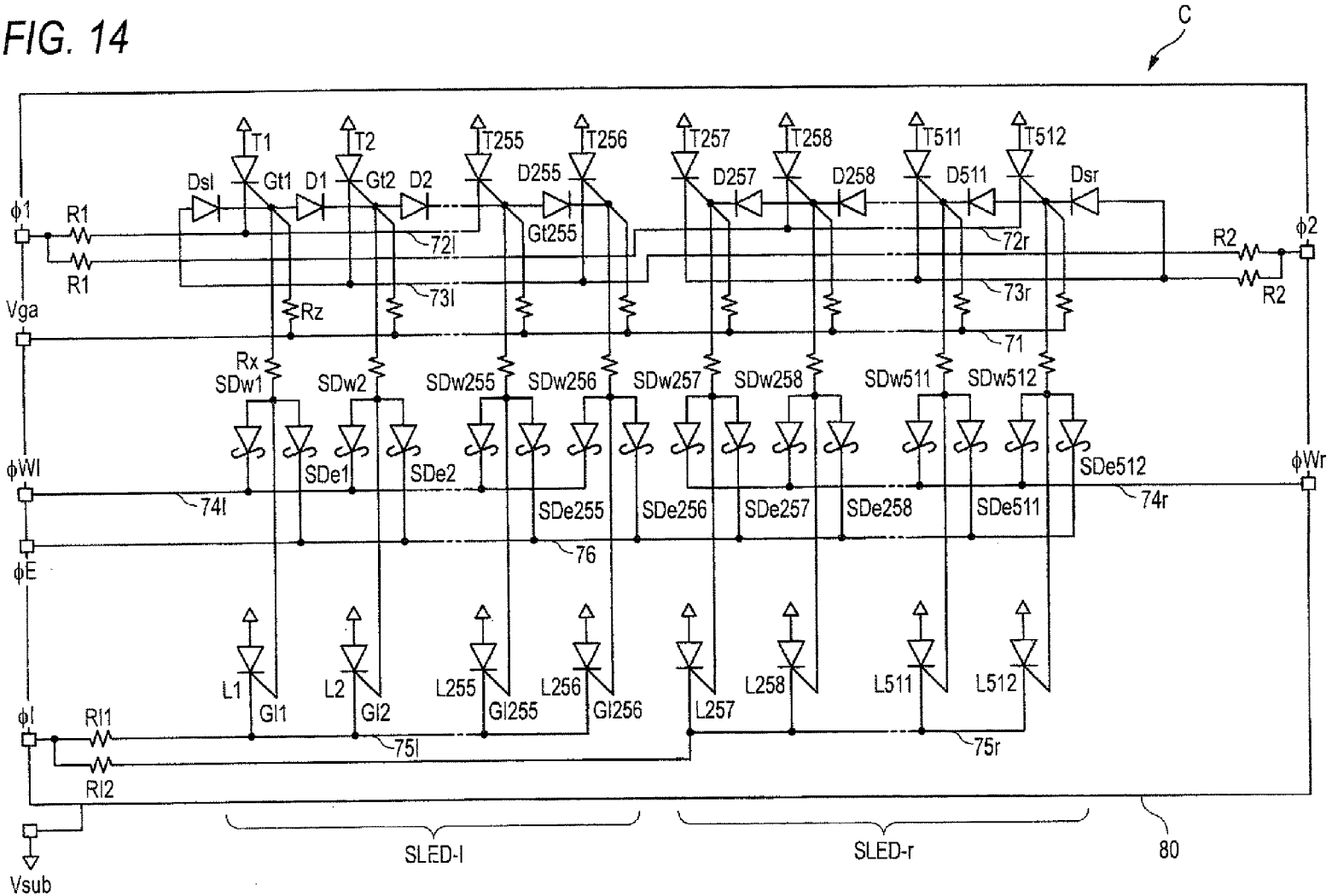
FIG. 14 is an equivalent circuit diagram illustrating the circuit configuration of a light emitting chip according to a fourth exemplary embodiment.

FIG. 14 is an equivalent circuit diagram illustrating the circuit configuration of a light emitting chip C according to the fourth exemplary embodiment.

The light emitting chip C according to the fourth exemplary embodiment includes transmission thyristors T1 to T256, enabling Schottky diodes SDe1 to SDe256, setting Schottky diodes SDw1 to SDw256, an SLED-1 including light emitting thyristors L1 to L256, transmission thyristors T257 to T512, enabling Schottky diodes SDe257 to SDe512, setting Schottky diodes SDw257 to SDw512, and an SLED-r including light emitting thyristors L257 to L512. That is, total 512 light emitting thyristors L are divided into left and right sides.

In the light emitting chip C according to the third exemplary embodiment, if it is assumed that one enabling Schottky diode SDw, one setting Schottky diode SDw, and one light emitting thyristor L form a pair, one transmission thyristor T is connected to the enabling Schottky diode SDe, the setting Schottky diode SDw, and the light emitting thyristor L, which form two pairs.

By contrast, in the light emitting chip C according to the fourth exemplary embodiment, one transmission thyristor T is connected to the enabling Schottky diode SDe, the setting Schottky diode SDw, and the light emitting thyristor L, which form one pair. This configuration is the same as that according to the second exemplary embodiment.

Accordingly, in the fourth exemplary embodiment, in the same manner as the second exemplary embodiment, the turn-on control of two light emitting thyristors L is performed in order from both ends of the light emitting thyristor L toward the inside.

Further, in the light emitting chip C according to the fourth exemplary embodiment, as illustrated in FIG. 14, the gate terminal Gt of the transmission thyristor T is connected to the power line 71 through the connection resistor Rz.

Further, cathode terminals of the light emitting thyristors L1 to L256 of the SLED-1 are connected to the turn-on signal line 75-1, and the turn-on signal line 75-1 is connected to the terminal ϕ1 through the current limiting resistor R11. In the same manner, cathode terminals of the light emitting thyristors L257 to L512 of the SLED-r are connected to the turn-on signal line 75-2, and the turn-on signal line 75-2 is connected to the terminal ϕ1 through the current limiting resistor R12.

At this time, the light emitting chip C according to the fourth exemplary embodiment is not provided with the turn-off thyristors TR1 and TR2 and the current limiting resistors RR1, RR2, R13, and R14 in the light emitting chip C according to the third exemplary embodiment as illustrated in FIG. 11.

Even this light emitting chip C is configured in the same manner as described according to the first exemplary embodiment.

In the light emitting chip C according to the fourth exemplary embodiment, the gate terminal Gt is connected to the power line 71 through the connection resistor Rz. Accordingly, when the transmission thyristor $T_n$ having the number n is in an on state, the potential of the gate terminal Gt is set to the power potential Vga ("L" (−3.3V)) except for the gate terminal $Gt_n$, the gate terminal $Gt_{n+1}$ of the transmission thyristor $T_{n+1}$, and the gate terminal $Gt_{n+2}$ of the transmission thyristor $T_{n+2}$, and thus the light emitting chip C operates more stably.

Figure 15:
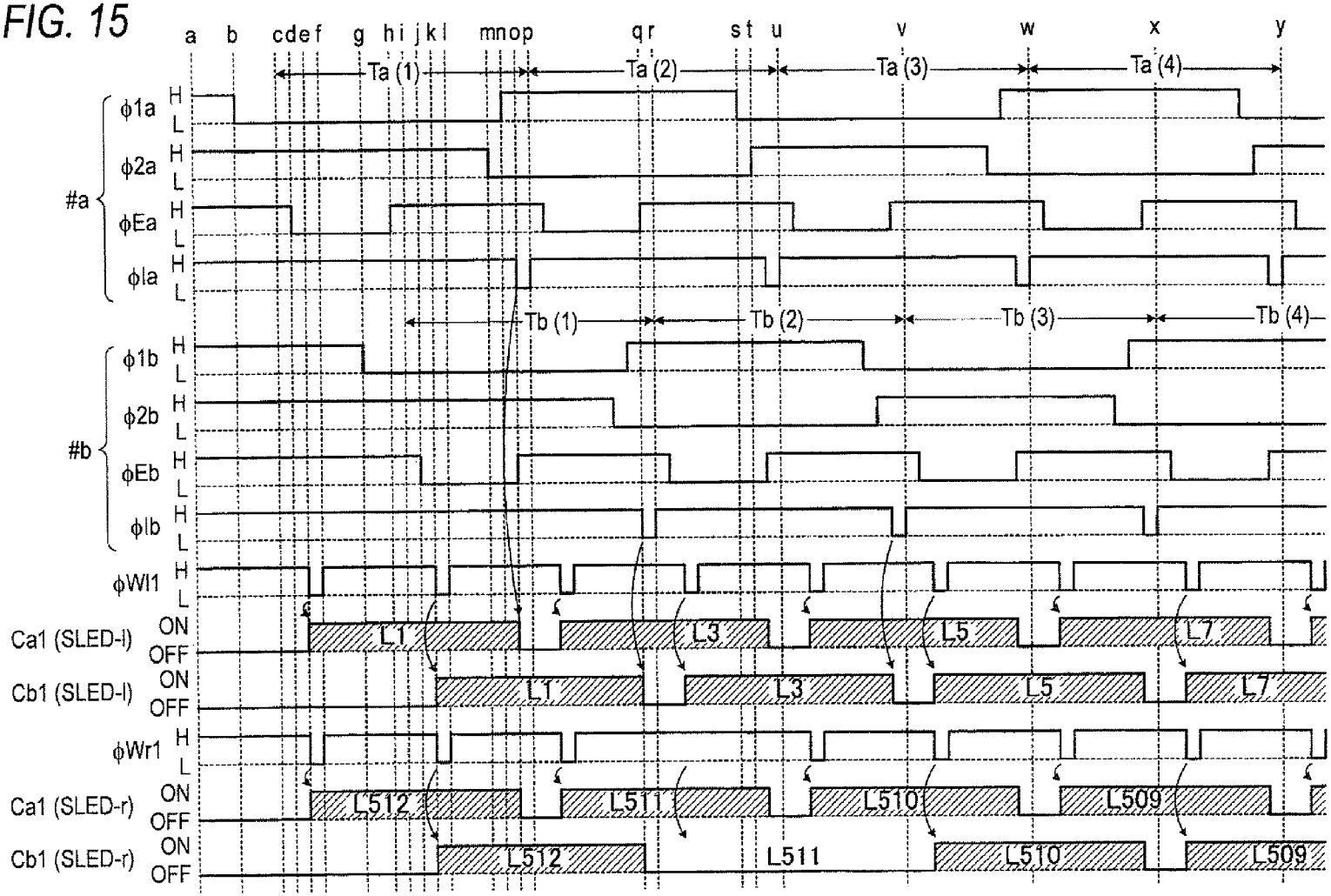
FIG. 15 is a timing chart illustrating an operation of a light emitting chip of a light emitting apparatus according to a fourth exemplary embodiment.

FIG. 15 is a timing chart illustrating an operation of a light emitting chip C of a light emitting apparatus 65 according to a fourth exemplary embodiment.

In the timing chart of FIG. 15, in comparison to the timing chart illustrating the operation of the light emitting chip C according to the third exemplary embodiment as illustrated in FIG. 12, the turn-off signal ϕRa is replaced by a turn-on signal ϕ1*a*, the turn-off signal ϕRb is replaced by a turn-on signal ϕ1*b*, and the light emitting chip Ca1(odd) is replaced by a light emitting chip Ca1(SLED-1). Further, the light emitting chip Cb1(odd) is replaced by a light emitting chip Cb1 (SLED-1), the light emitting chip Ca1(even) is replaced by Ca1(SLED-r), and the light emitting chip Cb1(even) is replaced by a light emitting chip Cb1(SLED-r).

In the fourth exemplary embodiment, the light emitting thyristor L of SLED-1 and the light emitting thyristor L of SLED-r constitute a light emitting device group, and one light emitting thyristor L of the light emitting device group, that is, one light emitting thyristor L of the SLED-1, and one light emitting thyristor L of the SLED-r form a pair so that the turn-on control thereof is performed.

The setting signals ϕW11 and ϕWr1 in the timing chart of FIG. 15 are equal to the setting signals ϕWo1 and ϕWe1 in the timing chart according to the third exemplary embodiment of FIG. 12.

On the other hand, the turn-on signals ϕ1*a* and ϕ1*b* in the timing chart of FIG. 15 have the relationship between "H" (0V) and "L" (−3.3V) that is reverse to that of the turn-off signals ϕRa and ϕRb in the timing chart according to the third exemplary embodiment of FIG. 12. In the fourth exemplary embodiment and the third exemplary embodiment, the potentials of the turn-on signal lines 75-1 and 75-2 are equal to each other.

That is, if the turn-on signal $\phi$1*a* is shifted from "H" (0V) to "L" (−3.3V) at time c, the potential of the turn-on signal line 75-1 is shifted from "H" (0V) to "L" (−3.3V). This corresponds to the same state as that in which the turn-on signal line 75-1 becomes "L" (−3.3V) at time c in FIG. 12 according to the third exemplary embodiment. In this case, the potentials of the turn-on signal line 75-1 between time a and time c are different from each other, but this does not affect the operation of the light emitting chip C.

Further, if the turn-on signal $\phi$1*a* is shifted from "L" (−3.3V) to "H" (0V) at time o, and the turn-on signal line 75-1 is shifted from "L" (−3.3V) to "H" (0V), the anode terminal and the cathode terminal of the on-state light emitting thyristor L1 become "H" (0V), and the light emitting thyristor L1 is turned off.

This corresponds to the case where at time o of FIG. 12 according to the third exemplary embodiment, the turn-off signal $\phi$Ra is shifted from "H" (0V) to "L" (−3.3V), and the turn-on signal line 75-1 is shifted from "L" (−3.3V) to "H" (0V).

Accordingly, the light emitting apparatus 65 and the light emitting chip C according to the fourth exemplary embodiment operates in the same manner as the light emitting apparatus 65 and the light emitting chip C according to the third exemplary embodiment.

That is, in one light emitting chip C, two light emitting thyristors L are simultaneously turned on (emit light).

Even in the fourth exemplary embodiment, a maximum of two light emitting thyristors L may be simultaneously turned on for each light emitting chip C. However, by making the number of SLED exceed two, three or more light emitting thyristors L may be simultaneously turned on (emit light).

Fifth Exemplary Embodiment

In a fifth exemplary embodiment, the circuit configuration of the light emitting chip C is different from that according to the fourth exemplary embodiment.

Accordingly, the configuration of the light emitting chip C, the configuration of the signal generation circuit 110, and the wire configuration on the circuit board 62 are different from those according to the third exemplary embodiment.

Figures 16A, 16B:
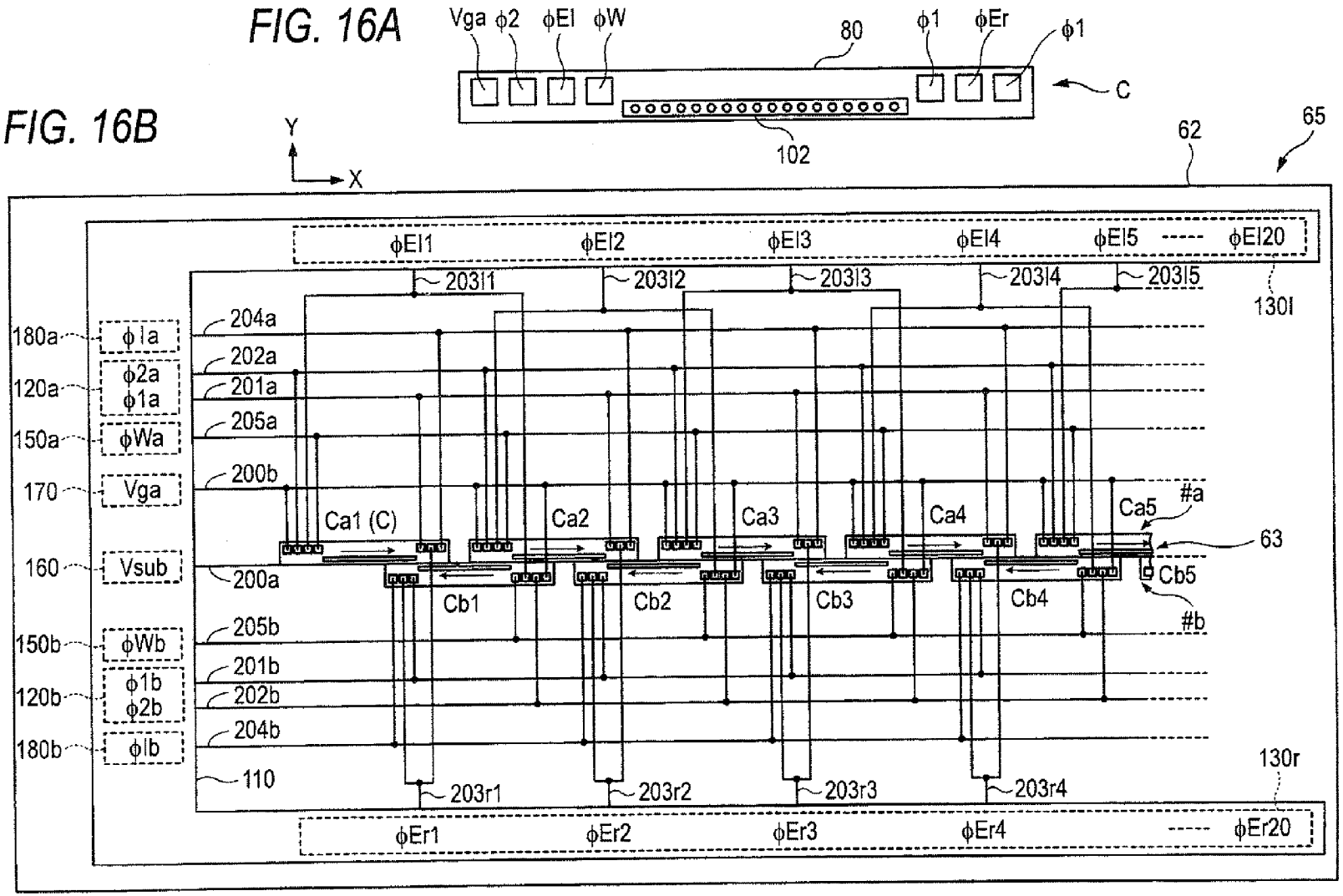
FIGS. 16A and 16B are diagrams illustrating the configuration of a light emitting chip, the configuration of a signal generation circuit, and the wire configuration on a circuit board according to a fifth exemplary embodiment.

FIGS. 16A and 16B are diagrams illustrating the configuration of a light emitting chip C, the configuration of a signal generation circuit 110, and the wire configuration on a circuit board 62 according to the fifth exemplary embodiment. FIG. 16A shows the configuration of the light emitting chip C, and FIG. 16B shows the configuration of the signal generation circuit 110 of the light emitting apparatus 65, and the wire configuration on the circuit board 62. Even in this exemplary embodiment, the light emitting chip C is divided into two light emitting chip groups #a and #b.

In the light emitting chip C according to the fifth exemplary embodiment of FIG. 16A, the terminal $\phi$W1 of the light emitting chip C according to the fourth exemplary embodiment as illustrated in FIG. 13A is replaced by a terminal $\phi$E1, the terminal $\phi$Wr is replaced by a terminal $\phi$Er, and the terminal $\phi$W is replaced by a terminal $\phi$E.

Further, in the fifth exemplary embodiment of FIG. 16B, the setting signal generation unit 150*o* according to the fourth exemplary embodiment as illustrated in FIG. 13B is replaced by an enabling signal generation unit 1301, the setting signals $\phi$Wo1 to $\phi$Wo20 are replaced by enabling signals $\phi$E11 to $\phi$E120, and the setting signal lines 205*o*1 to 205*o*20 are replaced by enabling signal lines 203/1 to 203/20. Further, the enabling signal generation unit 130*a* is replaced by a setting signal generation unit 150*a*, and the enabling signal $\phi$Ea is replaced by a setting signal $\phi$Wa.

In the same manner, in the fifth exemplary embodiment of FIG. 16B, the setting signal generation unit 150*e* according to the fourth exemplary embodiment as illustrated in FIG. 13B is replaced by an enabling signal generation unit 130*r*, the setting signals $\phi$We1 to $\phi$We20 are replaced by enabling signals $\phi$Er1 to $\phi$Er20, and the setting signal lines 205*e*1 to 205*e*20 are replaced by enabling signal lines 203*r*1 to 203*r*20. Further, the enabling signal generation unit 130*b* is replaced by a setting signal generation unit 150*b*, and the enabling signal $\phi$Eb is replaced by a setting signal $\phi$Wb.

Figure 17:
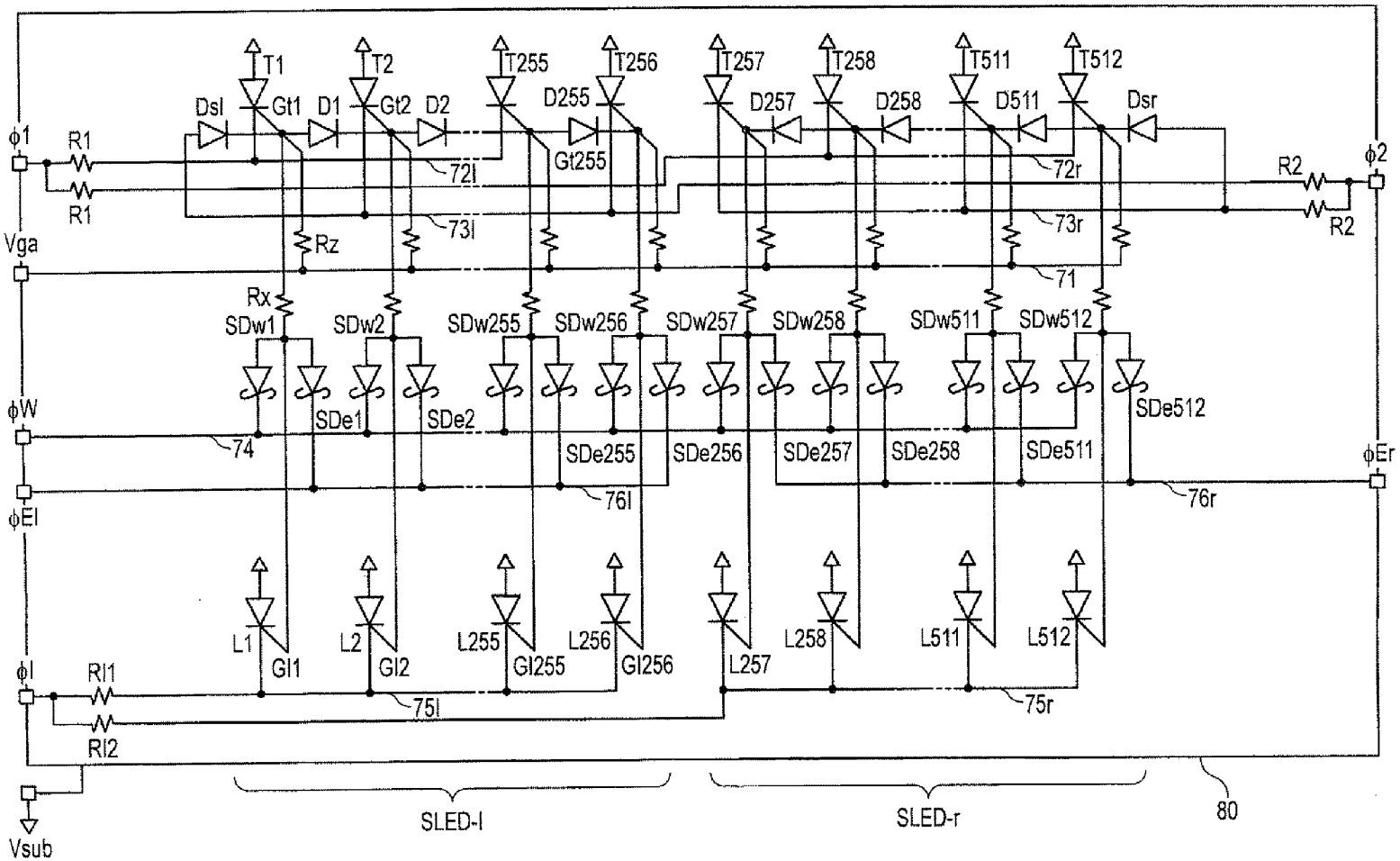
FIG. 17 is an equivalent circuit diagram illustrating the circuit configuration of a light emitting chip according to a fifth exemplary embodiment.

FIG. 17 is an equivalent circuit diagram illustrating the circuit configuration of a light emitting chip C according to the fifth exemplary embodiment.

In the light emitting chip C according to the fifth exemplary embodiment, the cathode terminal of the setting Schottky diode SDw is connected to the setting signal line 74. The setting signal line 74 is connected to the terminal $\phi$W. On the other hand, the cathode terminals of the enabling Schottky diodes SDe1 to SDe128 of the SLED-1 are connected to the enabling signal line 761. The enabling signal line 761 is connected to the terminal $\phi$E1. In the same manner, the cathode terminals of the enabling Schottky diodes SDe129 to SDe512 of the SLED-r are connected to the enabling signal line 76*r*. The enabling signal line 76*r* is connected to the terminal $\phi$Er.

This light emitting chip C is configured in the same manner as described in the first exemplary embodiment.

Figure 18:
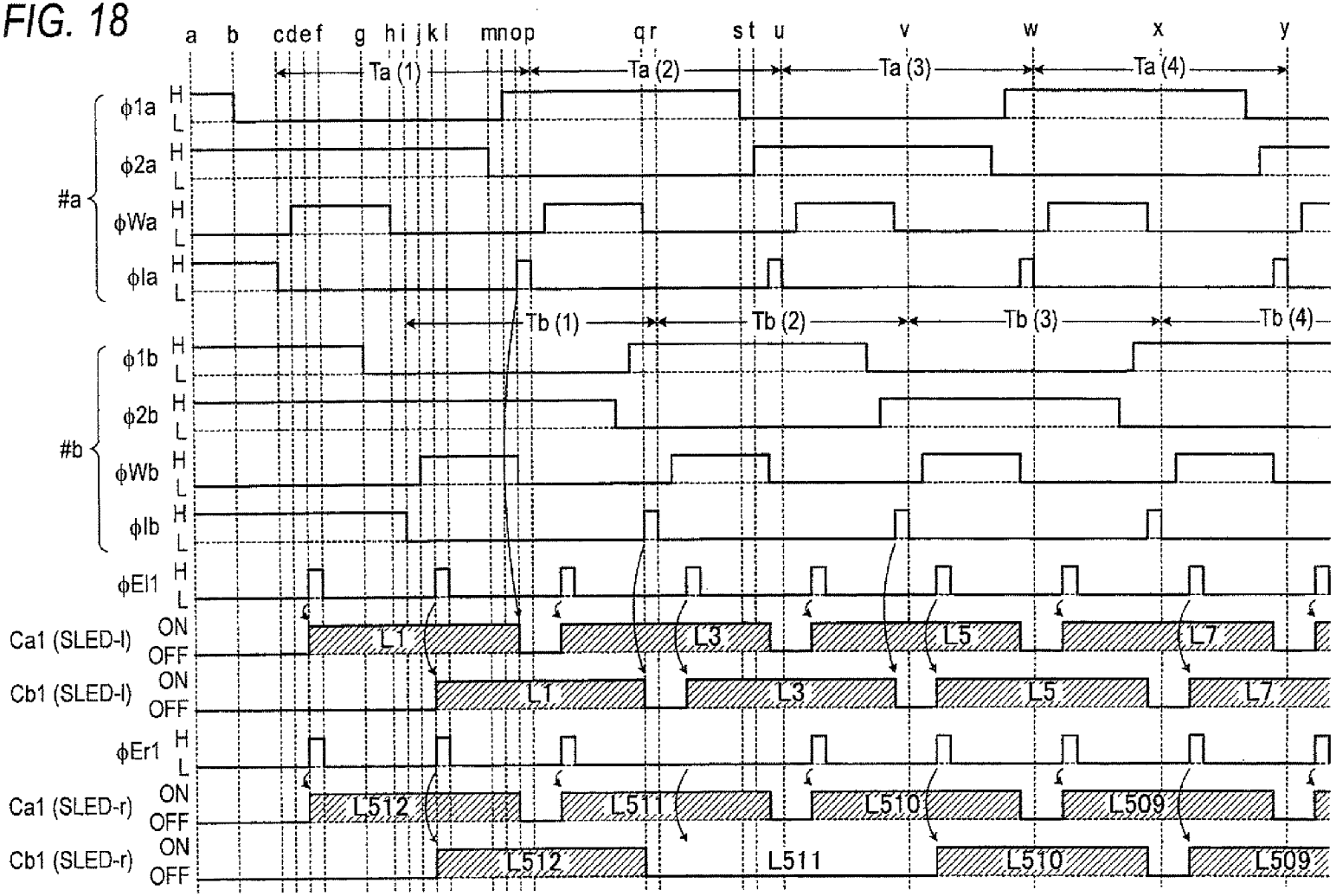
FIG. 18 is a timing chart illustrating an operation of a light emitting chip of a light emitting apparatus according to a fifth exemplary embodiment.

FIG. 18 is a timing chart illustrating an operation of a light emitting chip C according to a fifth exemplary embodiment.

In the timing chart of FIG. 18, in comparison to the timing chart according to the fourth exemplary embodiment as illustrated in FIG. 15, the enabling signal $\phi$Ea is replaced by a setting signal $\phi$Wa, the enabling signal $\phi$Eb is replaced by a setting signal $\phi$Wb, the setting signal $\phi$W11 is replaced by an enabling signal $\phi$E11, and the setting signal $\phi$Wr1 is replaced by an enabling signal $\phi$Er1.

That is, in the fifth exemplary embodiment, the functions of the enabling signal $\phi$E and the setting signal $\phi$W according to the fourth exemplary embodiment are performed in a reverse order. This is because, as described above in the third exemplary embodiment, in the case of using the enabling Schottky diode SDe and the setting Schottky diode SDw, the enabling signal $\phi$E and the setting signal $\phi$W may be replaced by each other. Further, in FIG. 17, the enabling Schottky diode SDe and the setting Schottky diode SDw are arranged in symmetric positions with respect to the gate terminal Gt to operate in the same manner. Accordingly, in the fifth exemplary embodiment, description of the detailed operation will be omitted.

Even in the fifth exemplary embodiment, a maximum of two light emitting thyristors L are simultaneously turned on for each light emitting chip C. However, even in the fifth exemplary embodiment, a maximum of two light emitting thyristors L are simultaneously turned on (emit light) for each light emitting chip C. However, by making the number of SLED exceed two, three or more light emitting thyristors L may be simultaneously turned on (emit light).

As described above according to the first exemplary embodiment, in the first exemplary embodiment to the fifth exemplary embodiment, the wording "simultaneous turn-on" includes not only a state where the turn-on starts at the same time but also a case where turn-on periods partially overlap each other. For example, by shifting the turn-on start time according to the difference in light emission amount of the respective light emitting thyristors L, the light emission time may be controlled to suppress the difference in light emission amount of the respective light emitting thyristors L.

In the first exemplary embodiment to the fifth exemplary embodiment, the power potential Vga may be set to a value that is different from "L" of the first transmission signals $\phi$1, the second transmission signal $\phi$2, the enabling signals $\phi$E (enabling signals $\phi$Ea and $\phi$Eb), or the setting signals $\phi$W (setting signals $\phi$Wo and $\phi$We).

In the first exemplary embodiment to the fifth exemplary embodiment, the transmission thyristor T operates in two phases of the first transmission signal $\phi$1 and the second transmission signal $\phi$2. However, the transmission thyristor T may operate through transmission of three-phase transmission signal for every three transmission thyristors. In the same manner, the transmission thyristor T may operate through transmission of four or more phase transmission signal.

Further, in the first exemplary embodiment to the fifth exemplary embodiment, the first transmission signal $\phi$1 and the second transmission signal $\phi$2 are divided for each group. However, they may be supplied in common to the respective groups through wires common to the respective groups without dividing the first transmission signal $\phi$1 and the second transmission signal $\phi$2 for each group.

Further, in the first exemplary embodiment to the fifth exemplary embodiment, resistors or coupling diodes D are used. However, it is sufficient if the electric unit is a unit in which potential change of one terminal side causes the potential change of the other terminal side.

Further, in the first exemplary embodiment to the fifth exemplary embodiment, the number of light emitting chips C that constitute the light emitting chip group is set to be equal to the number of light emitting chips C that constitute the light emitting chip set. However, they may be different from each other. Further, although the light emitting chips C that constitute the light emitting chip set belong to different light emitting chip groups, respectively, they may include the light emitting chips C that belong to the same light emitting chip group.

Further, in the first exemplary embodiment to the fifth exemplary embodiment, it is described that the anode terminals of the thyristors (the light emitting thyristor L, the transmission thyristor T, the setting thyristor S, the setting enabling thyristors TE1 and TE2, and the turn-off thyristors TR1 and TR2) are common on the substrate 80 (anode common). However, even in the cathode common in which the cathode terminals are common on the substrate 80, they may be used by changing the polarity of the circuit.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

DESCRIPTION OF REFERENCE NUMERALS AND SIGNS

1: image forming apparatus
10: image forming process unit
11: image forming unit
12: photoconductor drum
14: print head
30: image output control unit
40: image processing unit
62: circuit board
63: light source unit
64: rod lens array
65: light emitting apparatus
110: signal generation circuit
120 (120*a*, 120*b*): transmission signal generation unit
130 (130*a*, 130*b*): enabling signal generation unit
140 (140*a*, 140*b*): turn-off signal generation unit
150 (150*o*, 150*e*, 150*a*, 150*b*): setting signal generation unit
160: reference potential supply unit
170: power potential supply unit
180 (180*a*, 180*b*): turn-on signal generation unit
$\phi$1 ($\phi$1*a*, $\phi$1*b*): first transmission signal
$\phi$2 ($\phi$2*a*, $\phi$2*b*): second transmission signal
$\phi$E ($\phi$Ea, $\phi$Eb, $\phi$E1, $\phi$Er): enabling signal
$\phi$W ($\phi$Wo1 to $\phi$Wo20, $\phi$We1 to $\phi$We20, ($\phi$W11 to $\phi$W120, $\phi$Wr1 to $\phi$Wr20, $\phi$Wa, $\phi$Wb): setting signal
$\phi$R ($\phi$Ra, $\phi$Rb): turn-off signal
$\phi$1 (($\phi$1*a*, $\phi$1*b*): turn-on signal
C (Ca1 to Ca20, Cb1 to Cb20): light emitting chip
L: light emitting thyristor
T: transmission thyristor
S: setting thyristor
TE1, TE2: setting enabling thyristor
TE1, TR2: turn-off thyristor
D: coupling diode
Rx, Ry, Rz: connection resistor
SDw: setting Schottky diode
SDe: enabling Schottky diode
Vga: power potential
Vsub: reference potential

What is claimed is:

1. A light emitting apparatus comprising:

a plurality of light emitting chips that each have a plurality of light emitting devices and are divided into a plurality of chip groups, the light emitting devices in each of the light emitting chips being divided into a plurality of device groups;

a first wire that transmits in common a transmission signal to the light emitting chips in order to successively set the light emitting devices in each of the light emitting chips as subjects of turn-on or non-turn-on control;

a second wire that transmits in common a first selection signal to a given chip group of the light emitting chips in order to select the given chip group as a subject of the turn-on control in a period in which the light emitting devices in each of the light emitting chips are set as the subjects of the turn-on or non-turn-on control based on the transmission signal;

a third wire that transmits in common a second selection signal to a set of the device groups in order to select the set of the device groups as a subject of the turn-on control in the period in which the light emitting devices in each of the light emitting chips are set as the subjects of the turn-on or non-turn-on control based on the transmission signal, the set of the device groups including a first device group of the light emitting devices in the light emitting chips belonging to one of the chip groups and a second device group of the light emitting devices in the light emitting chips belonging to the others of the chip groups; and a fourth wire that transmits a turn-on control signal to each of the chip groups in order to control power supply for turning on the light emitting devices in the period in which the light emitting devices in each of the light emitting chips are set as the subjects of the turn-on or non-turn-on control based on the transmission signal.

2. The light emitting apparatus according to claim 1, wherein each light emitting chip of the plurality of light emitting chips includes:

a plurality of transmission devices setting the respective light emitting devices as the subjects of control based on the transmission signal; and a plurality of setting devices selecting the respective light emitting chips as the subject of turn-on based on the first selection signal, wherein each light emitting device of the plurality of light emitting devices is provided to correspond to each setting device of the plurality of setting devices, a plurality of combinations of the setting devices and the light emitting devices that correspond to the setting devices are provided to correspond to the respective transmission devices of the plurality of transmission devices, and each of the device groups is selected and configured for the transmission device from the plurality of combinations of the setting devices provided on the respective transmission devices of the plurality of transmission devices and the light emitting devices that correspond to the setting devices.

3. The light emitting apparatus according to claim 2, wherein each of the light emitting chips further includes an enabling device that is in parallel to the setting device for each of the device groups.

4. A print head comprising:

an exposure unit that includes the light emitting apparatus according to claim 1; and an optical unit that provides light irradiated from the exposure unit onto the image carrier to form an electrostatic latent image on the image carrier.

5. An image forming apparatus comprising:

an image carrier;

a charging unit that charges the image carrier;

an exposure unit that includes the light emitting apparatus according to claim 1;

an optical unit that provides light irradiated from the exposure unit onto the image carrier;

a developing unit that develops the electrostatic latent image formed on the image carrier; and a transfer unit that transfers an image developed on the image carrier onto a transfer body.

* * * * *